US009220297B2

(12) United States Patent
Sebastian et al.

(10) Patent No.: US 9,220,297 B2
(45) Date of Patent: Dec. 29, 2015

(54) MATERIALS, EQUIPMENT, AND METHODS FOR MANUFACTURING CIGARETTES

(75) Inventors: Andries D. Sebastian, Clemmons, NC (US); Alan Benson Norman, Clemmons, NC (US); Paul Stuart Chapman, Winston-Salem, NC (US); Robert Leslie Oglesby, Kernersville, NC (US); Scott William Foor, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 835 days.

(21) Appl. No.: 12/537,840

(22) Filed: Aug. 7, 2009

(65) Prior Publication Data

US 2011/0030709 A1 Feb. 10, 2011

(51) Int. Cl.

| | |
|---|---|
| ***A24D 1/02*** | (2006.01) |
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(Continued)

(52) U.S. Cl.

CPC . *A24C 5/005* (2013.01); *A24C 5/34* (2013.01); *A24D 1/025* (2013.01); *Y10T 428/24355* (2015.01)

(58) Field of Classification Search

None

See application file for complete search history.

(56) References Cited

U.S. PATENT DOCUMENTS

| | | | |
|---|---|---|---|
| 1,555,320 | A | 9/1925 | Weil |
| 1,996,002 | A | 3/1935 | Seaman |

(Continued)

FOREIGN PATENT DOCUMENTS

| | | | |
|---|---|---|---|
| EP | 0 546 576 | B1 | 3/1996 |
| EP | 1 234 514 | A2 | 8/2002 |

(Continued)

OTHER PUBLICATIONS

International Search Report, International Application No. PCT/US 03/40750, mailed Mar. 21, 2005, 6 pages.

(Continued)

*Primary Examiner* — Richard Crispino

*Assistant Examiner* — Phu Nguyen

(74) *Attorney, Agent, or Firm* — Kilpatrick Townsend & Stockton LLP

(57) ABSTRACT

Cigarettes are manufactured using modified automated cigarette making apparatus. Those cigarettes possess smokable rods having wrapping paper having additive materials applied thereto as patterns. The additive materials, which can include a starch and/or a polymer, are applied to a continuous paper web either online or offline the cigarette making apparatus. The formulation can be applied to the paper web using application apparatus possessing a series of rollers. In particular, a wrapping paper for a smokable rod can include a pattern of bands having a water-insoluble material comprising a starch ester, a starch-coated inorganic filler, and/or a thermoplastic polymer in an amount such that the material is sufficiently deformable so as to (a) reduce an amount of pressure to apply the bands, (b) decrease paper diffusivity, and (c) maintain paper opacity at a level acceptable for commercial production of the smokable rods.

33 Claims, 20 Drawing Sheets

(51) Int. Cl.

| | |
|---|---|
| ***A24C 5/00*** | (2006.01) |
| ***A24C 5/34*** | (2006.01) |

(56) References Cited

U.S. PATENT DOCUMENTS

| | | | | |
|---|---|---|---|---|
| 1,999,222 | A | 4/1935 | Weinberger | |
| 2,049,320 | A | 7/1936 | Hans Ruben et al. | |
| 2,580,568 | A | 1/1952 | Matthews et al. | |
| 2,876,160 | A | 3/1959 | Schoch et al. | |
| 3,526,904 | A | 9/1970 | Tamol | |
| 3,632,384 | A | 1/1972 | Saint-Pastou | |
| 3,739,775 | A | 6/1973 | Helm et al. | |
| 3,911,932 | A | 10/1975 | Houck, Jr. et al. | |
| 3,941,904 | A * | 3/1976 | Hoh et al. | 427/208.2 |
| 4,020,272 | A | 4/1977 | Tessler | |
| 4,044,778 | A | 8/1977 | Cohn | |
| 4,077,414 | A | 3/1978 | Baker et al. | |
| 4,187,862 | A | 2/1980 | Cohn | |
| 4,452,259 | A | 6/1984 | Norman et al. | |
| 4,453,553 | A | 6/1984 | Cohn | |
| 4,461,311 | A | 7/1984 | Mathews et al. | |
| 4,480,650 | A | 11/1984 | Weinert | |
| 4,491,485 | A | 1/1985 | Sanderson | |
| 4,607,647 | A | 8/1986 | Dashley et al. | |
| 4,615,345 | A | 10/1986 | Durocher | |
| 4,622,983 | A | 11/1986 | Mathews et al. | |
| 4,889,145 | A | 12/1989 | Adams et al. | |
| 4,998,541 | A | 3/1991 | Perfetti et al. | |
| 5,060,675 | A | 10/1991 | Milford et al. | |
| 5,085,228 | A | 2/1992 | Mooney et al. | |
| 5,263,999 | A | 11/1993 | Baldwin et al. | |
| 5,417,228 | A | 5/1995 | Baldwin et al. | |
| 5,434,201 | A | 7/1995 | Neigel et al. | |
| 5,450,863 | A | 9/1995 | Collins et al. | |
| 5,474,095 | A | 12/1995 | Allen et al. | |
| 5,534,114 | A | 7/1996 | Cutright et al. | |
| 5,587,412 | A | 12/1996 | Borchers et al. | |
| 5,693,786 | A | 12/1997 | Tanaka et al. | |
| 5,780,568 | A * | 7/1998 | Vuorenpaa et al. | 527/300 |
| 5,849,153 | A | 12/1998 | Ishino et al. | |
| 5,878,753 | A | 3/1999 | Peterson et al. | |
| 5,878,754 | A | 3/1999 | Peterson et al. | |
| 5,919,906 | A | 7/1999 | Rowlands et al. | |
| 6,011,092 | A | 1/2000 | Seppälä et al. | |
| 6,020,969 | A | 2/2000 | Struckhoff et al. | |
| 6,062,228 | A * | 5/2000 | Loercks et al. | 131/332 |
| 6,369,215 | B1 | 4/2002 | Peltonen et al. | |
| 6,605,715 | B1 | 8/2003 | Lammers et al. | |
| 6,827,087 | B2 | 12/2004 | Wanna et al. | |
| 6,837,248 | B2 | 1/2005 | Zawadzki et al. | |
| 6,848,449 | B2 | 2/2005 | Kitao et al. | |
| 6,854,469 | B1 | 2/2005 | Hancock et al. | |
| 6,904,917 | B2 | 6/2005 | Kitao et al. | |
| 6,929,013 | B2 | 8/2005 | Ashcraft et al. | |
| 7,073,514 | B2 | 7/2006 | Barnes et al. | |
| 7,234,471 | B2 | 6/2007 | Fitzgerald et al. | |
| 7,264,666 | B2 | 9/2007 | Peltonen et al. | |
| 7,275,548 | B2 | 10/2007 | Hancock et al. | |
| 7,276,120 | B2 | 10/2007 | Holmes | |
| 7,448,390 | B2 | 11/2008 | Barnes et al. | |
| 2002/0062834 | A1 | 5/2002 | Snaidr et al. | |
| 2002/0139381 | A1 | 10/2002 | Peterson et al. | |
| 2002/0179105 | A1 | 12/2002 | Zawadzki et al. | |
| 2002/0179106 | A1 | 12/2002 | Zawadzki et al. | |
| 2003/0037792 | A1 | 2/2003 | Snaidr et al. | |
| 2003/0131860 | A1 * | 7/2003 | Ashcraft et al. | 131/365 |
| 2003/0136420 | A1 | 7/2003 | Kraker | |
| 2003/0145869 | A1 | 8/2003 | Kitao et al. | |
| 2003/0150466 | A1 | 8/2003 | Kitao et al. | |
| 2003/0211351 | A1 | 11/2003 | Figel et al. | |
| 2004/0123874 | A1 | 7/2004 | Zawadzki et al. | |
| 2004/0231685 | A1 | 11/2004 | Patel et al. | |
| 2004/0261805 | A1 | 12/2004 | Wanna et al. | |
| 2007/0101904 | A1 | 5/2007 | Peltonen et al. | |
| 2007/0137668 | A1 | 6/2007 | Borschke et al. | |
| 2008/0115794 | A1 | 5/2008 | Oglesby | |
| 2008/0202542 | A1 | 8/2008 | Hampl et al. | |
| 2008/0216852 | A1 | 9/2008 | Rasouli et al. | |
| 2009/0255441 | A1 * | 10/2009 | Mikkonen et al. | 106/409 |

FOREIGN PATENT DOCUMENTS

| | | | |
|---|---|---|---|
| EP | 1 234 514 | A3 | 1/2003 |
| EP | 1 329 165 | A1 | 7/2003 |
| GB | 2195876 | A | 4/1988 |
| WO | WO 01/08514 | A1 | 2/2001 |
| WO | WO 02/17737 | A1 | 3/2002 |
| WO | WO 02/37991 | A1 | 5/2002 |
| WO | WO 02/43513 | A1 | 6/2002 |
| WO | WO 02/055294 | A1 | 7/2002 |
| WO | WO 02/078471 | A1 | 10/2002 |
| WO | WO 2007/020532 | A1 | 2/2007 |
| WO | WO 2007020327 | A1 * | 2/2007 |
| WO | WO 2007/113693 | A2 | 10/2007 |
| WO | WO 2007/113693 | A3 | 10/2007 |
| WO | WO 2008/081342 | A2 | 7/2008 |
| WO | WO 2009/024870 | A2 | 2/2009 |

OTHER PUBLICATIONS

European Patent Office, Extended European Search Report, Application No. 10167257, dated Aug. 12, 2010.

Canadian Intellectual Property Office, Office Action, Application No. 2,674,802, dated Dec. 24, 2010.

* cited by examiner

MATERIALS, EQUIPMENT, AND METHODS FOR MANUFACTURING CIGARETTES

FIELD OF THE INVENTION

The present invention relates to smoking articles, and in particular, to materials and techniques used for the manufacture of those smoking articles. More specifically, the present invention relates to the manufacture of cigarette rods, and in particular, to additive materials and to systems and methods for applying the additive materials to desired locations of wrapping materials of cigarettes in an efficient, effective, and desired manner.

BACKGROUND OF THE INVENTION

Smoking articles, such as cigarettes, have a substantially cylindrical rod-shaped structure and include a charge, roll, or column of smokable material, such as shredded tobacco, surrounded by a paper wrapper, to form a "cigarette rod," "smokable rod," or a "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate filter elements comprising, for example, activated charcoal particles. Typically, the filter element is attached to one end of the tobacco rod using a circumscribing wrapping material known as "tipping paper."

A cigarette is used by a smoker by lighting one end of that cigarette, and burning the tobacco rod. The smoker then receives mainstream smoke into his or her mouth by drawing on the opposite end of the cigarette. During the time that the cigarette is not being drawn upon by the smoker, the cigarette remains burning.

Regulations have been imposed by some states that require cigarettes and other smokable articles to exhibit certain self-extinction (SE) rates. Paper for smokable articles that meet such standards is known as "Fire Standard Compliant" (FSC) paper. To meet these self-extinction standards, some paper for smokable articles includes intermittent bands of materials (that in some instances can be film-forming materials) that reduce paper porosity, or permeability. Reducing paper porosity can control the supply of oxygen to the smokable material, thereby controlling ignition propensity.

Numerous attempts have been made to control the manner that a cigarette burns when the cigarette is not being drawn upon. For example, cigarette papers have been treated with various materials to cause cigarettes incorporating those papers to self extinguish during periods when those cigarettes are lit but are not being actively puffed. Certain treatment methods have involved applying materials to the paper in circumferential bands or longitudinal stripes, creating areas that affect the burn rate of cigarettes incorporating that cigarette papers. See, for example, U.S. Pat. No. 3,030,963 to Cohn; U.S. Pat. No. 4,146,040 to Cohn; U.S. Pat. No. 4,489,738 to Simon; U.S. Pat. No. 4,489,650 to Weinert; and U.S. Pat. No. 4,615,345 to Durocher; U.S. Patent Application Pub. No. 2002/0185143 to Crooks et al.; U.S. Patent Application Pub. No. 2003/0145869 to Kitao et al.; U.S. Patent Application Pub. No. 2003/0150466 to Kitao et al.; and U.S. Pat. No. 6,854,469 to Hancock et al. In addition, numerous references disclose applying films to the paper wrapping materials of tobacco rods. See, for example, U.S. Pat. No. 1,909,924 to Schweitzer; U.S. Pat. No. 4,607,647 to Dashley; and U.S. Pat. No. 5,060,675 to Milford et al.; U.S. Patent Application Pub. No. 2003/0131860 to Ashcraft et al.; and U.S. Patent Application Pub. No. 2004/0231685 to Patel et al.

"Banded" paper wrapping materials that are used for cigarette manufacture possess segments defined by the composition, location, and properties of the various materials within those wrapping materials. Numerous references contain disclosures suggesting various banded wrapping material configurations. See, for example, U.S. Pat. No. 1,996,002 to Seaman; U.S. Pat. No. 2,013,508 to Seaman; U.S. Pat. No. 4,452,259 to Norman et al.; U.S. Pat. No. 5,417,228 to Baldwin et al.; U.S. Pat. No. 5,878,753 to Peterson et al.; U.S. Pat. No. 5,878,754 to Peterson et al.; and U.S. Pat. No. 6,198,537 to Bokelman et al.; and PCT Publication No. WO 02/37991. Methods for manufacturing banded-type wrapping materials also have been disclosed. See, for example, U.S. Pat. No. 4,739,775 to Hampl, Jr. et al.; and U.S. Pat. No. 5,474,095 to Allen et al.; and PCT Publication No. WO 02/44700 and PCT Publication No. WO 02/055294. Some of those references describe banded papers having segments of paper, fibrous cellulosic material, or particulate material adhered to a paper web. See, U.S. Pat. No. 5,263,999 to Baldwin et al.; U.S. Pat. No. 5,417,228 to Baldwin et al.; and U.S. Pat. No. 5,450,863 to Collins et al.; and U.S. Patent Application Publication No. 2002/0092621 to Suzuki. Methods for manufacturing cigarettes having treated wrapping materials are set forth in U.S. Pat. No. 5,191,906 to Myracle, Jr. et al. and PCT Publication No. WO 02/19848.

Additive materials can be applied to cigarette paper wrapping materials during the time that those wrapping materials are being used for cigarette manufacture (i.e., in a so-called "on-line" fashion). However, water-based formulations incorporating those additives, and the paper wrappers to which the additives are applied, have a tendency to remain wet when the additive-treated wrapper reaches the garniture section of the cigarette making machine. Consequently, for example, the additive materials that are applied to a paper web tend to rub off of the paper and onto components of the finger rail assembly that is located near the garniture end of the suction rod conveyor of the cigarette making machine, and onto the tongue and folder components that are located in the garniture region of the cigarette making machine. A build-up of additive material on certain regions of the cigarette making machine can cause cigarette rod formation problems, paper breaks, and machine downtime for cleaning. Such an undesirable tendency for additive materials to transfer from the paper web to surfaces of the cigarette machine is increased with increasing speed of manufacture of the continuous cigarette rod.

It would be desirable to apply additive material in a controlled manner as a predetermined pattern (e.g., as bands) to a continuous strip of wrapping material of the type that is used for the manufacture of smokable rods. As such, it would be desirable to supply a continuous strip of paper web from a roll, apply additive material to that paper strip, and wind that resulting treated paper web on a roll for later use on an automated cigarette making machine (i.e., it would by desirable to provide treated wrapping material in a so-called "off-line" fashion). It also would be highly desirable to provide cigarettes having predetermined patterns of additive materials (e.g., as bands) applied in desired locations to the wrapping materials of those cigarettes, particularly using on-line processes during cigarette manufacture. It also would be desirable to apply additive materials to a continuous web of a wrapping material of a tobacco rod in an efficient and effective manner during the manufacture of that tobacco rod. It also would be desirable to ensure that the wrapping material so treated with additive material meets standards of quality desired by the manufacturer of those tobacco rods. It also would be desirable to apply an additive material onto a web of paper wrapping material in such a manner that reduces the amount of pressure needed to apply the additive material so as to maintain the integrity of the paper and thereby provide paper opacity at a level acceptable for commercial production of smokable rods. It also would be desirable to provide a method for minimizing or preventing transfer of an additive material on a paper web to a cigarette making machine surface; and it also would be desirable that such method operate effectively and be easily implemented within a conventional automated cigarette making machine of the type used to produce commercial quantities of cigarettes.

SUMMARY OF INVENTION

The present invention provides systems, apparatus, and methods for manufacturing smoking articles, such as cigarettes. Certain preferred aspect of the present invention relate to suitable additive materials, such as starch-based formulations. Certain preferred aspects of the present invention relate to manners and methods for transferring additive material to, and retaining an additive material on desired locations of, a wrapping material (e.g., paper wrapping web) that is wound onto a roll for later use for smoking article manufacture. Certain preferred aspects of the present invention relate to manners and methods for transferring additive material to, and retaining an additive material on desired locations of, a wrapping material suitable for use for smoking article manufacture (e.g., paper wrapping web) when manufacturing smoking articles from those materials using a cigarette making machine. That is, preferred aspects of the present invention comprise various embodiments of an apparatus for applying an additive material (e.g., as an adhesive-type of formulation) to a continuous advancing strip of a paper web within a region of an automated cigarette making machine system (e.g., a machine designed to produce a continuous cigarette rod). In the highly preferred aspects of the present invention, an additive material is applied to a paper web in an on-line fashion (i.e., using a cigarette making machine or a component of a cigarette making machine assembly during cigarette manufacturing process). In the most highly preferred aspects of the present invention, the automated cigarette making machine can operate so as to apply a desired additive material, in a desired amount, in a desired configuration, in a desired location, on a continuous strip of paper wrapping material used for the manufacture of a continuous cigarette rod; which strip of paper wrapping material is supplied (and hence the continuous cigarette rod is manufactured) at speeds exceeding about 350 meters per minute, and often at speed exceeding about 400 meters per minute.

Certain cigarette making apparatus and systems of the present invention are characterized as single component systems. A continuous paper web is provided from a source (e.g., a bobbin) associated with a component of such a system (e.g., an unwind spindle assembly of that system). Tobacco filler and components for manufacturing a continuous cigarette rod from the tobacco filler and the continuous paper web are provided using the same component of that system (e.g., using an upwardly moving air stream coupled with a conveyor system and a garniture system, respectively). Such cigarette making apparatus can be adapted to incorporate additive application apparatus that provide ways to apply additive material (e.g., coating formulations) to the continuous paper web in an on-line fashion.

Certain cigarette making apparatus and systems of the present invention are characterized as multi-component systems, and in particular, two component systems. A continuous paper web is provided from a source that is the first component of such a system. Tobacco filler and components for manufacturing a continuous cigarette rod from the tobacco filler and the continuous paper web supplied by the first component are provided using the second component of that system. For preferred two component systems, the two components are independent, stand alone units. Such cigarette making apparatus can be adapted to incorporate additive application apparatus that provide ways to apply additive material (e.g., coating formulations) to the continuous paper web in an on-line fashion.

In one aspect, the present invention relates to methods and techniques for applying an additive material to a substrate, such as a paper web used as a wrapping material for cigarette manufacture. Those methods and techniques are particularly suitable in connection with the operation of an automated cigarette making machine, and for the purpose of applying a predetermined pattern of additive material to a continuous strip of paper web. An additive application apparatus includes a first roller adapted to receive the additive material (e.g., a coating formulation in liquid form) and a second roller adjacent to the first roller adapted to transfer the additive material from the first roller to the substrate (e.g., paper web). That apparatus also includes an additive material reservoir adjacent to the first roller for containing the additive material, and for supplying the additive material to the first roller. The additive material so supplied is positioned within pockets, grooves or indentations within the roll face of the first roller. For that apparatus, the roll face of the second roller is in roll contact with the roll face of the first roller in one location, and the roll face of the second roller is in contact with the paper web in another location; thus allowing for a predetermined transfer of additive material in a two-step manner. That is, when the additive material is supplied to pockets within the roll face of the first roller, that additive material is transferred to the roll face of the second roller; and when the second roller contacts the advancing paper web, the additive material is transferred from the roll face of the second roller and applied to the advancing paper web.

For the foregoing additive application apparatus, the first roller is moved, or otherwise arranged or positioned, into operative rotating engagement with the second roller. Thus, in certain embodiments, such as when the first and second rollers both are located on the same side of the paper web, and when the first and second rollers are in appropriate roll contact, the additive material is transferred from the first roller to the second roller in virtually the same type of pattern as the pattern dictated by the location the pockets on the first roller. When the paper web contacts the second roller, the additive material is transferred from the second roller to the paper web in essentially the same pattern as the pattern dictated by the location of the pockets on the first roller (i.e., the pattern corresponds to the pattern of the pockets on the roll face of the first roller). As such, a suitable method for applying additive material to a web of wrapping material, most preferably in an on-line fashion, is provided.

In another embodiment of an additive application apparatus, additive material (e.g., a coating formulation in paste form) is applied to a substrate (e.g., a paper web) using a system that employs a first roller adapted to (i) receive an additive material from an additive material reservoir, and (ii) apply that additive material to the substrate. Preferably, the first roller comprises a plurality of pockets, grooves or indentations that are aligned or arranged in the form of a pattern on the roll face of that roller. When the additive material is supplied to the first roller, a predetermined amount of the additive material is contained in each of the plurality of pockets. A second roller is in roll contact with the first roller, and the paper web passes through the location or region where those two rollers make roll contact. Such roll contact facilitates transfer of the additive material from the first roller to the paper web.

For the foregoing additive application apparatus, the second roller is caused to move into, and out of, rotating contact with both the paper web and the first roller. When the paper web comes into contact between the first and second rollers in the nip region or location between those rollers, the additive material is transferred from the first roller to the paper web in essentially the same pattern as the pattern dictated by the location of the pockets on the first roller (i.e., the pattern corresponds to the pattern of the pockets on the roll face of the first roller). As such, a suitable method for applying additive material to a web of wrapping material, most preferably in an on-line fashion, is provided.

Another additive application apparatus includes a first roller adapted to receive the additive material (e.g., a coating formulation in liquid form) and a second roller adjacent to the first roller adapted to transfer the additive material from the first roller to a substrate (e.g., continuous advancing paper web). That apparatus also includes an additive material reservoir adjacent to the first roller for containing the additive material, and for supplying the additive material to the first roller. The additive material so supplied is positioned on the roll face of the first roller. For that apparatus, the roll faces of protruding dies extending from the second roller are in roll contact with the roll face of the first roller in one location; and the roll faces of the protruding dies of the second roller are in contact with the paper web in another location; thus allowing for a predetermined transfer of additive material in a two-step manner. That is, when the additive material is supplied to the roll face of the first roller, that additive material is transferred to the roll face of the protruding dies of the second roller; and when those dies possessing additive material on their roll faces contact the advancing paper web, the additive material is transferred from the roll face of the protruding dies of the second roller and applied to the advancing paper web. As such, a suitable method for applying additive material to a web of wrapping material, most preferably in an on-line fashion, is provided.

Another additive application apparatus includes a first roller adapted to receive the additive material (e.g., a coating formulation in liquid foam) on at least a portion of its roll face, a second roller adjacent to the first roller adapted to receive the additive material to at least a portion of its roll face, and an application roller adapted to (i) receive the additive material to desired locations on the roll face thereof from the roll face of the second roller, and (ii) apply that additive material to a substrate (e.g., continuous advancing paper web). That apparatus also includes an additive material reservoir adjacent to the first roller for containing the additive material, and for supplying the additive material to a desired location of the roll face of the first roller (e.g., a continuous groove circumscribing a portion of the roll face of that first roller). As such, the additive material so supplied is continuously positioned on a predetermined region of the roll face of the first roller; and as a result of the roll interaction of the first and second rollers, additive material is applied to a predetermined region of the roll face of the second roller. The roll faces of protruding dies extending from the application roller are in roll contact with the roll face of the second roller in one location; and the roll faces of the protruding dies of the application roller are in contact with the paper web in another location. Thus, there is provided a manner or method for carrying out a predetermined transfer of additive material in a multi-step manner. That is, additive material is supplied to the roll face of a second roller as a result of roll interaction of a first roller and that second roller, and that additive material on the roll face of the second roller is transferred to predetermined locations on the roll face of the application roller. When those locations of the application roller (e.g., those dies possessing additive material on their roll faces) subsequently contact the advancing paper web, the additive material is transferred from the roll face of the application roller and applied to the advancing paper web. As such, a suitable method for applying additive material to a web of wrapping material, most preferably in an on-line fashion, is provided.

Another additive application apparatus includes a first roller adapted to receive the additive material (e.g., a coating formulation in liquid form) and adapted to transfer the additive material to a substrate (e.g., a continuous advancing paper web). The paper web passes between the roll faces of the first roller and a second roller. That apparatus also includes an additive material reservoir adjacent to the first roller for containing the additive material, and for supplying the additive material to the first roller. The additive material so supplied is positioned on the roll face of the first roller. For that apparatus, the roll faces of protrusions or cams extending from the second roller are in roll contact with the roll face of the first roller, and the paper web passes between those roll faces such that both rollers are periodically in contact with the paper web; thus allowing for a predetermined transfer of additive material to the paper web from the roll face of the first roller when the roll faces of the protruding cams of the second roller cause the application of force to the paper web. That is, when the additive material is supplied to the roll face of the first roller, that additive material is transferred to predetermined locations on the surface of the paper web when the protruding cams of the second roller cause the paper web to be pushed against the roll face of the first roller. As such, a suitable method for applying additive material to a web of wrapping material, most preferably in an on-line fashion, is provided.

In yet another aspect, the present invention relates to a system for controlling the heat to which the web of wrapping material is subjected. That is, such a system can be used to control the temperature (e.g., by heating or cooling) the web of paper wrapping material, and any additive material that has been applied to that paper web. One suitable system is a radiant energy system that utilizes electromagnetic radiation in the form of microwave radiation. In a highly preferred embodiment, the moving continuous paper web is subjected to treatment using a heating/cooling device (which most preferably is a radiant heating device) essentially immediately after that paper web has additive material (e.g., a water-based coating formulation) applied thereto.

In yet another aspect, the present invention relates to a system for inspecting a substrate in the form of a wrapping material for smoking article manufacture. The system is particularly well suited for inspection of a web of paper wrapping material that has a discontinuous nature, such as is provided by application of an additive material to all or a portion of that wrapping material (e.g., as a pattern). The system possesses an emitter for directing radiation into contact with the web of material containing a pattern such that the radiation impinges upon the web of material and is absorbed. The system also possesses a detector (e.g., a near infrared sensor or detector, or a non-contact ultrasonic transducer) for receiving reflected radiation from the web, and for forming electrical signals representative of at least one selected component (e.g., water) or representative change in mass of material corresponding to the presence of additive material. The system further includes circuitry for processing the aforementioned electrical signals to determine information relating to the presence of the pattern on the web, and for generating output signals. The system further includes computing logic for receiving the output signals and for determining whether those signals are representative of an unacceptable, irregular pattern on the web or of an acceptable, desired pattern. The system further includes computer logic for receiving information regarding irregular patterns and for signaling rejection of component materials (e.g., formed cigarettes) manufactured from wrapping materials possessing additive material that have been determined to possess irregular patterns.

In yet another embodiment, the present invention relates to system that can be used in an "off-line" manner, and hence, for example, can provide a roll (e.g., a bobbin) of wrapping material having additive material applied thereto. That is, the system can be used to apply a desired pattern of additive material to a continuous strip of wrapping material using a first system located at a first location, and the wrapping material so treated is used at a later time to produce a smoking article using a second system (e.g., an automated cigarette making apparatus) that is located at a second location. As such, the system is not necessarily integrally associated with an automated cigarette making apparatus. Such an off-line system incorporates an application system possessing additive applicator apparatus that is used to apply coating formulation to a continuous substrate, such as a wrapping material for smoking article manufacture. For example, a continuous strip of paper web is fed from a first bobbin, passed through the additive applicator apparatus, and a pattern of additive material is applied to that paper web as a coating formulation. The paper web optionally is passed by an appropriate detection system that is capable of detecting the presence and amount of that formulation on locations on that paper web. Then, the paper web most preferably is routed through a heat control system (e.g., a radiant drying system, such as a microwave drying system) in order to dry the formulation that has been applied to that paper web. Speed of travel of the paper web and speed of operation of the additive applicator apparatus can be controlled, in order to ensure that the formulation is applied in the appropriate manner, in the appropriate amount, and in the appropriate locations on the paper web. Then, the paper web having dried additive material applied thereto is wound onto a core or spool, thereby forming a second bobbin. That second bobbin then can be removed from the system and stored. That second bobbin then can be used to provide the continuous strip of paper web for the manufacture of a continuous smokable rod using a conventional type of cigarette making machine. As such, there is provided a manner or method for (i) providing a bobbin of a continuous strip of wrapping material of a composition and physical configuration suitable for use for manufacture of a continuous cigarette rod using automated cigarette making equipment, (ii) for applying additive material to that wrapping material in an automated fashion such that a pattern of additive material is applied to that wrapping material, (iii) for rewinding the wrapping material to provide a bobbin, and (iv) for providing a bobbin of a continuous strip of wrapping material having additive material applied thereto in a form and physical configuration suitable for use for manufacture of a continuous cigarette rod using automated cigarette making equipment.

In yet another aspect, the present invention relates to certain formulations of additive materials that can be applied to the wrapping material. In that regard, the present invention also relates to wrapping materials having such formulations applied thereto (most preferably in a controlled manner), and to cigarettes manufactured from those wrapping materials. Preferred formulations of additive materials are formulations that incorporate at least one starch and/or at least one modified starch. Water soluble and/or water insoluble filler materials (e.g., calcium carbonate and/or sodium chloride) also can be incorporated into those formulations. Other ingredients, such as preservatives and/or colorants, also can be incorporated into those formulations.

The bands of additive material, which may be film-forming materials, can be applied to the wrapping paper in various ways and utilizing various apparatus. For example, the additive material can be applied onto the substrate by spraying or by inkjet coating; by utilizing a hot embossing technique, such as ultrasonic embossing; without a solvent; by curing at ambient temperature sufficiently to solidify the bands on the substrate; on-line on a cigarette making apparatus during making of the smoking article; and/or offline prior to making of the smoking article.

In another aspect, the present invention relates to a material comprising such components that under action of physical processing (such as pressure and/or heat), the material changes its nature or behavior on or in a wrapping paper. In certain circumstances, the material can behave as a film-forming material. In preferred embodiments, the material can comprise a starch-based material, which can be incorporated into a film-forming material. In other embodiments, the material can comprise a thermoplastic material. In still other embodiments, the material can comprise a thermoplastic material that incorporates a starch-based material. For example, a wrapping paper for a smokable rod can comprise a pattern of intermittent bands applied to a wire side surface of the wrapping paper. In some embodiments, the bands can comprise a water-insoluble material comprising a starch-based material. The starch component can be in an amount such that the material is sufficiently deformable so as to (a) reduce an amount of pressure to apply the bands, (h) decrease paper diffusivity, and (c) maintain paper opacity at a level acceptable for commercial production of the smokable rods. The pattern of bands can be adapted to reduce the porosity of the paper so as to decrease the supply of oxygen to smokable material inside the rod and thereby reduce ignition propensity of the smokable rod.

In preferred embodiments, the starch-based formulation in the additive material can comprise a starch having a particle size, for example, of about 200 nm to about 1000 nm in diameter. In a highly preferred embodiment, the starch comprises a starch ester. The material can include a filler comprising a starch ester filler and another filler, such as a calcium carbonate filler. In a preferred embodiment, the material comprises a filler comprising a starch having a diameter of about 200 to about 400 nm and a calcium carbonate filler, the starch comprising a filler loading of about 20% and the calcium carbonate comprising a filler loading of about 6% based on the total weight of the filler. In some embodiments, the starch in the material can comprise a starch-coated inorganic filler, such as a starch-coated calcium carbonate. In preferred embodiments, the material comprising a starch-coated inorganic filler includes a ratio of starch to calcium carbonate in the range of about 1:1 to about 1:3. Such a ratio of starch to calcium carbonate can be a ratio of thickness of the two materials. Optimization of starch content in a wrapping paper can result in a decrease in paper diffusivity, thereby protecting the integrity of the wrapping paper during application of additive materials. In this way, opacity of the paper can be maintained at a level acceptable for commercial production of the smokable rods.

In some embodiments, the additive material can include a hot melt formulation comprising a thermoplastic polymer. In particular embodiments, the thermoplastic polymer can be combined with a starch-based material, such as a starch ester and/or a starch-coated inorganic filler. Preferably, the hot melt formulation comprises a low melt polymer, for example, having a melting temperature in a range of about 60 degrees C. to about 130 degrees C. The hot melt material can be applied to the paper under various advantageous conditions, including, for example, without a solvent, utilizing ultrasonic waves, and curing at ambient temperature. In a preferred embodiment, the thermoplastic polymer comprises a polycaprolactone. Heating the additive material comprising a thermoplastic polymer and the paper decreases the paper diffusivity, thereby helping to preserve the inherent paper opacity.

In preferred embodiments, the starch-based material, such as a starch ester and/or starch-coated filler, comprises a total loading weight in a range of about 20 percent to about 30 percent of the total weight of the paper and starch-based material. Such a filler loading in a wrapping paper can result in a decrease in paper diffusivity so as to reduce the amount of pressure needed to apply the bands. In this way, the integrity of the wrapping paper can be protected during application of additive materials, thereby maintaining an acceptable level of paper opacity.

In another aspect, the present invention relates to a method of making a wrapping paper for a smoking article. The method can include the steps of: providing a wrapping paper substrate for a smoking article wound on a first roll; unwinding the substrate from the first roll; and applying on the substrate a pattern of intermittent bands comprising a water-insoluble material comprising a starch-based material, for example, a starch ester and/or a starch-coated inorganic filler. The starch component can be in an amount such that the material is sufficiently deformable so as to (a) reduce an amount of pressure to apply the bands, (b) decrease paper diffusivity, and (c) maintain paper opacity at a level acceptable for commercial production of the smoking article. Such a wrapping paper can be utilized to make a smoking article having reduced ignition propensity.

Features of the foregoing aspects and embodiments of the present invention can be accomplished singularly, or in combination, in one or more of the foregoing. As will be appreciated by those of ordinary skill in the art, the present invention has wide utility in a number of applications as illustrated by the variety of features and advantages discussed below. As will be realized by those of skill in the art, many different embodiments of the foregoing are possible. Additional uses, objects, advantages, and novel features of the present invention are set forth in the detailed description that follows and will become more apparent to those skilled in the art upon examination of the following or by practice of the invention.

DETAILED DESCRIPTION OF PREFERRED EMBODIMENTS

Figure 1:
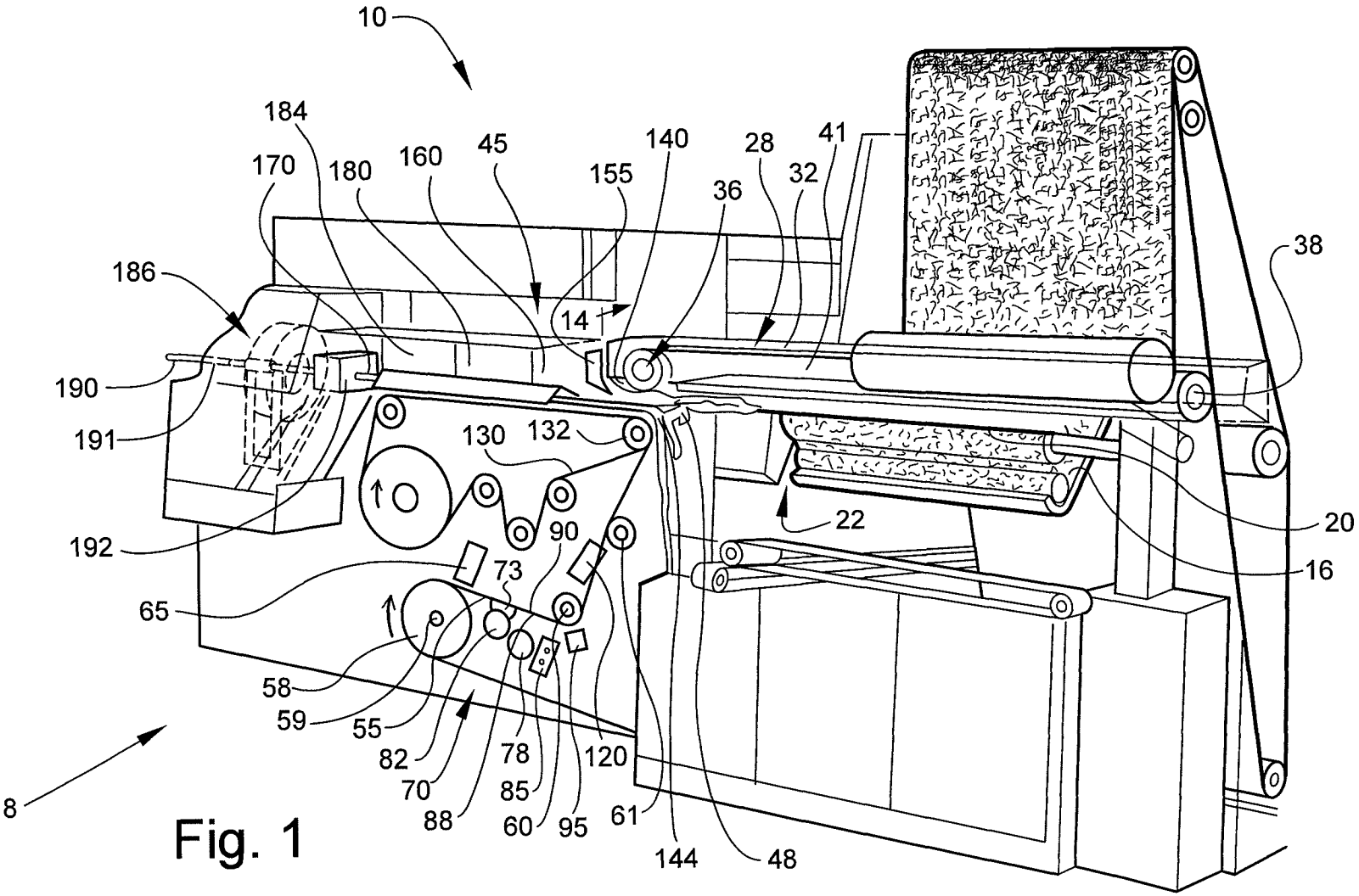
FIG. 1 is a schematic illustration of a portion of a cigarette making machine showing a source of wrapping material, a source of tobacco filler and a garniture region that is used to produce a continuous cigarette rod.

For the purposes of this application, unless otherwise indicated, all numbers expressing quantities, conditions, and so forth used in the specification are to be understood as being modified in all instances by the term "about." Accordingly, unless indicated to the contrary, the numerical parameters set forth in the specification are approximations that can vary depending upon the desired properties sought to be obtained by the embodiments described herein. At the very least, each numerical parameter should at least be construed in light of the number of reported significant digits and by applying ordinary rounding techniques.

Notwithstanding that the numerical ranges and parameters setting forth the broad scope of the described embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10—that is, all subranges beginning with a minimum value of 1 or more, for example, 1 to 6.1, and ending with a maximum value of 10 or less, for example, 5.5 to 10.

As used in this specification, the singular forms "a," "an," and "the" include plural referents unless the context clearly dictates otherwise. Thus, for example, the term "film-forming material" is intended to mean a single film-forming material or more than one film-forming material.

Aspects and embodiments of the present invention include cigarette making machines and components thereof that are useful for manufacturing cigarettes, and in particular, that are useful for transferring and retaining additive material on a paper wrapping web in an efficient, effective and desired manner. FIGS. 1-20 illustrate those aspects and embodiments. Like components are given like numeric designations throughout the figures.

A conventional automated cigarette rod making machine useful in carrying out the present invention is of the type commercially available from Molins PLC or Hauni-Werke Korber & Co. KG. For example, cigarette rod making machines of the type known as Mk8 (commercially available from Molins PLC) or PROTOS (commercially available from Hauni-Werke Korber & Co. KG) can be employed, and can be suitably modified in accordance with the present invention. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,844,100 to Holznagel; U.S. Pat. No. 5,156,169 to Holmes et al. and U.S. Pat. No. 5,191,906 to Myracle, Jr. et al.; U.S. Patent Application 2003/0145866 to Hartman; U.S. Patent Application 2003/0145869 to Kitao et al.; U.S. Patent Application 2003/0150466 to Kitao et al.; and PCT WO 02/19848. Designs of various components of cigarette making machines, and the various material used to manufacture those components, will be readily apparent to those skilled in the art of cigarette making machinery design and operation.

Referring to FIG. 1, a one-component cigarette making machine assembly 8 includes cigarette making machine 10. The cigarette making machine 10 includes a chimney region 16 that provides a source of tobacco filler 20, or other smoking material. The tobacco filler 20 is provided continuously within an upwardly moving air stream (shown by arrow 22), and is blown onto the lower outside surface of a continuous a conveyor system 28. The conveyor system 28 includes an endless, porous, formable conveyor belt 32 that is supported and driven at each end by left roller 36 and right roller 38. A low pressure region or suction chamber 41 within the foraminous belt 32 acts to attract and retain tobacco filler 20 against the bottom of the conveyor system 28. As such, tobacco filler 20 located below the conveyor belt 32 is pulled upward toward that belt, thereby forming the tobacco filler into a tobacco stream or cake on the lower surface of that belt. The conveyor belt 32 thus conveys the stream of tobacco filler 20 to the left; toward a garniture section 45 of the cigarette making machine 10. An ecreteur or trimmer disc assembly 48 assists in providing transfer of the appropriate amount of tobacco filler 20 to the garniture region 45. Descriptions of the components and operation of several types of chimneys, tobacco filler supply equipment and suction conveyor systems are set forth in U.S. Pat. No. 3,288,147 to Molins et al.; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,630,751 to Fagg et al.; and U.S. Patent Application 2003/0136419 to Muller.

Meanwhile, a continuous web of paper wrapping material 55 is supplied from a bobbin 58. The bobbin is supported and rotated using an unwind spindle assembly 59.

The paper web 55 is routed on a desired path using a series of idler rollers and guideposts (shown as rollers 60, 61), through an optional printing assembly device 65, and ultimately through the garniture region 45. Typically, product indicia are printed onto the paper web 55 at predetermined regions thereof using printing assembly 65. Printing assemblies for printing product indicia (e.g., logos in gold colored print) are component parts of commercially available machines, and the selection and operation thereof will be readily apparent to those skilled in the art of cigarette making machine design and operation. Techniques for registering the location of printed product indicia on the ultimate cigarette product (e.g., on the paper wrapper of a cigarette rod in a location immediately adjacent to the tipping material of that product) are known to those skilled in the art of automated cigarette manufacture.

The paper web 55 also is routed through an applicator system 70 prior to the time that the web reaches the garniture section 45. The applicator system 70 is employed to apply a desired pattern of additive material 73 to the paper web 55. A representative pattern is provided by applying spaced bands that are aligned transversely to the longitudinal axis of the paper web 55. A representative additive material 73 is a coating formulation in a liquid, syrup or paste form.

Optionally, though not preferably, the paper web 55 can be routed through a heating/cooling control unit (not shown) immediately before the paper web passes through the applicator system 70. A suitable heating/cooling unit is a heating unit having the form of an infrared heater (not shown), and that heater can be operated at any desired temperature; for example, at a temperature of about 180° C. to about 220° C. The heating/cooling unit can be used to provide the paper web 55 at a desired temperature (e.g., the paper web can be preheated) immediately prior to application of the additive material formulation 73 to the surface of that paper web.

A representative additive applicator 70 comprises a pick-up roller 78 and a transfer roller 82. The pick-up roller 78 includes a plurality of patterned (e.g., evenly spaced apart) pockets on its roll face (not shown) into which a predetermined amount of additive is deposited. The positioning, shape and number of pockets can vary, and typically depends upon the pattern that is desired to be applied to the paper web 55 (e.g., spaced apart pockets can be used to place spaced bands of additive material 73 on the web). For example, in one embodiment of a transfer roller 82, seven pockets each having the form of transversely aligned bands each placed about 46 mm apart. The shape, including depth, of each pocket can determine the amount of additive material that can be carried by that pocket, and hence applied to the paper web 55.

The additive material 73 typically is provided from a supply source reservoir (not shown) through tubing or other suitable supply means (not shown) to a port or supply region 85 near the head (i.e., infeed region) of the pick-up roller 78. The additive material 73 is fed from the head of the pick-up roller into the pockets of the pick-up roller.

If desired, the supply region and the region of the pick-up roller 78, and other relevant regions of the additive applicator 70, can be supplied with heat control system using a suitable heating or cooling device (not shown). As such, a heating device can provide a heated region that can be used to assist in maintaining a solid or very viscous coating formulation in a melted form, such as in the form of a liquid, syrup or paste. A representative heating device is an electrical resistance heating unit controlled by a rheostat; and the heating device can be appropriately fashioned so as to transfer the desired amount of heat to the various components of the additive applicator 70. As such, sufficient heat can be provided to provide coating formulation at a temperature above ambient temperature, and for example, at a temperature within the range of about 120° F. to about 180° F. If desired, heat insulation material (not shown) can be positioned in adjacent regions of the cigarette making machine 10 in order that transfer of heat to other regions of that machine is minimized or prevented.

Operation of the pick-up roller 78 and the transfer roller 82 are timed and controlled relative to the speed of operation of the cigarette making machine 10. As the pick-up roller 78 and the transfer roller 82 are engaged in roll contact, and rotate in contact with each other on their respective peripheral surfaces in a controlled manner, the additive material 73 is transferred from the pockets of the pick-up roller 78 onto predetermined regions of the roll face surface (not shown) of the transfer roller 82. The additive material 73 is transferred onto the transfer roller 82 surface in essentially the same pattern as that of the spaced apart pockets on the pick-up roller 78 (i.e., the pattern applied to the paper web is dictated by the design of the pattern of the roll face of the pick-up roller 78).

The paper web 55 comprises two major surfaces, an inside surface 88 and an outside surface 90. The stream of tobacco filler 20 ultimately is deposited upon the inside surface 88 of the paper web 55, and the additive material 73 most preferably also is applied to the inside surface 88 of that web. As the paper web 55 travels across the surface of the rotating transfer roller 82, the additive material 73 on the surface of the transfer roller 82 is transferred to the inside surface 88 of the advancing paper web 55 at locations corresponding to the location of the pockets located on the roll face of the pick-up roller 78.

After the additive material 73 has been applied to the paper web 55, the web can be exposed to a sensor or detector 95 for a measurement system, such as a registration system and/or an inspection system (not shown). Preferably, the detector 95 is mounted on the frame of the cigarette making machine 10 and is positioned so as to receive information concerning the paper web 55 immediately after additive material 73 has been applied to that paper web. Typically, the detector 95 is a component of certain registration systems and inspection systems of the present invention. Suitable detector systems are described hereinafter in greater detail with reference to FIG. 8. Alternative sensors, detectors and inspection system components and description of inspection system technologies and methods of operation are set forth in U.S. Pat. No. 4,845,374 to White et al.; U.S. Pat. No. 5,966,218 to Bokelman et al.; U.S. Pat. No. 6,020,969 to Struckhoff et al. and U.S. Pat. No. 6,198,537 to Bokelman et al. and U.S. Patent Application 2003/0145869 to Kitao et al.; U.S. Patent Application 2003/0150466 to Kitao et al.; which are incorporated herein by reference.

A representative inspection system employs a capacitance detector positioned downstream from the applicator system 70. A preferred detector is a non-contact detector that can sense changes in the dielectric field of the paper web resulting from the application of additive material to certain regions of that paper web. A representative detector is a Hauni Loose End Detector, Part Number 2942925CD001500000 that is available from Hauni-Werke Korber & Co. KG. The detector is combined with appropriate electronics for signal processing. That is, the detector generates an electrical signal, and appropriate electronic circuitry is used to compare that signal relative to a programmed threshold level. Such a signal allows for graphical display of the profile of applied additive material along the length of the paper web. When application of a band of additive material does not occur as desired (i.e., a band is missing on the paper web, or the amount of additive material that is applied is not the desired amount) a signal is generated. As such, rejection of poor quality rods, and adjustments to the overall operation of the cigarette making machine, can occur. In addition, an output signal from such a measurement system can be used in a feedback control system to maintain the desired level of additive material to the paper web and/or to maintain the desired rate of feed of coating formulation to the applicator system.

Additionally, after the additive material 73 has been applied to the paper web 55, the web can be passed through an optional heating/cooling control device 120. The control device 120 can be used to alter the heat to which the paper web 55 and additive material 73 is subjected (e.g., by raising or lowering temperature). For example, the heating/cooling control device can be a heating or drying device adapted to assist in the removal of solvent (e.g., moisture) from the additive material 73 that has been applied to the paper web 55. Alternatively, for example, the heating/cooling control device can be a cooling device adapted to assist in the hardening melted additive material 73 that has been applied to the paper web 55 using a heated additive applicator system 70. Typically, the heating/cooling control device 120 has a tunnel-type configuration through which the paper web 55 is passed; and during the time that the paper web is present within that tunnel region, the paper web is subjected to heating supplied by a convection or radiant heating device, or cooling supplied by a refrigerant-type, solid carbon dioxide-type or liquid nitrogen-type cooling device.

Optionally, though not preferably, the indicia printing assembly 65 can be modified in order to print formulations other than printing inks and intended for purposes other than product indicia. For example, the printing assembly 65 can be adapted to apply coating formulations having intended purposes other than product indicia. For example, fluid coating formulations (e.g., that incorporate pre-polymer components and are essentially absent of solvent, or that are water-based), can be applied to either the inside surface or outside surface of the paper web 55, using a suitably adapted printing assembly 65. Such coating formulations can be supplied using a pump or other suitable means (not shown) from a reservoir (not shown) through a tube or other suitable supply means (not shown). The paper web 55 having water-based additive material (not shown) applied thereto is subjected to exposure to heat or microwave radiation using heat source 126, in order to dry the coating formulation and fix additive material to the desired location on the paper web. A reflective shield or cover (not shown) can be positioned over that radiation source 126. The previously described heating/cooling control device 120 and/or the radiation source 122 also can be employed.

The paper web 55 travels toward the garniture region 45 of the cigarette making machine 10. The garniture region 45 includes an endless formable garniture conveyor belt 130. That garniture conveyor belt 130 conveys the paper web 55 around a roller 132, underneath a finger rail assembly 140, and advances that paper web over and through a garniture entrance cone 144. The entrance cone 144 also extends beyond (e.g., downstream from) the finger rail assembly 140. The right end of the garniture conveyor belt 130 is positioned adjacent to and beneath the left end of the suction conveyor system 28, in order that the stream of tobacco filler 20 carried by conveyor belt 32 is deposited on the paper web 55 in that region. The finger rail assembly 140 and garniture entrance cone 144 combine to provide a way to guide movement of an advancing tobacco filler cake 20 from the suction conveyor 32 to the garniture region 45. Selection and use of finger rail assemblies and garniture entrance cones will be readily apparent to those skilled in the art of cigarette manufacture.

As the conveyor belt 32 and tobacco filler cake 20 travel within the finger rail assembly 140, vacuum suction applied to the inside region of the conveyor belt 32 is released. As a result, tobacco filler 20 is released from contact with the conveyor belt 32, falls downwardly from that conveyor belt through a longitudinally extending track (not shown) within the finger rail assembly 140, and is deposited onto the advancing paper web 55 at the left side of the garniture region 45 immediately below the finger rail assembly. In conjunction with the release of vacuum from the conveyor belt 32, removal of tobacco filler 20 from the conveyor belt 32 and deposit of that tobacco filler onto the moving paper web 55 is facilitated through the use of a shoe or scrape 155 or other suitable means, that is used to peel or otherwise physically remove advancing tobacco filler 20 off of the outer surface of the extreme left end of the conveyor belt 32.

The garniture section 45 includes a tongue 160 adjacent to the distal end of the finger rail assembly 140 and above the top surface of the garniture conveyor belt 130. The tongue 160 provides a commencement of constriction of the tobacco filler 20 that has been deposited on the paper web 55. Meanwhile, the garniture conveyor belt 130 begins to form that tobacco filler stream and paper web 55 into a continuous rod 170. The tongue 160 extends to a point where the paper web 55 is secured around that stream of tobacco filler. The tongue 160 and the garniture conveyor belt 130 define a passage which progressively decreases in cross-section in the direction of movement of the tobacco filler stream, such that the deposited tobacco filler stream progressively forms a substantially circular cross-section that is desired for the ultimate finished continuous cigarette rod 170.

The garniture section 45 also includes a folding mechanism 180 on each side of the garniture conveyor belt 130 located adjacent to, and downstream from, the tongue 160. The folding mechanism 180 is aligned in the direction of filler stream movement, further compresses the tobacco filler 20 within the rod that is being formed, and folds the paper web 55 around the advancing components of the forming continuous cigarette rod 170. A fashioned continuous tobacco rod that exits the tongue 160 and folding mechanism 180 then passes through an adhesive applicator 184, in order that adhesive is applied to the exposed length or lap seam region of the paper web 55. That is, the exposed length of paper web 55 then is lapped onto itself, and the adhesive is set that region in order to secure the paper web around the tobacco filler 20, thereby forming the continuous cigarette rod 170. The continuous rod 170 passes through a cutting or subdivision mechanism 186 and this subdivided into a plurality of rods 190, 191 each of the desired length. The selection and operation of suitable subdivision mechanisms 186, and the components thereof, will be readily apparent to those skilled in the art of cigarette manufacture. For example, the cutting speed of knife (not shown) within a ledger or other suitable guide 192 is controlled to correspond to the speed that the cigarette making machine 10 is operated. That is, the location that an angled flying knife (not shown) cuts the continuous rod 170 into a plurality of rods 190, 191, each of essentially equal length, is controlled by controlling the speed of operation of that knife relative to speed that the cigarette making machine supplies the continuous rod.

Typically, operation of the conveyor belt 32, garniture belt 130 and flying knife (not shown) within ledger 192 all are mechanically linked to one another by belts or other suitable means, and are driven off of the same power source (not shown). For example, for a cigarette making machine, such as a PROTOS 80 that is commercially available from Hauni-Werke Korber & Co. KG, the main motor of that cigarette making machine is used to drive operation of the conveyor belt 32, the garniture belt 130 and the flying knife. An alternate design of such a type of cigarette making machine can be provided by providing power to the flying knife from one power source, such as the motor of a servo system (not shown); and the power to the garniture belt 130 and the conveyor belt 32 can be provided from a second power source, such as the motor of a second servo system (not shown). The detector 95 (e.g., such as a non contact ultrasonic detector) also can be adapted to provide information regarding location of additive material 73 that has been applied to the paper web 55 to the same processing unit (not shown). Using the processing unit, the positioning of applied pattern on the paper web 55 can be compared to a specified positioning of the pattern, and the processing unit can be used to alter the speed of operation of the two servo systems relative to one another to bring cigarette rods 190, 191 that are out of specification back to within specification. For example, the speed of operation of the flying knife can be increased and/or the speed of operation of the garniture belt can be decreased until cigarette rods are determined to be back within the desired range of tolerance or within specification.

Those cigarette rods 190, 191 then most preferably have filter elements (not shown) attached thereto, using known components, techniques and equipment (not shown). For example, the cigarette making machine 10 can be suitably coupled to filter tipping machine (not shown), such as a machine available as a MAX, MAX S or MAX 80 Hauni-Werke Korber & Co. KG. See, also, for example, U.S. Pat. No. 3,308,600 to Erdmann et al. and U.S. Pat. No. 4,280,187 to Reuland et al.

The cigarette making machine assembly and configuration described with reference to FIG. 1 are representative of a single cigarette making machine that provides both the tobacco filler and the patterned paper web to the garniture region of that machine. Cigarette making machine assemblies and configurations representative of those that provide the tobacco filler to the garniture region from one location, and the patterned paper web to the garniture region from another location, (i.e., multi-component systems), are described with reference to FIG. 2.

Figure 2:
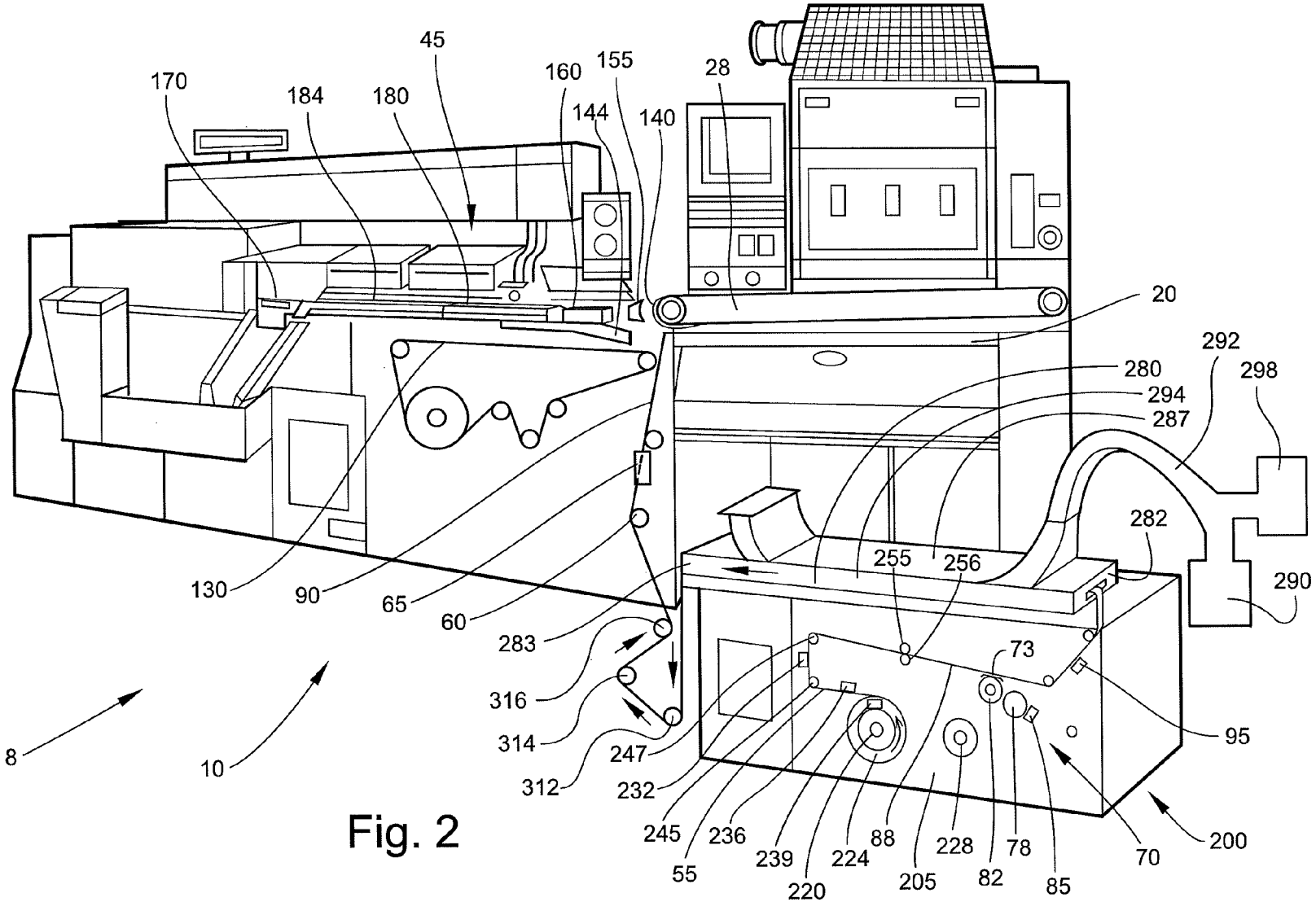
FIG. 2 is a schematic illustration of a cigarette making machine assembly including the combination of a wrapping material supply system and a cigarette making machine.

Referring to FIG. 2, there is shown a two-component automated cigarette making machine assembly 8 that is constructed by coupling a wrapping material supply machine 200 (e.g., a first component) with a cigarette making machine 10 (e.g., a second component).

A suitable wrapping material supply machine 200 can be provided by appropriately modifying a web supply unit available as SE 80 from Hauni-Werke Korber & Co. KG. See, for example, U.S. Pat. No. 5,156,169 to Holmes et al., which is incorporated herein by reference. Other suitable unwind units, such those having the types of components set forth in U.S. Pat. No. 5,966,218 to Bokelman et al., also can be employed. The supply machine 200 most preferably is a free-standing machine that is capable of providing a patterned web of wrapping material 55 to a conventional (or suitably modified) cigarette making machine 10. The supply machine 200 includes a frame 205 that supports at least one unwind spindle assembly 220 onto which a first bobbin 224 is mounted. Preferably, the supply machine 200 includes a second unwind spindle assembly 228 for a second bobbin (not shown), and a web splicing mechanism 232.

The paper web 55 is threaded through a tension sensor 236, which, in conjunction with a braking component 239 is connected to the shaft of the unwind spindle assembly, maintains a desired amount of tension on the paper web 55 as it is transferred from the bobbin 224.

In operation, a continuous paper web 55 supplied from a bobbin 58 is routed through a path defined by a series of idler rollers 245, 247 and guideposts 255, 256. The paper web 55 also is routed through an applicator system 70 that is used to apply a desired pattern of additive material 73 to the paper web 55. A representative additive material 73 is a coating formulation in a liquid, syrup or paste form. Optionally, though not preferred, the paper web can be routed through a heating/cooling control unit (not shown) immediately before the paper web passes through the applicator system 70.

A representative additive applicator 70 comprises a pick-up roller 78 and a transfer roller 82, and can be operated in essentially the same manner as described previously with reference to FIG. 1. The additive material 73 typically is provided from a supply source reservoir (not shown) through tubing (e.g., Tygon-type or polyethylene tubing) or other suitable supply means (not shown) to a port or supply region 85 near the head (i.e., infeed region) of the pick-up roller 78. If desired the supply region and the region of the pick-up roller can be supplied with heat using a suitable heating device (not shown). The additive material 73 is fed from the head of the pick-up roller into the pockets of the pick-up roller. As the pick-up roller 78 and the transfer roller 82 are engaged in roll contact, and rotate in contact with each other, the additive material 73 is transferred from the pockets of the pick-up roller 78 onto predetermined regions of the roll face surface (not shown) of the transfer roller 82. The additive material 73 is transferred onto the transfer roller 82 surface in essentially the same pattern as that of the spaced apart pockets on the pick-up roller 78 (i.e., the pattern on the paper web is defined by that pattern on the roll face of the pick-up roller). The additive material 73 most preferably also is applied to predetermined locations on the inside surface 88 of the paper web 55.

After the additive material 73 has been applied to the paper web 55, the web can be exposed to a sensor or detector 95 for a registration system and/or an inspection system (not shown). Preferably, the detector 95 is positioned so as to receive information concerning the paper web 55 immediately after additive material 73 has been applied to that paper web. Typically, the detector 95 is used in conjunction with the certain registration systems and inspection systems of the present invention. Suitable detector systems are described hereinafter in greater detail with reference to FIG. 8. Alternative sensors, detectors and inspection system components and description of inspection system technologies and operation are set forth in U.S. Pat. No. 4,845,374 to White et al.; U.S. Pat. No. 5,966,218 to Bokelman et al.; U.S. Pat. No. 6,020,969 to Struckhoff et al. and U.S. Pat. No. 6,198,537 to Bokelman et al.; which are incorporated herein by reference.

Additionally, after the additive material 73 has been applied to the paper web 55 (i.e., downstream from the applicator apparatus 70), the web can be passed through an optional, though highly preferred, heating/cooling control device 280, or other suitable means for controlling heat to which the paper web is subjected. The control device 280 can be used to alter the heat to which the paper web 55 and additive material is subjected (e.g., by raising or lowering the temperature). For example, the control device can be a heating or drying device adapted to assist in the removal of solvent (e.g., moisture) from the additive material 73 that has been applied to the paper web 55. Alternatively, for example, the heating/cooling control device can be a cooling device adapted to assist in the hardening melted additive material 73 that has been applied to the paper web 55 using a heated additive applicator system 70. Typically, the heating/cooling control device 280 has a tunnel-type configuration through which the paper web 55 is passed (through an inlet end 282 and out an outlet end 283); and during the time that the paper web is present within that tunnel region, the paper web is subjected to heating supplied using infrared convection or radiant heating devices, or cooling supplied using refrigerant-type, solid carbon dioxide-type or liquid nitrogen-type cooling devices.

Most preferably, the heating/cooling control device 280 is used to provide radiant heating to the paper web 55. An exemplary heating and drying system 280 is available as IMS Model No. P24N002KA02 2 kW, 2450 MHz Linear Drying System from Industrial Microwave Systems, Inc. Representative types of radiant drying systems are set forth in U.S. Pat. No. 5,958,275 to Joines et al.; U.S. Pat. No. 5,998,774 to Joines et al.; U.S. Pat. No. 6,075,232 to Joines et al.; U.S. Pat. No. 6,087,642 to Joines et al.; U.S. Pat. No. 6,246,037 to Drozd et al. and U.S. Pat. No. 6,259,077 to Drozd et al.; all of which are incorporated herein by reference. Such types of radiant drying systems can be manufactured from materials such aluminum and aluminum alloys. See, also, U.S. Pat. No. 5,563,644 to Isganitis et al., which is incorporated herein by reference.

Optionally, radiant-type drying systems can be utilized, because typical infrared-type drying systems require relatively long residence times to adequately remove effective quantities of solvent or liquid carrier (e.g., water) from the paper web 55. For fast moving paper webs 55 running at nominal cigarette making machine speeds, the application of sufficient heat demands the need for relatively long infrared-type drying apparatus. Additionally, sufficient heat from infrared-type drying systems requires the use of relatively high temperatures; thus providing the propensity for scorching and browning of certain areas of the paper web, and the risk of fire. For example, for a conventional cigarette making machine operating so as to produce about 8,000 cigarette rods per minute, and having bands of additive material applied to the advancing paper web so that about 1 mg of water is applied to each individual cigarette rod, about 350 to about 700 watts per hour is effectively required to remove that water from the paper web.

An optional microwave-type drying system is desirable because effectively high amounts of heat can be employed in controlled manners. An exemplary system is one that employs planar wave guide of about 36 inches in length, an internal width of about 1.6 inches, and an internal depth of about 3.7 inches. Preferred wave guides are of dimension to allow passage of only lowest order (i.e., $TE_{10}$) or single mode radiation. An exemplary system also can possess inlet and outlet ends 282, 283 that both have widths of about 1.75 inch and heights of about 0.37 inch. Within the inner region of the drying system, immediately within each end of the inlet and outlet ends 282, 283, are positioned choke flanges, pin chokes (not shown) or other means to assist in the prevention of escape or leakage of radiation from the system; and those flanges or pins typically extent about 3 inches into the system from each respective end.

Microwave-type drying systems can apply heat to desirable locations on the paper web 55 where heat is needed (i.e., in the printed regions of the paper web). In one preferred radiant-type drying system, microwave energy is launched at one end of a waveguide and is reflected at the other end of that waveguide, resulting in the paper web experiencing radiant energy for effectively an extended period. Precise drying control can be achieved by attenuating the microwave energy and/or the path of the paper web within the microwave drying system. Such radiant-type drying systems thus can be used to evaporate the solvent or liquid carrier (e.g., water) of the additive material formulations by applying the microwave energy uniformly throughout the patterned region (e.g., to the bands of applied additive material coating formulation).

For a radiant heating system 280 for the embodiment shown in FIG. 2, radiant microwave energy is supplied by a generator 290 for electromagnetic radiation, which is located one end of that system. Typically, higher power generators are used to produce heat to remove greater amounts of moisture; and generators producing up to about 10 kW of power, and usually up to about 6 kW of power, are suitable for most applications. Radiation produced by the generator is passed through appropriate wave guides and circulators (not shown). The microwave radiation passes through a curved wave guide 292 and through a drying region 294 for the paper web 55. A typical drying region for a microwave drying system has a length of about 30 inches. As such, the radiation supplied to the drying system and the paper web 55 move in the same overall direction through that drying system. Radiation that travels through the drying region 294 is reflected by suitable reflector 296 (i.e., a short plate or reflector plate) at the other end of the drying system. That radiation is reflected back through the drying region, back through the channel at the other end of the heating system, and as such, the reflected radiation and the paper web 55 move in an overall counter current manner relative to one another. Any remaining radiation is appropriately redirected through appropriately positioned wave guides and circulators to a dry air-cooled load 298, or other suitable radiation dissipation means. As such, the radiation is converted to heat, and the resulting heat can be removed using electrical fans (not shown) or other suitable means.

In a preferred embodiment (not shown), the positioning of the heating device 280 shown in FIG. 2 is reversed (e.g., the heating device is rotated 180°) such that the paper web 55 enters at the end of the heating device possessing the reflector 296 and exits at the end through which radiation enters the channel 292 from the generator 290. As such, radiation entering the drying system from the source of radiation and the paper web 55 travel in an overall counter current manner relative to one another.

The additive applicator 70 used in conjunction with the supply machine 200 most preferably is driven by a servo drive control system (not shown) or other suitable control means. Suitable servo-based systems and the operation thereof are described in greater detail hereinafter with reference to FIG. 8. As such, the positioning of the additive material on the paper web 55 can be controlled relative to the location that the continuous cigarette rod 170 that is manufactured using the second component 10 is cut into predetermined lengths, and hence, registration of the applied pattern of additive material on a finished cigarette can be achieved. That is, the automated cutting knife (not shown) for subdividing the continuous rod into predetermined lengths can be controlled relative to those components used to apply additive material to the paper web that is used to provide that continuous rod.

The paper web 55 exits the temperature control device 280 and is advanced to the cigarette making machine 10. Direction of the paper web 55 is provided by suitably aligned series of idler rollers 312, 314, 316 (or guideposts, turning bars, or other suitable means for directing the paper web from the first component 200 to the second component 10). Suitable pathways for travel of the paper web 55 can be provided by suitably designed tracks or tunnels (not shown). As such, there is provided a way to direct the paper web from the first component 200 to the second component 10.

The continuous paper web 55 is received from the first component 200 by the second component 10. Typically, the paper web 55 is directed from idler roller 316 to roller 60 of the cigarette making machine 10, or other suitable location. The paper web 55 travels through printing assembly 65 where indicia can be printed on the outer surface 90 of that web, if desired. The paper web 55 then travels to the garniture region 45 of the cigarette making machine 10, where there are provided components for manufacturing a continuous cigarette rod 170 by wrapping the tobacco filler 20 in the paper web. The garniture conveyor belt 130 advances that paper web through that garniture region. At the left end of the suction conveyor system 28, tobacco filler 20 is deposited from its source on the foraminous belt 32 onto the paper web 55. The garniture region 45 includes finger rail assembly 140, garniture entrance cone 144, scrape 155, tongue 160, folding mechanism 180 and adhesive applicator 184, that are employed to provide a continuous cigarette rod 170. The continuous rod 170 is subdivided into a plurality of rods (not shown), each of the desired length, using known techniques and equipment (not shown). Those rods then most preferably have filter elements attached thereto, using known techniques and equipment (not shown).

The cigarette making machine assembly and configuration described with reference to FIG. 2 are representative of cigarette making machine assemblies and configurations that can be used to provide tobacco filler 20 to a garniture region 45 from one location, and the patterned paper web 55 to the garniture region from another location. Furthermore, the representative cigarette making machine assembly (i.e., with the component that provides the patterned paper web positioned to the front and to the right of the component that incorporates the tobacco source and the garniture assembly) is such that the general direction of travel of the paper web through the wrapping material supply machine is essentially parallel to the direction of travel of the paper web through the garniture region of the cigarette making machine. However, the positioning of the wrapping material supply machine to the cigarette making machine can vary. For example, the wrapping material supply machine 200 can be positioned beside or behind the cigarette making machine; or positioned generally perpendicular to the garniture region of the cigarette making machine 10. In such circumstances, the path of travel of the paper web from the wrapping material supply machine to the cigarette making machine can be accomplished through the use of appropriately positioned idler bars and roller guides. The exact path of travel of the paper web is a matter of design choice, and the selection thereof will be readily apparent to those skilled in the art of design and operation of cigarette manufacturing equipment.

Figure 3:
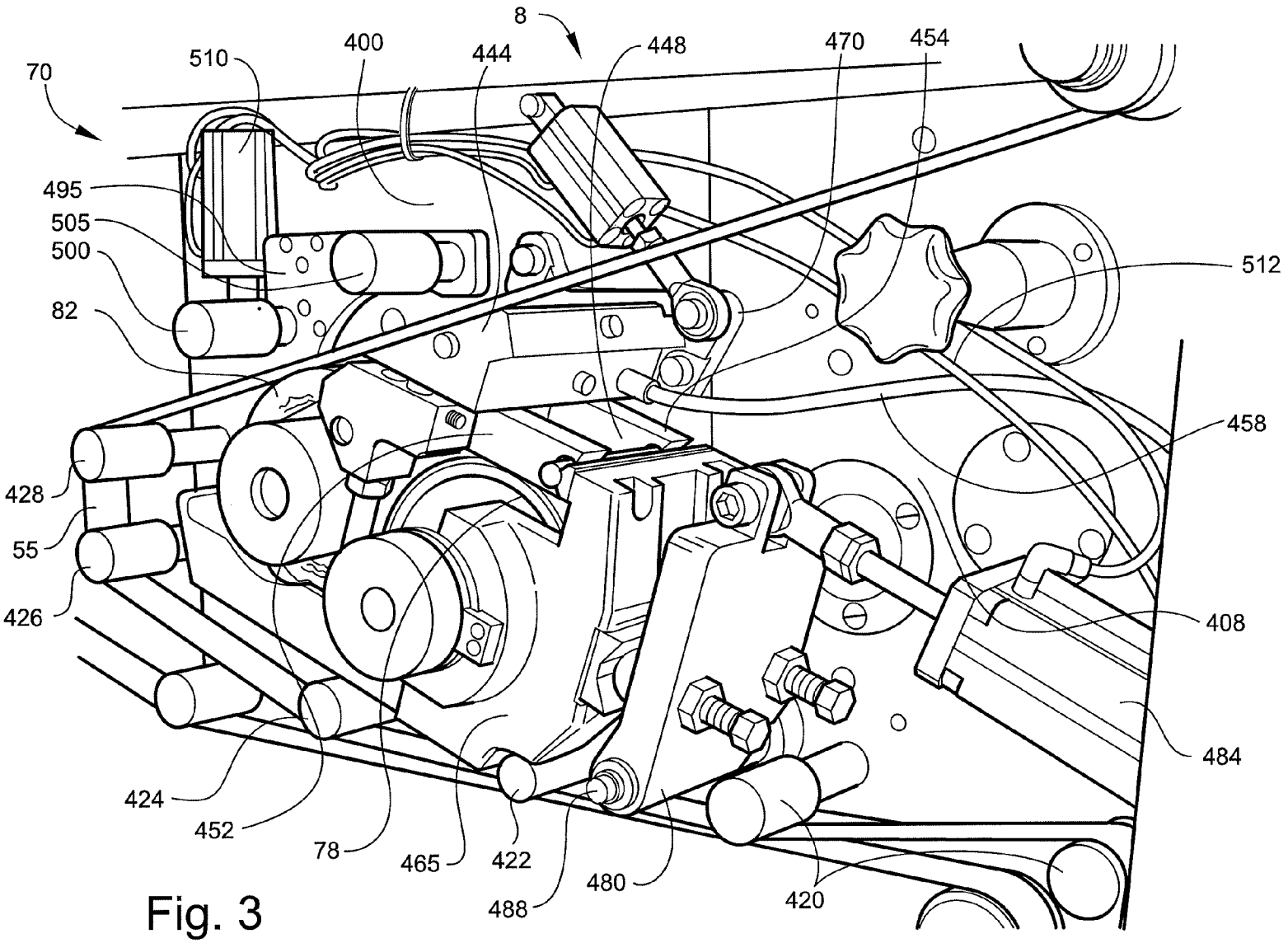
FIG. 3 is a perspective of an additive applicator apparatus of one embodiment of the present invention, that additive applicator apparatus being mounted at an appropriate location on a cigarette making machine assembly.

Referring to FIG. 3, there is shown a portion of a cigarette making machine assembly 8 of the present invention. In particular, there is shown an additive applicator apparatus 70 representative of one aspect of the present invention. Such an additive applicator 70 is particularly useful for applying to a paper web 55 additive materials that are not particularly viscous (e.g., formulations of additive materials having viscosities of less than about 1,000 centipoise).

Additive applicator 70 is an assembly that includes a pick-up roller 78 and a transfer roller 82 mounted adjacent to each other and through a first or front roller support plate 400 on the exterior front face of the cigarette making machine assembly 8. A second or rear roller support plate 408, located in the plane of and adjacent to the front roller plate 400, provides a surface to which other structures of the additive applicator 70 are mounted. Components of the additive applicator apparatus 70, including rollers 78, 82 and support plates 400, 408 are manufactured from materials such as stainless steel or hardened carbon steel. Several fixed or rotatable guide rollers 420, 422, 424, 426, 428 are suitably fixedly mounted; such as to either the front roller plate 408 or rear roller plate 410, depending upon the desired location of those guide rollers. Those guide rollers provide the path over which the paper web 55 travels from a bobbin (not shown), past the additive applicator 70, and on to other downstream destinations of the cigarette making machine assembly.

The additive applicator 70 also includes a manifold 444 positioned above an additive material reservoir 448, which is defined by the positioning of a reservoir front arm 452 and a reservoir rear arm 454. Those arms 452, 454 are positioned above the pick-up roller 78. Tubing 458, or other suitable supply means, is connected to the manifold 444 and originates at a source of additive material (not shown) to provide an input of additive material to reservoir 448, and hence to the roll face of the pick-up roller 78. That portion of the additive applicator assembly thus provides a sealed path for flow of additive material to the region where that additive material is deposited onto the pick-up roller. Preferably, the reservoir front arm 452 and rear arm 454 each include at least one port (not shown), located on the bottom sides of each of those arms 452, 454. At least one of those ports is an output port through which additive material is supplied to the roll face of the pick-up roller 78. At least one other port is an input port through which a suction pump (not shown) suctions excess additive material from the edges of the pick-up roller 78, and pumps excess additive material back into the reservoir 448 defined by arms 452, 454. The assembly also includes a collection pot 465 positioned adjacent to and slightly below the pick-up roller 78. The collection pot 465 serves as a temporary collection location for excess additive material removed from the pick-up roller 78.

The manifold 444 is attached to a glue manifold pivot plate 470, which is attached to the front roller plate 400 and the rear roller plate 408. Such attachment leaves the manifold 444 with the capability of moving upward and downward about a manifold pivot pin (not shown). Movement of the manifold 444 upward from the operative position allows access to those regions located below the manifold. Access to that region is desirable have access to the reservoir arms 452, 454, to insert, remove and service the pick-up roller 78, and for maintenance and service of the collection pot 465. In addition, the reservoir arms 452, 454, are movable upward and downward about a reservoir pivot shaft (not shown) to allow access to the pick-up roller 78 and the collection pot 465.

The transfer roller 82 and the pick-up roller 78 are positioned into operative engagement with one another using a roller pressure plate 480. The roller pressure plate 480 is operably connected to an air cylinder 484, or other suitable means for applying force to rollers 78, 82. The air cylinder 484 utilizes compressed air to force the roller pressure plate 480 about a pressure plate pivot shaft 488 into and out of engagement with the transfer roller 82. Movement of the roller pressure plate 480 to engage and disengage the pick-up roller 78 with the transfer roller 82 can programmed, and as such a microprocessor associated with the operation of the cigarette making machine can be used to control movement of that plate 480.

The additive applicator 70 further comprises a roller lift bracket 495 mounted to the front roller plate 400, and that lift bracket is movable. The roller lift bracket 495 includes a pair of rollers 500, 505, or other suitable means for controlling the path of travel of the paper web 55. The roller lift bracket 495 is operably connected to an air cylinder 510, or other suitable means for applying force to the lift bracket. The air cylinder 510 also is connected to a supply of pressurized air by an air tube 512, or other suitable connection and supply means. The air cylinder 510 utilizes compressed air to move the pair of rollers 500, 505 on the roller lift bracket 495 into and out of rotating contact with the advancing paper web 55. For example, when the rollers 500, 505 on the roller lift bracket 495 move downward into contact with the paper web 55, that paper web is likewise moved into rotating contact with roll face of the transfer roller 82. As a result of the contact of the paper web 55 with the transfer roller 82, the additive material applied to the transfer roller is transferred to the inside surface of the paper web, in a desired pattern or fashion. Movement of the roller lift bracket 495 and rollers 500, 505 into and out of contact with the paper web 55 can programmed, and as such a microprocessor associated with the operation of the cigarette making machine can be used to control movement of that bracket 495. The roller lift bracket 495 can be controlled by a signal received from the cigarette making machine, in order that the bracket can be retracted and the paper web 55 can be moved so as to not be in contact with the various rollers when the cigarette making machine is not in normal operation; and as such, problems associated with sticking of the paper web to various components of the applicator apparatus 70 are minimized, avoided or prevented.

In operation, during the process of cigarette manufacture, the pick-up roller 78 is rotated counter-clockwise, and the transfer roller 82 is rotated clock-wise. Those rollers are engaged in contact by pressure supplied by the pressure plate 480. Additive material is fed from a source (not shown) to the manifold 444, and from the manifold to the reservoir 448, from the reservoir to the roll face of the pick-up roller 78, and onto the transfer roller 82. The additive material then is transferred from the transfer roller to the paper web 55 as the paper web advances across the surface of the rotating transfer roller 82. That is, as the paper web 55 advances across the surface of the rotating transfer roller 82, the roller lift bracket 495 is moved downward, and the rollers 500, 505 attached to that roller lift bracket are moved into contact with the advancing paper web 55. As a result, the additive material on the surface of the transfer roller 82 is transferred to the inside surface of the advancing paper web 55 at locations corresponding to the pattern on the roller face of the transfer roller 82. The paper web 55 having additive material applied thereto then is advanced to downstream locations of the cigarette making machine.

Figure 4:
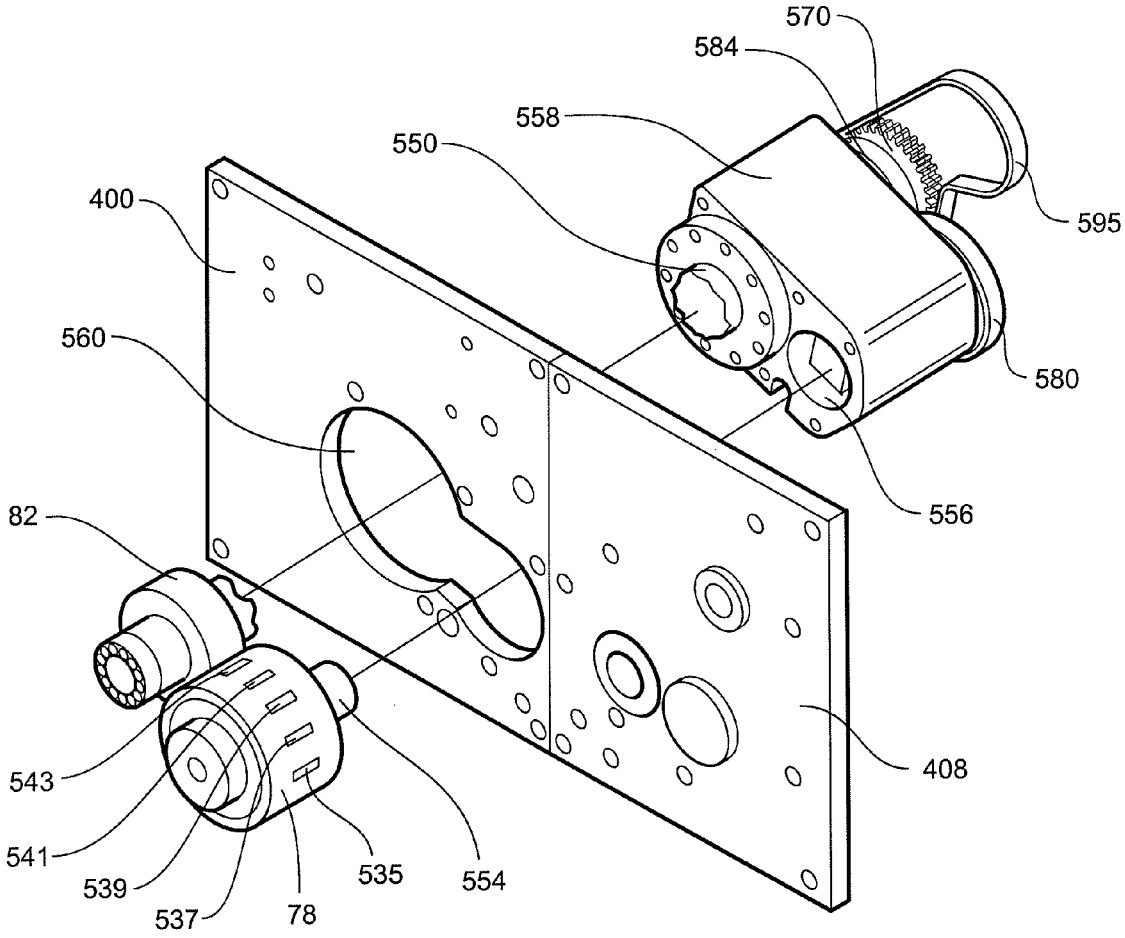
FIG. 4 is an exploded perspective of an additive applicator apparatus of the type shown in FIG. 3.

Referring to FIG. 4, there is shown a portion of an additive applicator apparatus 70 representative of one aspect of the present invention. The pick-up roller 78 and the transfer roller 82 are shown roll contact with one another and in operative engagement. Pick-up rolled possesses a roll face having a pattern of recessed grooves, or pockets, 535, 537, 539, 541, 543, having the form of spaced bands, or other desired pattern. Those recessed grooves provide a location for a predetermined amount of additive material to be deposited, and the size and shape of those grooves is a matter of design choice. The pick-up roller 78 is rotated using a pick-up drive shaft 550 (shown as cut away); and the transfer roller 82 is rotated using an applicator drive shaft 554 (shown as extending from opening 556 in the applicator drive shaft box 558. The drive shafts 550, 554 extend through an opening 560 in the front roller support plate 400, which is adjacent the rear roller support plate 408. The pick-up roller 78 and the transfer roller 82 are adapted to extend beyond the front faces of each of the front and rear roller plates 400, 408.

The applicator drive shaft box 558 is adapted to be positioned and secured to the back side of the front and rear roller plates 400, 408. A pick-up roller gear 580 is in operative connection with the pick-up drive shaft 550. A transfer roller gear 584 is in operative connection with the applicator drive shaft 554. Both gears 580, 584 are located external to the applicator drive shaft box 558, and are positioned on the back side of that drive shaft box 558. Those gears 580, 584 have interlocking teeth such that rotation of one of those gears in one direction causes rotation of the other gear in the opposite direction. The transfer roller gear 584 is connected to a transfer roller pulley 590. A belt 595 extends about the transfer roller pulley 590 and around a power source pulley (not shown). As a result, power for rotational movement is provided to the transfer roller shaft 550 and transfer roller 82 by rotation of the pulley 590 by movement of the belt 595; and power for controlled rotational movement is provided to the pick-up roller 78 by way of the drive shaft 550 that is rotated by operation of gears 580, 584. In addition, belt 595 can act as a timing belt, and by suitable use of that belt to control the speed of the applicator drive shaft 554 relative to the speed of operation of the cigarette making machine, it is possible to provide integral timing with the cigarette rod subdivision mechanism (not shown) of the cigarette making machine. Thus, appropriate use of belt 595 to connect appropriate gear mechanisms yields a method for providing pattern (e.g., band) registration for each individual finished cigarette rods (not shown) that are cut from the continuous rod (not shown).

The applicator assembly 70 of the present invention can further include a photoelectric sensor switch (not shown) located above a point of roller engagement between the pick-up roller 78 and the transfer roller 82. An exemplary sensor is a WT 12-2P430 from Sick, Inc. Output from the photoelectric proximity switch is sent to a PLC or other suitable processor (not shown) associated with that photoelectric sensor (not shown) and monitors the amount (e.g., level) of additive material (not shown) in the region above that point of roller engagement of rollers 78, 82. Thus, as a flow of additive material is supplied from the manifold 44 and reservoir 448, an amount of the additive material forms at the point of engagement between those rollers 78, 82. When the amount of that additive material supplied to that region drops below a predetermined level for sufficient desired transfer of the additive material to the transfer roller 82, the information sensed and supplied by photoelectric sensor controls a switch to activate a pump (not shown), and hence to supply more additive material to the reservoir 448. Similarly, deactivation of the pump can be controlled when a desired level of additive material is achieved.

The applicator assembly 70 can further include sensors (not shown) that assist in ensuring that proper amounts of additive material is transferred to the paper web. For example, an induction-type sensor (not shown) located in the region of a pick-up roller 78 can sense that the pick-up roller, and other associated components of the applicator assembly, are in proper position. In addition, the cigarette making machine can be programmed such that when the induction sensor detects that the pick-up roller is not in proper position, that machine can provide appropriate signal to the operator or cease operation. In addition, a further sensor (not shown) can be mounted on the rear roller plate 408 at a location of the paper web after that paper web has passed over the transfer roller 82. That further sensor can be used to detect the presence, or degree of presence, of additive material on the paper web 55. Detection of a sufficient presence of additive material on the paper web 55 indicates that additive material transfer mechanisms are operating properly. The cigarette making machine can be programmed to alert the machine operator or stop movement of the paper web 55 if the further sensor detects an insufficient presence of the additive material on the paper web 55.

Figure 5:
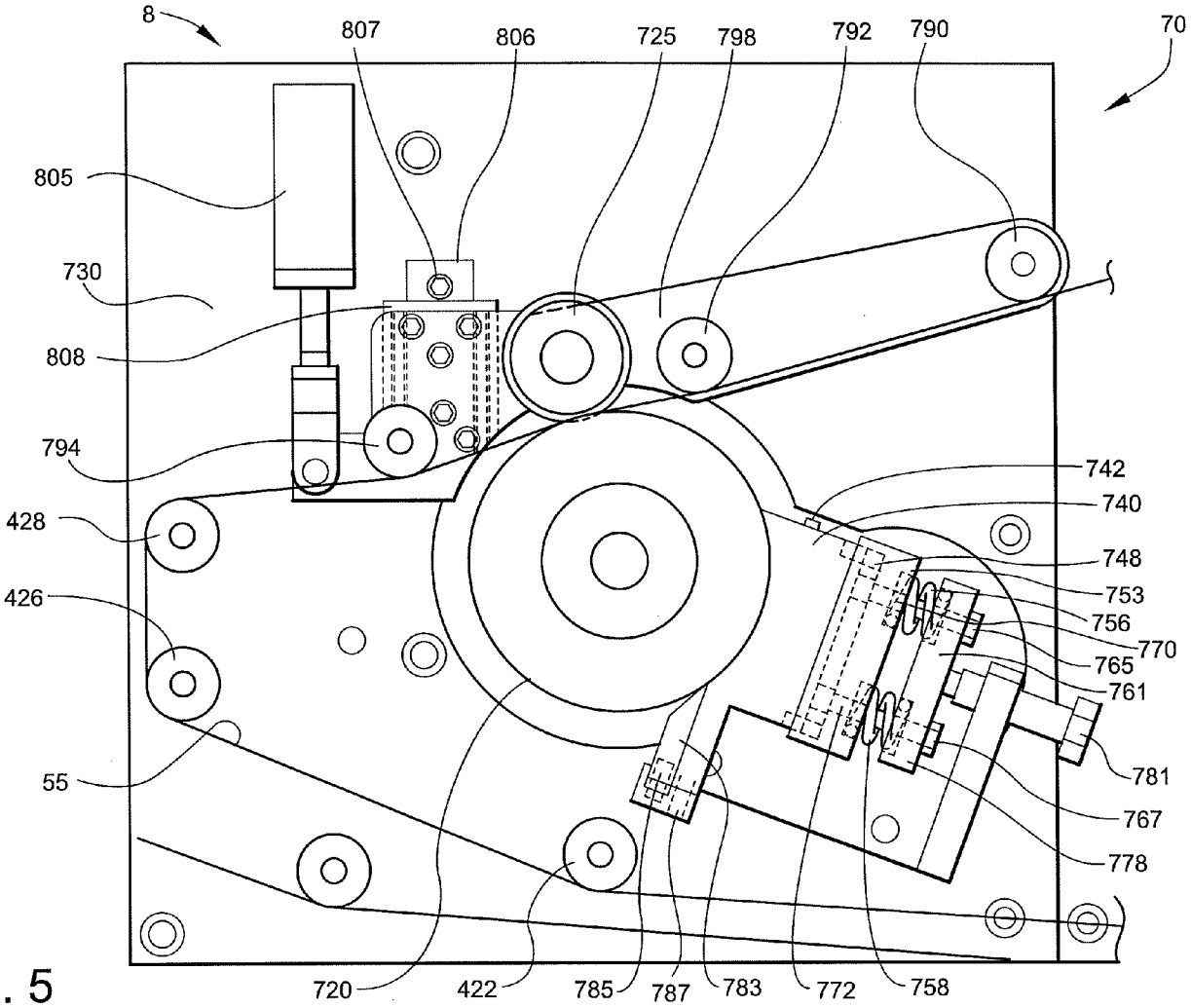
FIG. 5 is a schematic illustration of an additive applicator apparatus of one embodiment of the present invention.

Referring to FIG. 5, there is shown a portion of a cigarette making machine assembly 8 of the present invention; and there also are shown relevant components of another representative embodiment of an additive applicator apparatus 70 of the present invention. Such an applicator 70 is particularly useful for applying to a paper web 55 more viscous additive materials, than those embodiments described previously with reference to FIGS. 3 and 4. More viscous additive materials useful in applications involving cigarette paper include, for example, formulations of additive materials having viscosities of greater than 100,000 centipoise. Such higher viscosity additive materials can be characterized as pastes.

Additive applicator 70 is an assembly that includes a major pick-up/transfer roller 720 and a transfer pressure roller 725 (or back-up roller) mounted adjacent to each other and through a front roller plate 730 secured to front exterior of a cigarette making machine. Each of a plurality of rollers 422, 426, 428 is fixedly mounted to the front roller plate 730; and those rollers provide guides for a path over which the paper web 55 travels from a bobbin (not shown) to the additive applicator 70 and on to other regions of the cigarette making machine 8.

Positioned adjacent to the major roller 720 is a reservoir 740 for the additive material. The reservoir is maintained in place and secured to the front roller plate 730 by bolts (not shown) or other suitable connection means. The reservoir 740 is connected to a source (not shown) of additive material (e.g., a formulation having the form of a paste), through port 742 near the top region of the reservoir 740. As such, a source of additive material for the major roller 720 is provided. Typically, the additive material is supplied through tubing (not shown), such as Tygon-type tubing, that feeds the reservoir 740 through port 742. The additive applicator 70 provides a sealed path for flow of the additive material to the point of deposit onto the major roller 720. The reservoir 740 includes at least two ports (not shown) on the side thereof adjacent to the major roller 720. One port is an output port positioned near the middle of the reservoir 740, through which additive material is supplied to the major roller 720. At least one other port is an input port through which excess additive material is scraped from the edges of the major roller 720, and is fed back into the reservoir 740.

The reservoir 740 is attached to an assembly that is designed to exert pressure upon that reservoir. Such a pressure exerting assembly includes a reservoir pad 748 that is positioned adjacent to the reservoir 740. The reservoir pad 748 is held in position by a reservoir pad retainer 753, which encompasses the reservoir pad 748. Compression springs 756, 758 are positioned between the reservoir pad retainer 753 and a reservoir spring retainer 761, and provide resistance for tightening of the reservoir spring retainer 761 toward the reservoir 740. Screws 765, 767, or other suitable connection means, are positioned through each side of the reservoir spring retainer 761, through the center of each respective compression spring 756, 758, and through a passage in each side of the reservoir pad retainer 753. The screws 765, 767 are movable in and out of respective passages 770, 772 of the reservoir pad retainer 753. The threaded ends of the screws 765, 767 are positioned in threaded contact with threaded walls of the passages 770, 772 of the reservoir pad 748 so as to supply the application of pressure to the reservoir pad 748 when pressure is exerted against the reservoir spring retainer 761.

An adjustment screw mounting plate 778 is attached to the front roller plate 730 adjacent to the reservoir spring retainer 761. An adjustment screw 781 is threaded through the adjustment screw mounting plate 778 into contact with the reservoir spring retainer 761. When the adjustment screw 781 is adjusted a predetermined amount inward into increasingly compressive contact with reservoir spring retainer 761, pressure is applied by the screws 765, 767 to the reservoir pad 748. As a result, a predetermined amount of pressure is exerted on the paste reservoir 740. The additive material formulation is caused to flow to the reservoir 740 by application of head pressure supplied from an upstream pumping system (not shown) or other suitable means. The additive applicator 70 also can be equipped with sensors and control devices (not shown) of the type described previously with reference to FIG. 4.

A scraper plate 783 is connected to the reservoir 740. A compression spring 785 is positioned between a scraper 783 and the scraper plate 787 such that the scraper is urged into operative contact with the roll face of the major roller 720. As such, excess additive material on the surface of the roll face of the major roller 720 is scraped from that roll face as the moving major roller passes the scraper, and that material is deposited back into the reservoir 740. Thus, additive material carried by the major roller 720 for transfer to the paper web is located in the desired location; within the pockets located on the roll face of that roller.

Rollers 790, 792, 794 together with transfer pressure roller 725 are positioned on a roller lift bracket 798. The roller lift bracket 798 is designed to be moved downward by the forces applied by air cylinder 805 about a lift bracket pivot plate 806. The air cylinder 805 is connected to a source of pressurized air (not shown), and is employed to provide for movement of the roller lift bracket 798. The roller lift bracket 798 is attached on one end to the front roller plate 730 about lift bracket pivot plate 806 through roller lift bracket pivot pin 807, and the lift bracket 798 is movable. The roller lift bracket 798 further includes a lift bracket pivot sleeve 808, which is slidingly attached on the end opposite the pivot pin 807 to lift bracket pivot plate 806.

In operation, the transfer pressure roller 725 and rollers 790, 792, 794 can be moved about the pivot pin 807 so as to be positioned into and out of contact with the upper surface of the paper web 55. When the transfer pressure roller 725 is moved into operative contact with the major roller 720, the transfer pressure roller 725 rotates under the power of the major roller 720, but in the opposite direction to that of the major roller. Preferably, the major roller 720 rotates clockwise, and the transfer pressure roller 725 rotates counterclockwise. The transfer pressure roller 725 thus preferably contacts the advancing paper web 55 at a point of engagement of the roll faces of the transfer pressure roller 725 and the major roller 720. As a result of the pressured contact experienced by the paper web 55 as it travels between transfer pressure roller 725 and the major roller 720, additive material is applied to the paper web 55 in a predetermined pattern. Movement of the roller lift bracket 798, transfer pressure roller 725, and rollers 790, 792, 794 into and out of contact with the paper web 55 can programmed, and as such a microprocessor associated with the operation of the cigarette making machine can be used to control movement of that lift bracket 798. The roller lift bracket 798 can be controlled by a signal received from the cigarette making machine, in order that the bracket can be retracted and the paper web 55 can be moved so as to not be in contact with the various rollers when the cigarette making machine is not in normal operation; and as such, problems associated with sticking of the paper web to various components of the applicator apparatus 70 are minimized, avoided or prevented.

Figure 6:
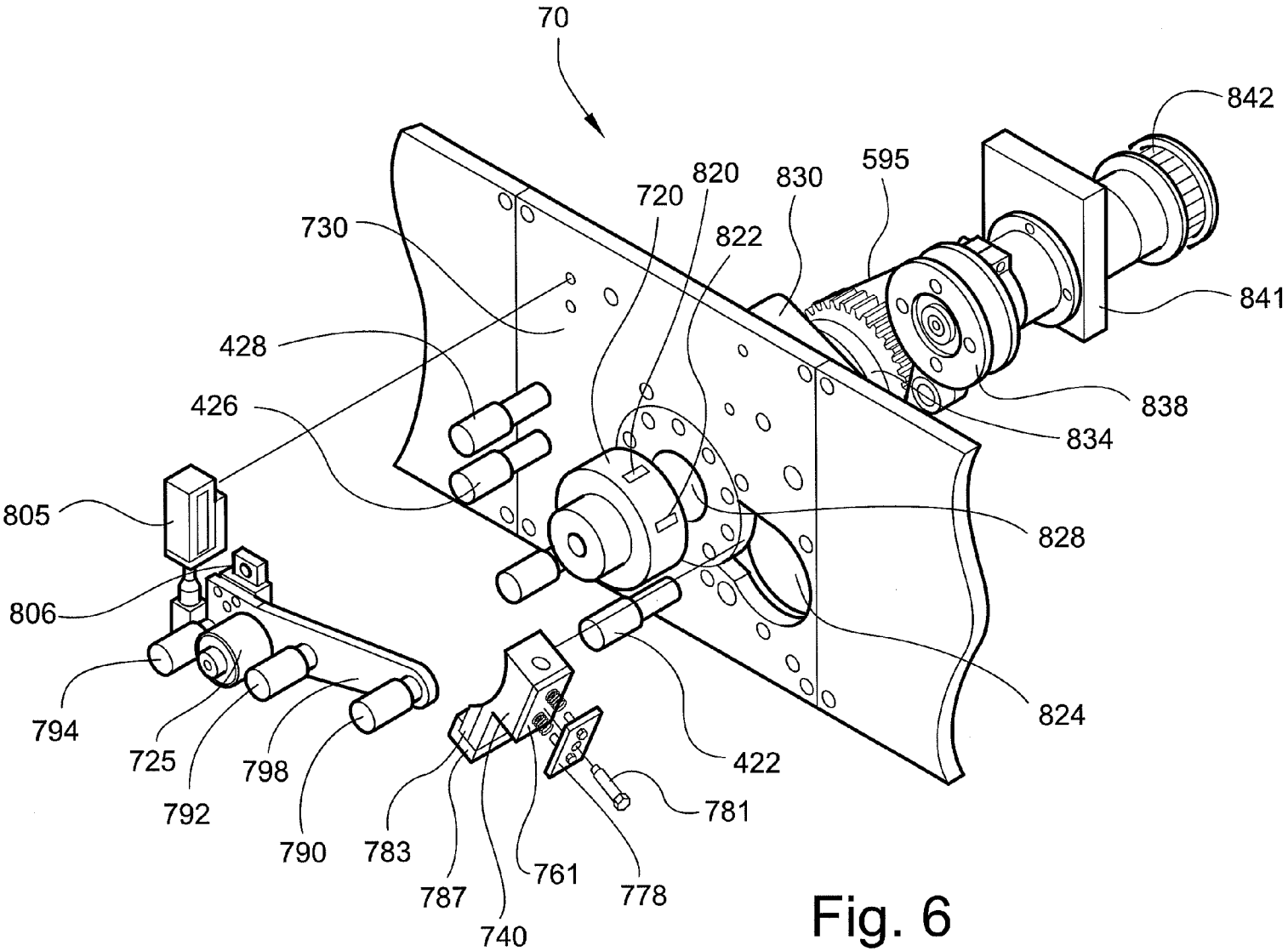
FIG. 6 is an exploded perspective of an additive applicator apparatus of the type shown in FIG. 5.

Referring to FIG. 6, there are shown relevant components of a portion of an additive applicator apparatus 70 representative of one aspect of the present invention. The major roller 720 possesses a roll face having a pattern of recessed grooves or pockets 820, 822; thus providing a pocketed wheel. The diameter of the major roller can vary, but suitable major roller has a diameter of about 104 mm. Exemplary grooves provide spaced bands located so as to extend perpendicularly to the longitudinal axis of a paper web and across a portion of the width of that paper web, and are generally box-like in shape. The dimensions of the grooves can vary, and are dependent upon factors such as the pattern of application that is desired; but suitable grooves have depths of about 2 mils, longitudinally extending lengths of about 5 mm, and transversely extending lengths of about 23 mm. Those grooves 820, 822 are designed to contain additive material (not shown) and to transfer that additive material to a paper web (not shown) that contacts that roller face as the paper web travels past the roll face of the major roller 720. As such, for the pattern shown, spaced apart bands are applied at predetermined intervals transversely to the longitudinal axis of the continuous paper web. That is, the recessed grooves 820, 822 provide a location for a predetermined amount of additive material to be deposited on a paper web; and the size and shape of those grooves is a matter of design choice. The major roller 720 is manufactured from materials such as stainless steel, hardened carbon steel, or the like.

The roller lift bracket 798 supports rollers 790, 792, 794 and back-up roller 725. Back-up roller 725, or "soft-faced" roller, typically is manufactured from stainless steel or hardened carbon steel, and the roll surface is provided by an overlying band or ring of a suitable material such as a rubber-type or elastomeric material. Suitable "soft-faced" rollers 725 are adapted from those types of commonly used for component parts of conventional cigarette making machines, and are manufactured from materials commonly used in conventional cigarette making machines. The roller lift bracket also supports the air cylinder 805 and the pivot plate 806. The diameter of the back-up roller 798 can vary, but a suitable back-up roller has a diameter of about 40 mm.

The reservoir 740 for the additive material is assembled along with the reservoir spring retainer 761, the adjustment screw mounting plate 778, the adjustment screw 781, scraper 783 and the scraper plate 787.

Positioned on the front roller plate 730 are a plurality of rollers 422, 426, 428 and an opening 824. The major roller 720 is connected to a roller drive shaft 828 that passes through opening 824 and to an applicator drive shaft box 830 that is in turn connected to a roller gear 834. A belt 595 extends about the roller gear 834 and around a pulley 838 mounted to a power drive assembly 841. Rotational power is provided from the power drive assembly 841 to the roller gear 834 to the roller shaft 828 and to the major roller 720. Timing belt pulley 842 can be used to receive input regarding the speed of operation of the cigarette making machine, and hence can be use in conjunction with a belt (not shown) to time operation of the other components of the applicator apparatus 70.

Figure 7:
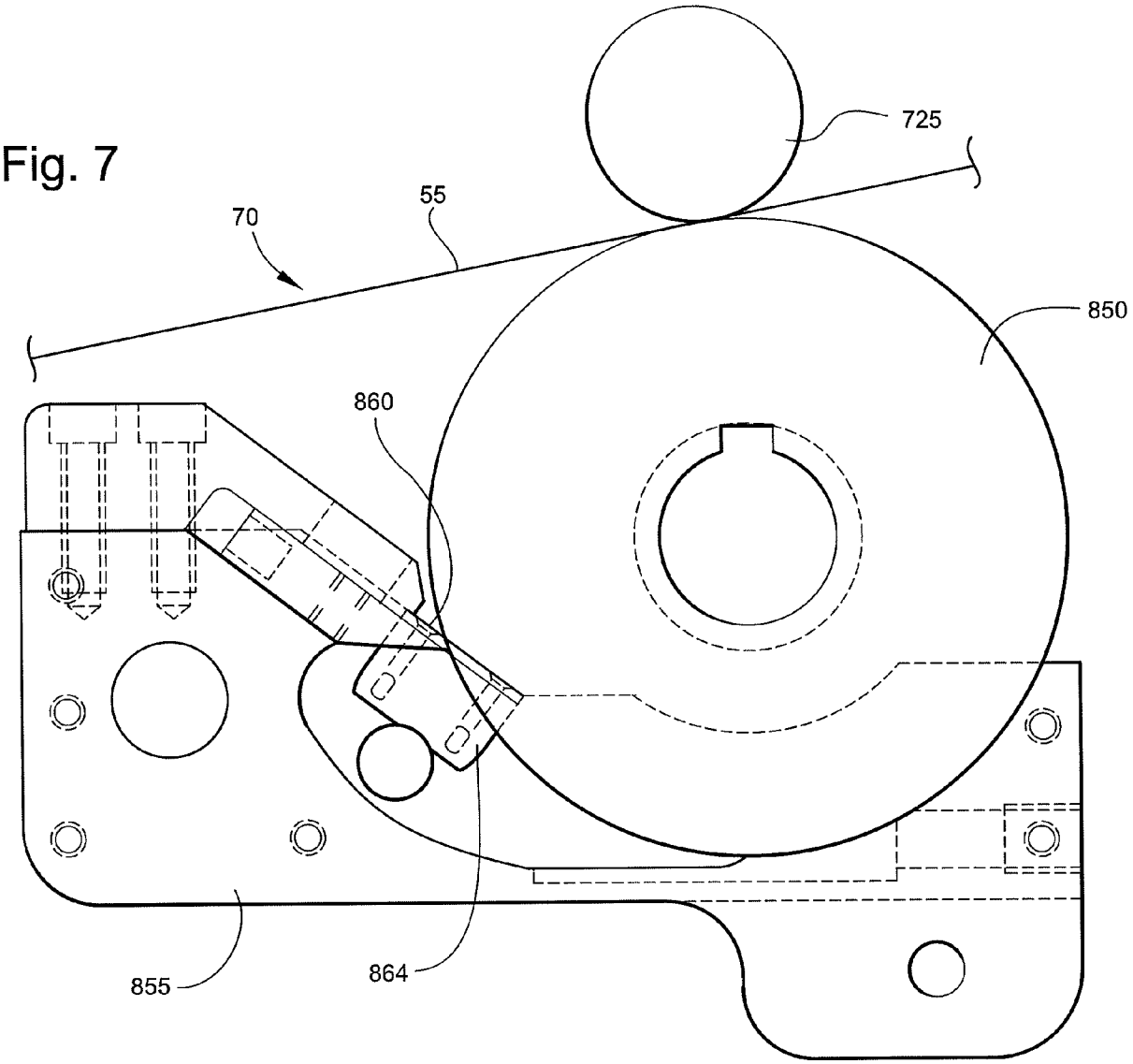
FIG. 7 is a schematic illustration of an additive applicator apparatus of one embodiment of the present invention.

Referring to FIG. 7, there are shown relevant components of a portion of yet another additive applicator apparatus 70 representative of one aspect of the present invention. Other components of the additive applicator apparatus, and the general operation thereof, are described previously with reference to FIGS. 5 and 6. Such an applicator 70 is particularly useful for applying to a paper web 55 more viscous additive materials. More viscous additive materials useful in applications involving cigarette paper include, for example, paste-type formulations of additive materials having viscosities of greater than 100,000 centipoise.

Additive applicator 70 is an assembly including a major pick-up/transfer roller 850 that is generally similar to that pocketed roller described previously with reference to FIGS. 5 and 6. For example, the diameter of the major roller 850 can be about 104 mm, and the major roller can be manufactured from materials such as stainless steel, hardened carbon steel, and the like. Several rollers (not shown) are fixedly mounted to the front roller plate 730; and those rollers provide guides for a path over which the paper web 55 travels from a bobbin (not shown) to the additive applicator 70, between the roll faces of major roller 850 and back-up roller 725, and on to other regions of the cigarette making machine 8.

Positioned adjacent to the major roller 850 is a reservoir 855 for the additive material. The reservoir is maintained in place and secured to the front roller plate 730 by bolts (not shown) or other suitable connection means. The reservoir 855 is connected to a source (not shown) of additive material (e.g., a formulation having the form of a paste), through the top region of the reservoir 855. As such, a source of additive material for the major roller 850 is provided. A portion of the reservoir 855 is shown in phantom in order to show more clearly the positioning of a portion of the major roller 850 within the reservoir, and to more clearly show the positioning of the scrapers 860, 864 against the roll face and side, respectively, of the major roller. Typically, the additive material is supplied through tubing (not shown), such as Tygon-type tubing, that feeds the reservoir 850 through a port (not shown). The additive applicator 70 provides a path for flow of the additive material to the point of deposit onto the major roller 850.

A scraper 860 is connected to the body of the reservoir 855. The scraper 860 is urged into operative contact with the roll face of the major roller 850. As such, excess additive material on the surface of the roll face of the major roller 850 is scraped from that roll face as the moving major roller passes the scraper, and that material is deposited back into the reservoir 855. Thus, additive material carried by the major roller 850 for transfer to the paper web is located in the desired location; within the pockets located on the roll face of that roller. Against the front side face of major roller 850 is positioned a scraper 864. A corresponding scraper (not shown) is positioned against the back side face of the major roller 850. As such, the roll face and both side faces are subjected to surface treatment by three scraper pieces arranged in a "U"-like configuration, so as to remove undesirable excess additive formulation from those surfaces, and hence, maintain those surfaces relatively clean by maintaining those surfaces relatively free of build up of coating formulation.

Figure 8:
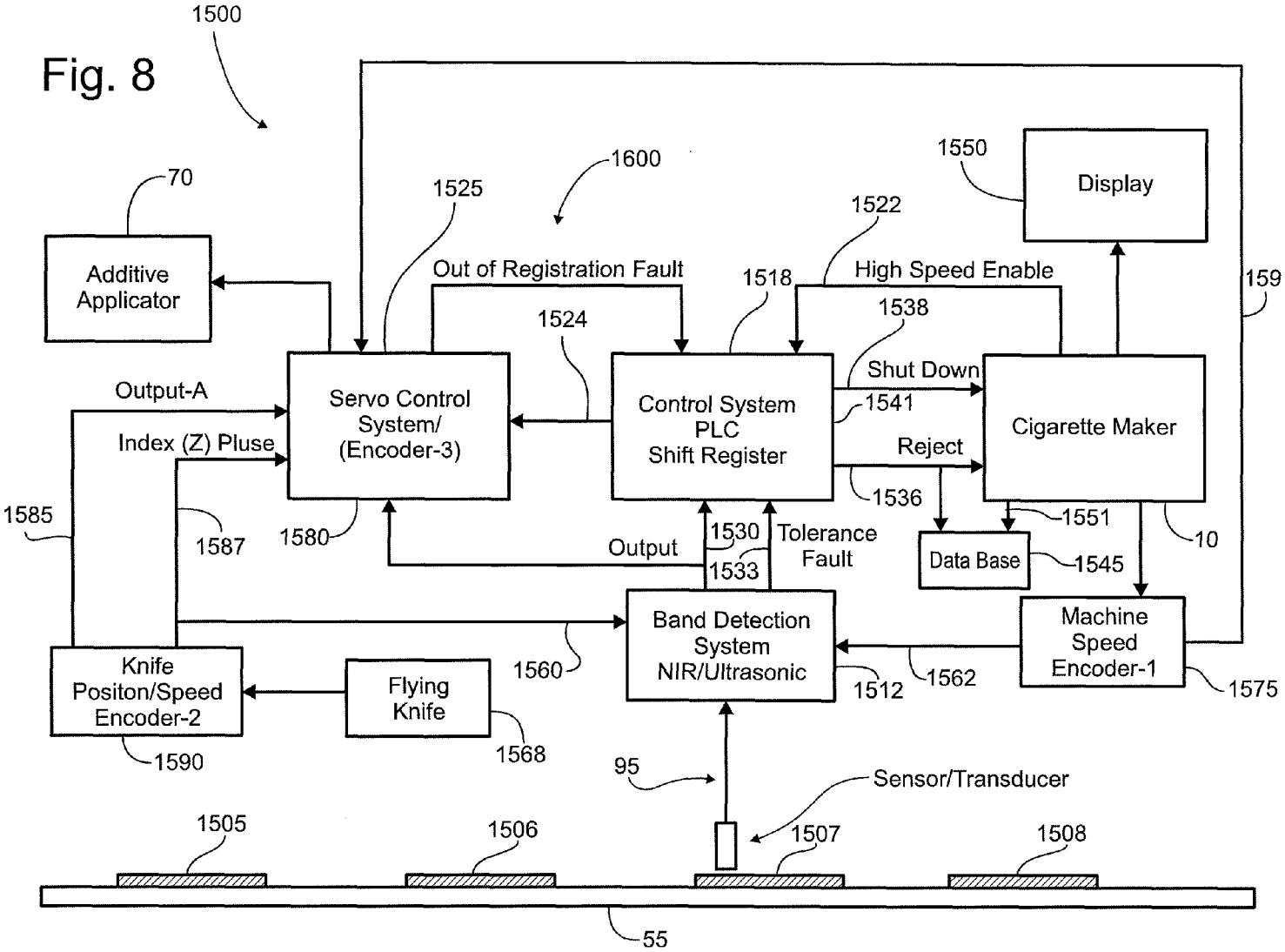
FIG. 8 is a block diagram showing the components and general operation of a registration system and an inspection system.

Referring to FIG. 8, there is shown a block diagram of registration and inspection systems 1500 representative of various aspects of the present invention. Such a system 1500 is useful for inspecting and assisting in the control of manufacture of cigarettes (not shown) that are manufactured from a continuous paper web 55 possessing a predetermined pattern, such as a plurality of bands 1505, 1506, 1507, 1508. The paper web 55 is routed near a detection system 95. The detection system can be spectroscopic system, such as a non-contact ultrasonic transmission system or a near infrared (NIR) absorption system. Such a detection system can be characterized as a non-optical type of detection system. A typical detection system 95 includes a transducer/sensor component 1510 and a processor/analyzer component 1512. A typical ultrasonic detection system 95 utilizes a transducer and an analyzer. A preferred ultrasonic detection system is available as Model NCT 210-P2 6.3 mm 1 MHz transducer 1510 and NCA-1000 2 EN analyzer 1512, available from SecondWave Systems Corp. A typical NIR system 95 utilizes a sensor and a processor. A preferred NIR detection system utilizes a GD 100W NIR sensor 1510 with a 100 microsecond response time and G-NET Verification System processor 1512, available from Nordson Corporation. Typically, detector systems 95 possess response times sufficient to provide adequate information regarding a continuous paper web 55 that is moving at speeds customary on conventional cigarette making machines.

NIR reflectance systems are particularly preferred spectroscopic systems for inspecting samples, such as paper webs that are considered to be opaque, when water is present in the bands and/or paper web. See, *Near-Infrared Technology in the Agricultural and Food Industries*, edited by Phil Williams and Karl Norris, Published by the American Association of Cereal Chemists, Inc. St. Paul, Minn., USA. Typically, the radiation emission source and detector 1510 are housed in the sensor body, and a fiber optic bundle guides the incident light to the paper web through a focusing lens in order to achieve a spot size of about 3 mm. Typically, the reflected radiation is collected by the same lens and fiber optic bundle, and directed back to the detector 1510. Such components of such a system typically have a response time of about 100 microseconds, which is sufficiently fast to detect bands on a cigarette making machine running at speeds sufficient to produce about 8,000 cigarette rods per minute, and having either 1 or 2 bands per cigarette rod. For example, for a tobacco rod length of 60 mm, a nominal tobacco rod making speed of 8,000 rods per minute, and a single band of adhesive of 5 mm width per rod, the detection time for each rod is about 625 microseconds.

NIR spectroscopy measures the chemical concentration of constituents in a sample in the wavelength range of about 850 nm to about 2500 nm. Radiation within such wavelengths can be generated using gratings, band pass interference filters, diodes or high speed electronically controlled acousto-optic transmission filters (AOTF). Exemplary detectors used in NIR spectrophotometric systems are lead sulfide (PbS), silicon (Si) and indium gallium arsenide (InGaAs) detectors. NIR-based systems can be used to detect the presence of chemical constituents, such as water, other components of the coating formulations applied to the paper web, or marker materials that are incorporated into the coating formulations. For many additive formulations that are applied to paper webs in accordance with the on-line application techniques of the present invention, those formulations incorporate water (e.g., in many instances at least about 40 weight percent, and usually at least about 50 weight percent of the applied coating formulation is water). Water has strong absorbance bands at 1450 nm and 1940 nm.

Alternatively, such an inspection system can be configured and utilized to inspect and control manufacture of cigarettes in which bands and/or the paper web do not include water. When water is not present in the bands and/or the paper web, such an inspection system can detect and measure different wavelengths suitable for detecting bands on the paper web.

A PLC-based control system 1518 provides overall supervisory control of the cigarette manufacturing process. For example, the PLC-based control system 1518 can receive, process and provide process control information concerning pattern application of additive material to the paper web 55, inspection of the paper web, conditions associated with drying of additive material that has been applied to the paper web, and rejection of cigarettes that do not meet certain specifications. A suitable PLC-based system is available as SIMATIC S7-300 controller model 6ES7 315-2AF03-0AB0 available from Siemens Energy and Automation, Incorporated.

During cigarette manufacture, when the cigarette making machine reaches the preset speed, and cigarette production is underway, the cigarette making machine 10 sends a high speed enable signal 1522 to the PLC 1518. The PLC processes that signal and generates an output signal 1524 to a servo control system 1525, which in turn, instructs the servo motor (not shown) to engage the additive applicator apparatus 70 for operation (i.e., the roller system is instructed to position itself into operative engagement and begin operation for additive material application). An output signal 1530 representative of the pattern sensed by the detection system 95 is sent to the PLC 1518 for processing, and the PLC determines, among other things, if there is a fault and if cigarette rod rejection is required. In addition, the detection system 95 sends a second signal 1533 (i.e., a tolerance fault) that indicates if pattern deviation (e.g., a band width deviation) is within or beyond a predetermined tolerance level. If a band 1507, 1508 is missing or out of tolerance (i.e., is an incorrect size), such an event is noted and the PLC determines whether to reject 1536 a cigarette or shut down 1538 the cigarette making machine 10, by communication with the cigarette making machine. Internal shift registers 1541 within the PLC 1518 are used to keep track of the reject cigarette rod information sent to the cigarette maker control system for rejection of the reject tobacco rods at the selected downstream rejection location (not shown). The PLC also determines if system shut down is required (e.g., if consecutive sets of rejects above a set value thereby indicating a major or catastrophic fault requiring machine operator intervention), and the shutdown signal 1538 is sent to the control system (not shown) within the cigarette making machine 10. The reject signal 1536 is also sent to a database 1545 for recording to compute efficiency information, and any faults generated by the PLC 1518 are sent through the cigarette making machine control system (not shown) to a graphical display 1550 for feed back to the machine operator. Information 1551 from the cigarette making machine 10 also is sent to the database 1545.

For a system 1500 designed to detect applied patterned bands 1507, 1508 on a paper web 55, such a detection system receives two input signals 1560, 1562. For example, the first signal 1560 can be a trigger signal that corresponds to a 1:1 ratio with the flying knife cut position 1568 of the continuous tobacco rod (i.e., one cut is represented by one pulse), and the second signal 1562 being an encoder signal that corresponds to the speed 1575 of the continuous cigarette rod. In addition to the presence or absence of an applied band, the position of such a band within a rod and the width of that band can be determined by the combination of these two in put signals 1560, 1562.

Figure 9:
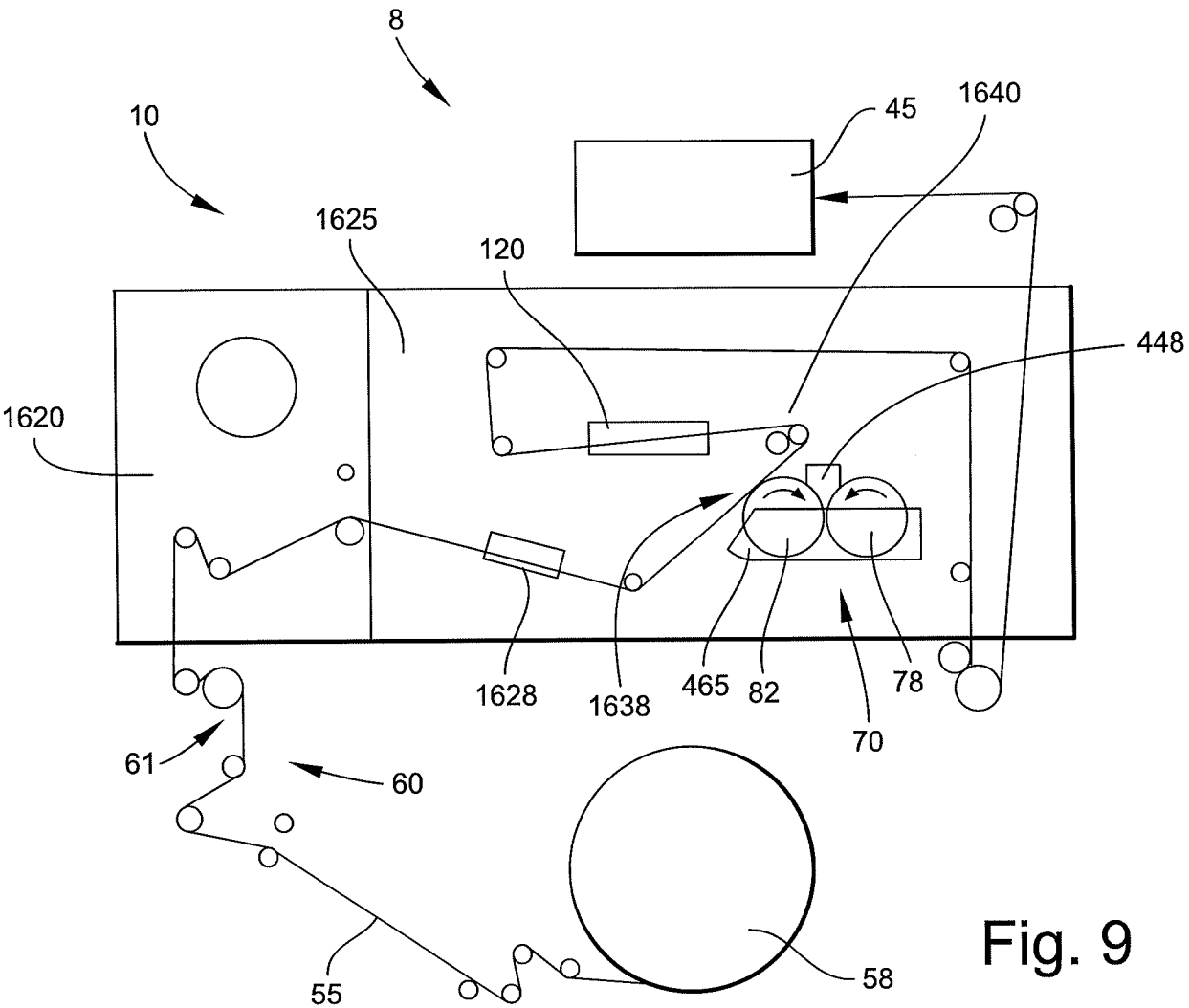
FIG. 9 is a schematic illustration of a side view of an apparatus for making a smoking article and wrapper, and specifically, a schematic illustration of a portion of a cigarette making machine showing a source of wrapping material, an additive applicator apparatus, a source of tobacco filler and a garniture region that is used to produce a continuous cigarette rod.

Referring to FIG. 9, there is shown a schematic illustration of portion of a cigarette making machine 8 having yet another additive applicator apparatus representative of one aspect of the present invention. A portion of a conventional PROTOS cigarette maker 10 manufactured by Hauni-Werke Körber &Co. KG of Germany is shown. The maker 10 is modified to comprise an additive applicator apparatus 70. The cigarette maker 10 includes a large bobbin 58 with a strip 55 of paper web, or cigarette wrapper, wound thereon. Bobbin 58 is mounted for clockwise rotation beneath the cigarette maker garniture 45 and printer section 1620. As the strip 55 of paper web, or wrapper, is unwound from the bobbin 58, it passes around an arrangement of rollers (shown as rollers 60, 61) to take up any slack in the strip 55 and maintain a certain amount of tension on the paper strip.

After the paper strip 55 passes through the printer section 1620, it travels to the additive applicator apparatus region 1625, where it first passes through a paper preheater 1628. The additive applicator 70 is arranged between the bobbin 58 and the garniture 45, and preferably is employed to apply bands of adhesive-type material to the moving paper strip 55. The preheater 1628 is preferably an infrared heater, which preheats the paper web 55 to a temperature in the range of about 180° C. to about 220° C. Preheating of the paper web 55 is optional, but can be preferred, especially in the case of a high speed cigarette maker when preheating the paper can advantageously assist in evaporating the solvent for the subsequently applied additive.

The preheated paper web 55 travels next to the additive applicator assembly 70, sometimes broadly referred to as a "glue pot." The additive applicator assembly 70 comprises a pair of counter-rotating rollers 78, 82, which counter-rotate in the directions shown by the arrows. The additive applicator assembly 70 further comprises an additive feed shoe 448. A drip box 465 encloses the lower portions of the rollers 78, 82 to catch any additive that drips, spatters, or is thrown by centrifugal force or otherwise from the rollers. Rollers 78, 82 are engaged to counter-rotate at identical peripheral speeds, which also correspond to the speed of the paper strip 55 at the point 1638 where the paper strip tangentially contacts the peripheral surface of roller 82. Conventional speed control systems are useful for moving and rotating machine components at precise predetermined speeds and for maintaining zero relative speed between moving and rotating machine components.

Roller 82 is an application roller and roller 78 is a pattern roller, preferably a gravure or intaglio pattern roller provided with a plurality of circumferentially-spaced transverse grooves, or pockets. Additive feed shoe 448 is located between the counter-rotating rollers 78, 82 so as to feed additive material to the pattern roller 78 immediately upstream of the nip between the rollers. Additive material includes adhesives, such as a cigarette seam adhesive, filter plug wrap adhesive, tipping paper adhesive, or the types of additive materials set forth hereinafter. As the rollers 78, 82 counter-rotate, the additive material or adhesive is transferred from the transverse pockets, or grooves, on the pattern roller 78 to the application roller 82 in circumferentially-spaced locations on the peripheral surface of the application roller. The application roller 82 is positioned to bear with a slight upward pressure against the paper strip 55 at point 1638 so as to transfer the additive material to the optionally preheated paper strip 55 in longitudinally-spaced, cross-directional bands (not shown) of a predetermined width and spacing.

After the additive material has been applied to the paper strip 55, the paper strip passes through an infrared paper dryer 120 downstream of the additive applicator assembly 70 and upstream of the garniture 45 of the cigarette maker 10. After passing through the dryer 120, the paper strip 55 with the cross-directional bands on one surface thereof travels via another arrangement of rollers 1640 to the garniture 45 where it is formed about a tobacco rod and bonded along an overlapping longitudinal seam formed by the longitudinal side edges of the paper strip 55. The additive material and the paper strip 55 are dried sufficiently in the infrared paper dryer 120 and during passage over the roller arrangement 1640 so that the paper with the spaced, cross-directional adhesive bands applied to it does not tear when it is wrapped about the tobacco rod in the garniture 45.

The additive applicator apparatus 70 causes the additive bands to be applied to the inside surface of the paper cigarette wrapper (i.e., the surface confronting the tobacco rod) as is preferred. However, the additive applicator apparatus 70 can be arranged on the cigarette maker 10 so that the bands of additive material can be applied to the outside surface of the paper cigarette wrapper, if that is desired.

Figure 10:
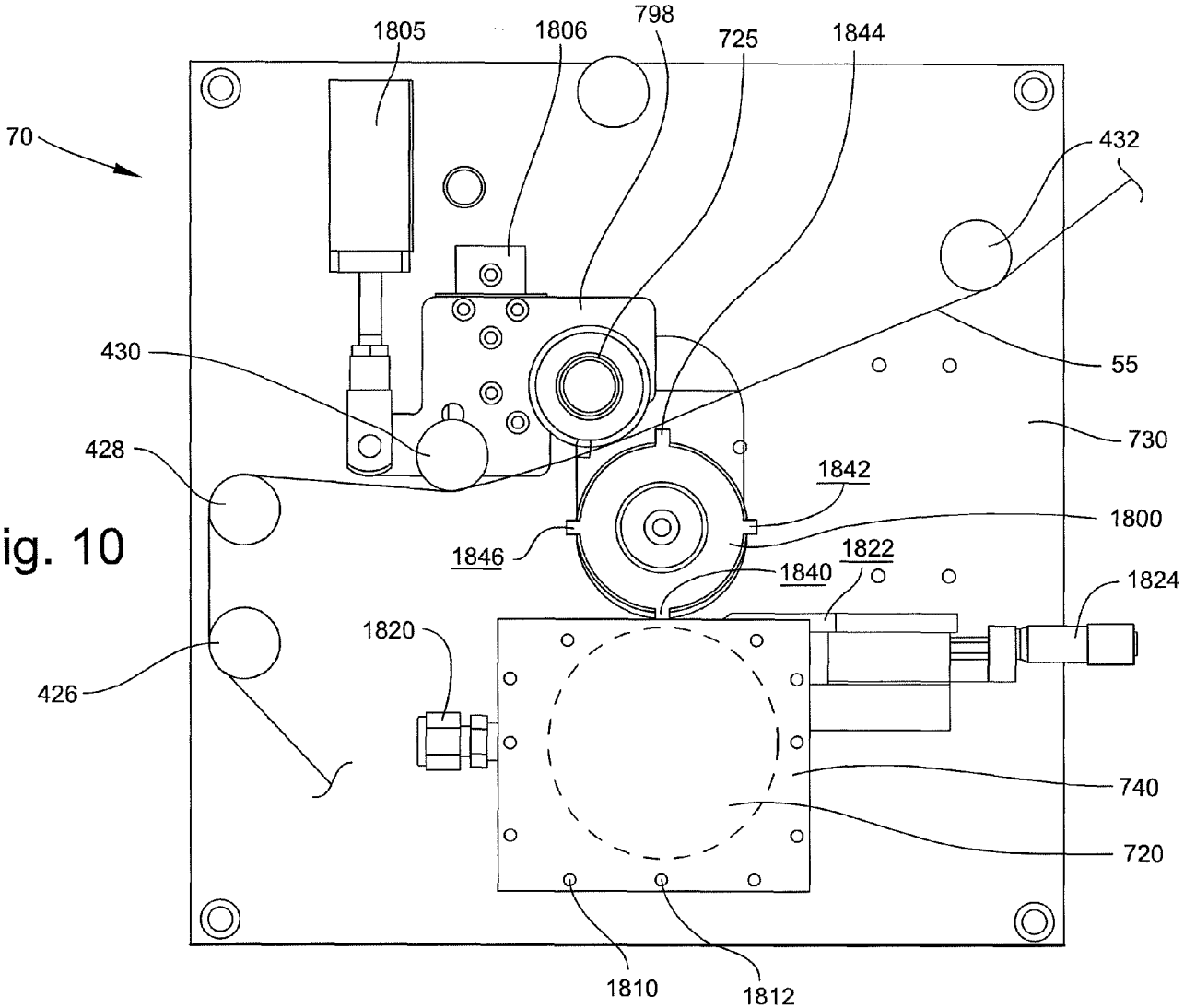
FIG. 10 is a schematic illustration of an additive applicator apparatus of an embodiment of the present invention.

Referring to FIG. 10, there is shown a portion of a cigarette making machine assembly 8; and there also are shown relevant components of another representative additive applicator apparatus 70. Such an applicator 70 is particularly useful for applying to a paper web 55 certain types of viscous additive materials. Such additive materials useful in applications involving cigarette paper include, for example, paste-type formulations of additive materials having viscosities in the range of about 500,000 centipoise to about 2,500,000 centipoise.

Additive applicator 70 is an assembly that includes a pick-up roller 720 and a transfer pressure roller 725 (or back-up roller) mounted on each side of an application roller 1800. Those rollers are mounted through a front roller plate 730 secured to the front exterior region of a cigarette making machine. Each of a plurality of rollers 426, 428, 430, 432 is fixedly mounted to the front roller plate 730; and those rollers provide guides for a path over which the paper web 55 travels from a bobbin (not shown) to the additive applicator 70 and on to other regions of the cigarette making machine 8.

The pick-up roller 720 (shown in phantom) is positioned within a reservoir 740 for the additive material (not shown). The reservoir is maintained in place and secured to the front roller plate 730 by bolts 1810, 1812 or other suitable connection means. The reservoir 740 is connected to a source (not shown) of additive material (e.g., a formulation having the form of a paste), through port 1820 near the top region of the reservoir 740. As such, a source of additive material for the pick-up roller 720 is provided. If desired, the reservoir can be equipped with devices for monitoring the amount of additive material that is present within that reservoir, such as are described hereinbefore with reference to FIG. 4. Typically, the additive material is supplied through tubing (not shown), such as Tygon-type or polyethylene tubing, that feeds the reservoir 740 through port 1820. The reservoir of the additive applicator 70 provides a receptacle for the additive material to the point of deposit onto the pick-up roller 720.

A doctor blade 1822 is positioned near the pick-up roller 720 near the top region of that roller. The doctor blade can be supported in a fixed position relative to the roller, or the doctor blade can be adjustable, for example, by being mounted in so as to be moveable using micrometer 1824. As such, the positioning of the doctor blade 1822 relative to the roll face of roller 720 can be adjusted. Preferably, the doctor blade is positioned in order that additive material that has been applied to the roll face of the pick-up roller is provided in the desired amount. Typically, the doctor blade is positioned so as to provide a layer of additive material on the roll face of the pick-up roller that has the desired thickness, both along the length and width of the roll face. Typically, the doctor blade 1822 is positioned about 0.001 to about 0.002 inch from the surface of the roll face of pick-up roller 720. After the additive material on the roll face of the pick-up roller has been provided in the desired amount, that additive material is transferred from the pick-up roller to the face of appropriate die 1840 of applicator roller 1800.

The pick-up roller 720 preferably is manufactured from a material that can vary, but preferably is manufactured from an elastomeric type material, such as a polyurethane rubber type material, a natural gum rubber, ethylene-propylene diene monomer rubber, or the like. An exemplary pick-up roller has a diameter of about 50 mm to about 100 mm. For the embodiment shown, the pick-up roller rotates counter-clockwise within the reservoir 740, and additive material within the reservoir is deposited on the surface of that roller.

The pick-up roller 720 is in roll contact with a plurality of protruding applicator dies 1840, 1842, 1844, 1846 of application roller 1800. The application roller dies preferably are of the general dimension of the pattern of additive material that is desired to be applied to the paper web 55. An exemplary application roller 1800 is manufactured from stainless steel, elastomeric material, or a combination of those materials. For example, the larger wheel portion of the applicator roller can be manufactured from stainless steel, and the protruding dies can be manufactured as replaceable inserts manufactured from relatively soft elastomeric materials. Alternatively, the wheel and die component parts of the applicator roller can be manufactured from a hard metal material, such as stainless steel. An exemplary applicator roller has a diameter of about 50 mm to about 100 mm, and typically about 85 mm; and possesses four protruding dies each of about 10 mm to about 15 mm in height, about 22 mm to about 25 mm in width, and about 5 mm to about 8 mm in circumferential length. Other sizes and shapes of the dies, other configurations of the dies on the roller, other roller sizes, and the composition of components used to manufacture the roller, can be a matter of design choice. For the embodiment shown, application roller 1800 rotates clockwise.

In a preferred embodiment, each roller 725, 1800 is driven independently. For example, one servo drive (not shown) can control the rotation of transfer roller 725, and a second servo drive (not shown) can control the applicator roller 1800. Controlling operation of the two rollers 725, 1800 with independent servo system allow for independent control of speeds of those two rollers, and hence, the ability to tightly control the tolerances associated with application of additive material to the paper web using those two rollers. Rollers that are independently adjustable also are preferred in that the degree of touching of the roll faces of the respective rollers during roll contact can be controlled. For example, roller lift bracket 798 is slidingly adjustable about pivot plate 1806 by means of actuation by air cylinder 1805 to move roller 725 into and out of roll contact with paper web 55 and protruding dies 1840, 1842, 1844, 1846 of the applicator roller 1800.

In operation, the continuous paper web 55 passes between the roll faces of the transfer roller 725 and the application roller 1800. As a result of the contact experienced by the paper web 55 as it travels between the roll faces of the transfer pressure roller 725 and the applicator roller 1800, additive material transferred to the surfaces of the protruding dies 1840, 1842, 1844, 1846 from the surface of the applicator roller 720 is applied to the paper web 55 in a predetermined pattern. As such, the die faces provide a type of off-set printing of additive material to desired locations on the moving paper web. Movement of the transfer pressure roller 725 can programmed, such as by a microprocessor associated with the operation of the cigarette making machine. Such control by a signal received from the cigarette making machine can allow for retraction of the pressure roller from the paper web 55 so as to not be in contact with the various rollers when the cigarette making machine is not in normal operation; and as such, problems associated with sticking of the paper web to various components of the applicator apparatus 70 are minimized, avoided or prevented.

Figure 11:
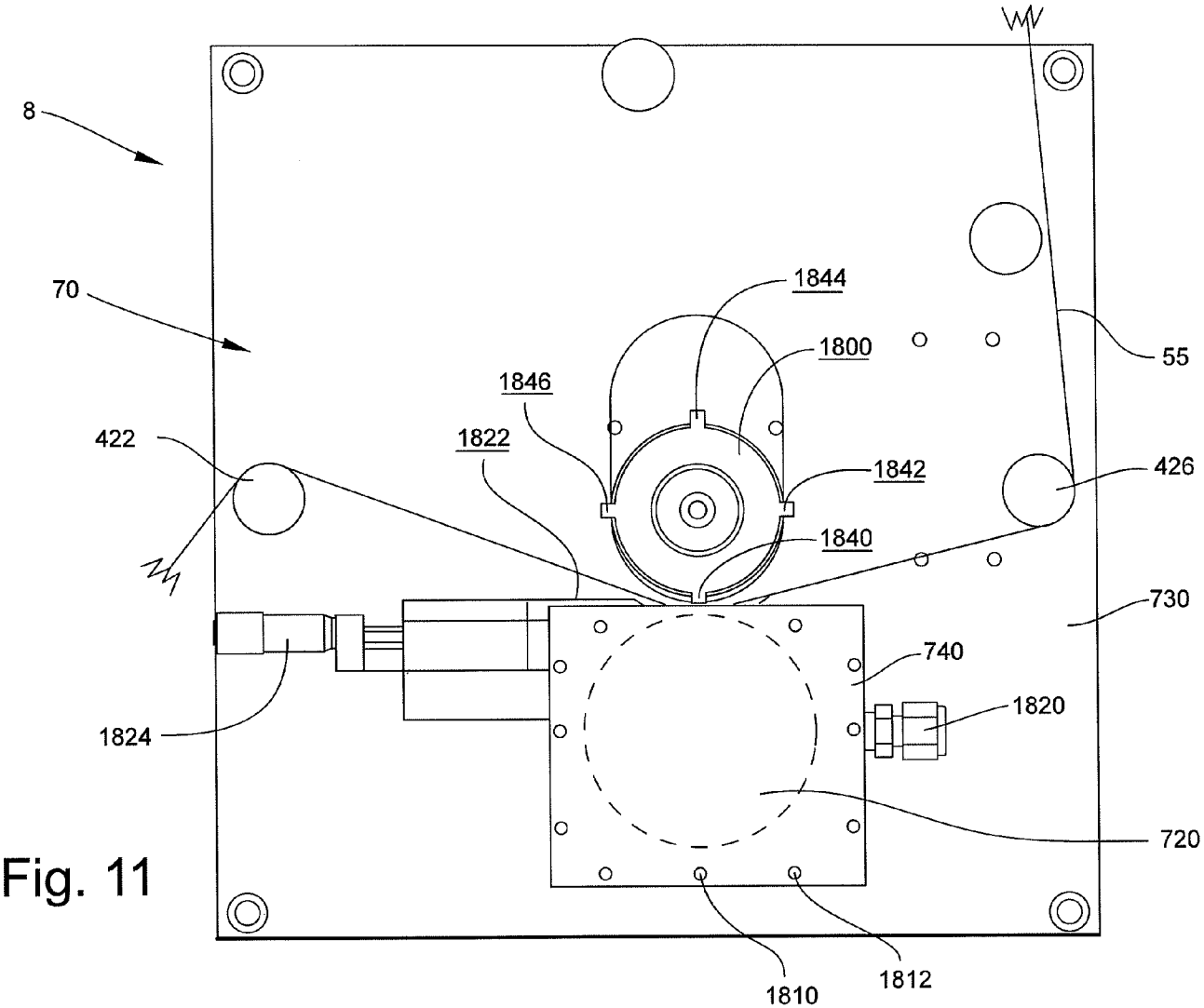
FIG. 11 is a schematic illustration of an additive applicator apparatus of an embodiment of the present invention.

Referring to FIG. 11, there is shown a portion of a cigarette making machine assembly 8; and there also are shown relevant components of another representative additive applicator apparatus 70. Such an applicator 70 is particularly useful for applying to a paper web 55 certain types of viscous additive materials. Such additive materials useful in applications involving cigarette paper include, for example, paste-type formulations of additive materials having viscosities in the range of about 500,000 centipoise to about 2,500,000 centipoise.

Additive applicator 70 is an assembly that includes a pick-up roller 720 in roll contact with an applicator roller 1800. Those rollers are mounted through a front roller plate 730 secured to front exterior of a cigarette making machine. Each of a plurality of rollers 422, 426, is fixedly mounted to the front roller plate 730; and those rollers provide guides for a path over which the paper web 55 travels from a bobbin (not shown) to the additive applicator 70 and on to other regions of the cigarette making machine 8.

The pick-up roller 720 (shown in phantom) is positioned within a reservoir 740 for the additive material (not shown). The reservoir is maintained in place and secured to the front roller plate 730 by bolts 1810, 1812 or other suitable connection means. The reservoir 740 is connected to a source (not shown) of additive material (e.g., a formulation having the form of a paste), through port 1820 near the top region of the reservoir 740. As such, a source of additive material for the pick-up roller 720 is provided. Typically, the additive material is supplied through tubing (not shown), such as Tygon-type tubing or polyethylene tubing, that feeds the reservoir 740 through port 1820.

A doctor blade 1822 is positioned near the pick-up roller 720 near the top region of that roller. The doctor blade can be mounted in a fixed position relative to the roll face of the roller. The doctor blade also can be adjustable, for example, by being positioned so as to be movable using a micrometer 1824. As such, the positioning of the doctor blade 1822 relative to the roll face of roller 720 can be adjusted. Preferably, the doctor blade is positioned in order that additive material that has been applied to the roll face of the pick-up roller is provided in the desired amount. Typically, the doctor blade is positioned so as to provide a layer of additive material on the roll face of the pick-up roller that has the desired thickness, both along the length and width of the roll face. Typically, the doctor blade 1822 is positioned about 0.001 to about 0.002 inch from the surface of the roll face of pick-up roller 720. After the additive material on the roll face of the pick-up roller has been provided in the desired amount, that additive material is transferred from the roll face of the pick-up roller to appropriate locations on the paper web 55.

The pick-up roller 720 preferably is manufactured from a material that can vary, (e.g., the material can be a soft material or a hard material), but preferably the material is manufactured from an elastomeric type material, such as a polyurethane rubber type material, or other suitable material. An exemplary pick-up roller is described previously with reference to FIG. 10. The pick-up roller rotates clockwise (for the embodiment shown) within the reservoir 740, and additive material within the reservoir is deposited on the surface of the roll face of that roller.

The pick-up roller 720 is in roll contact with protruding applicator cams 1840, 1842, 1844, 1846 of application roller 1800. The application roller cams are of the general dimension of the pattern of additive material that is desired to be applied to the paper web 55. An exemplary application roller 1800 is described previously with reference to FIG. 10. For the embodiment shown, application roller 1800 rotates counter-clockwise.

In a preferred embodiment, each roller 725, 1800 is driven independently. For example, one servo drive (not shown) can control the rotation of transfer roller 725, and a second servo drive (not shown) can control the applicator roller 1800. Controlling operation of the two rollers 725, 1800 with independent servo systems allow for independent control of speeds of those two rollers, and hence, the ability to tightly control the tolerances associated with application of additive material to the paper web using those two rollers.

In operation, the continuous paper web 55 passes between the roll faces of the pick-up roller 720 and the application roller 1800. As a result of the contact experienced by the paper web 55 as it travels between pick-up roller 720 and the applicator roller 1800, additive material transferred by the surfaces of the protruding cams 1840, 1842, 1844, 1846 from the surface of the applicator roller 720 is applied to the paper web 55 in a predetermined pattern. That is, the protruding applicator roller cams on the side of paper web, opposite the pick-up roller and the additive material, cause periodic deflection of the paper web toward the pick-up roller; and as such, additive material is transferred from the surface of the pick-up roller to the paper web in a controlled manner as a result of the camming action of the applicator roller. The paper web 55 is routed in a manner such that the paper web has a tendency to move upwards and away from the surface of the applicator pick-up roller when the various cams are not deflecting that paper web downwards. As a result, control of the location of the application of additive material on the paper web can be carried out.

Figure 12:
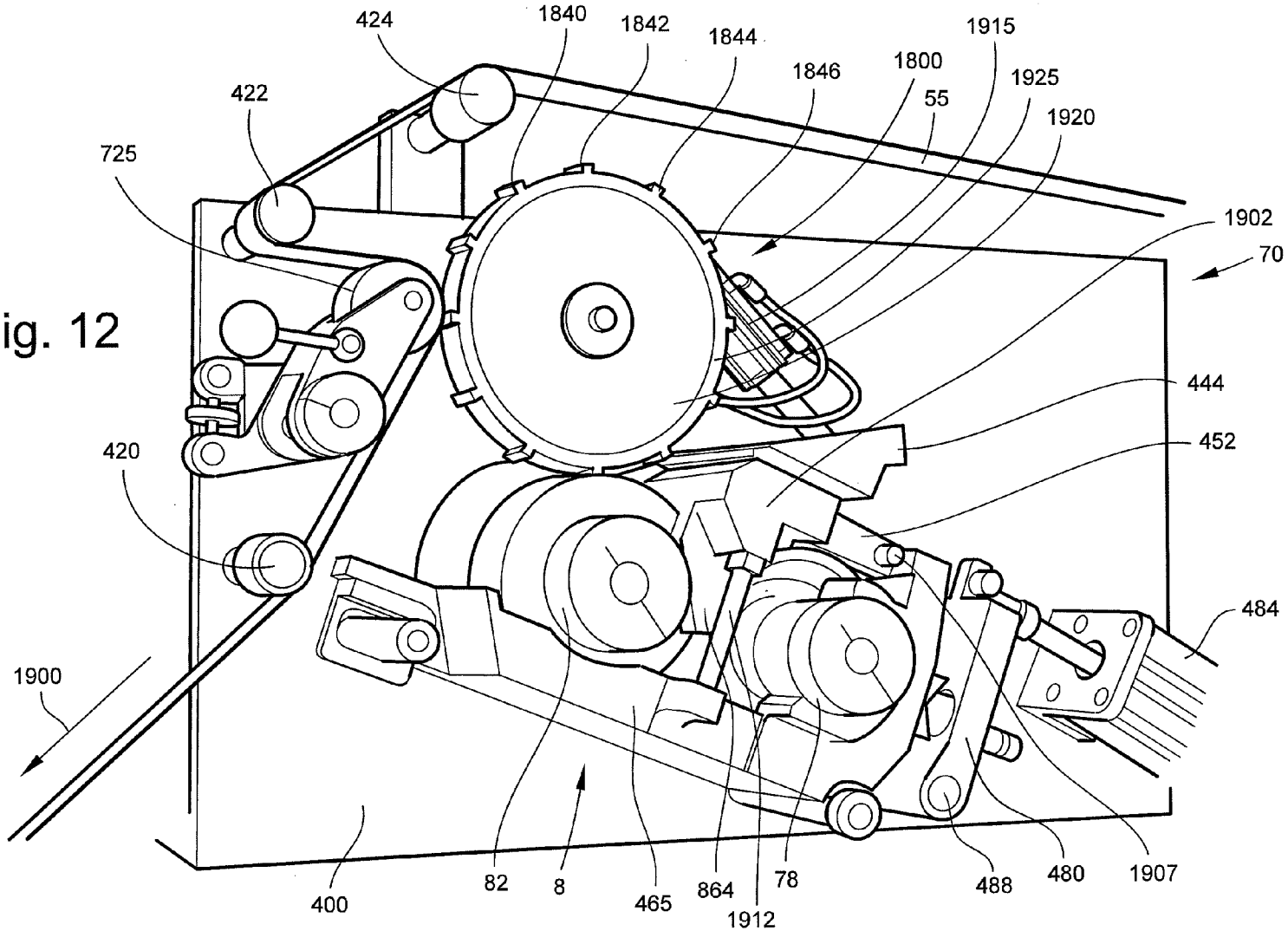
FIG. 12 is a perspective of an additive applicator apparatus of one embodiment of the present invention, that additive applicator apparatus being mounted at an appropriate location on a cigarette making machine assembly.
Figure 13:
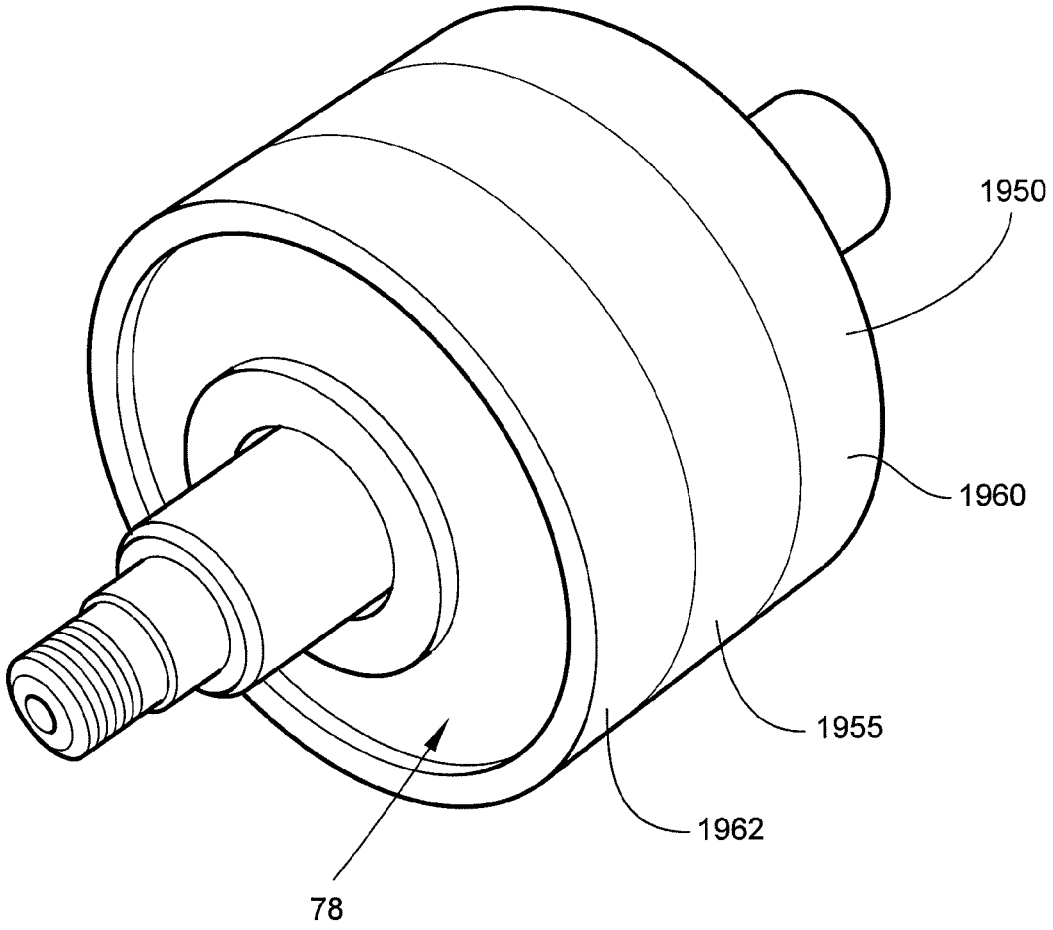
FIGS. 13-17 are perspectives of a portion of an additive applicator apparatus of the type shown in FIG. 12.

Referring to FIG. 12, there is shown a portion of a cigarette making machine assembly 8 of the present invention. In particular, there is shown an additive applicator apparatus 70 representative of one aspect of the present invention. Such an additive applicator 70 is particularly useful for applying to a paper web 55 additive materials (not shown) that can have relatively wide ranges of viscosities (e.g., formulations of additive materials that can be considered to have forms ranging from liquid to relatively thick pastes).

Additive applicator 70 is an assembly that includes a pick-up roller 78 and a transfer roller 82 mounted adjacent to each other, and mounted through a roller support plate 400 on the exterior front face of the cigarette making machine assembly 8. Descriptions of various relevant components of such an additive applicator apparatus 70 are set forth previously with reference to FIGS. 3-7, 21 and 22. Various components of such an additive applicator 70 are manufactured from suitable metals, such as cast or machined aluminum or stainless steel. The pick-up roller 78 and the transfer roller 82 preferably are manufactured from hardened stainless steel. An exemplary pick-up roller has a diameter of about 80 mm to about 130 mm, and a total roll face width of about 55 mm to about 80 mm. An exemplary transfer roller has a diameter of about 80 mm to about 130 mm, and a total roll face width of about 35 mm to about 50 mm. Several fixed guide posts, air bars or rotatable guide rollers 420, 422, 424, are suitably fixedly mounted; such as to either the front roller plate 400 or the chassis of the cigarette making machine assembly 8, depending upon the desired location of those guide posts or rollers. Those guide posts or rollers provide the path over which the paper web 55 travels from a bobbin (not shown) in the direction shown by arrow 1900, past the additive applicator 70, and on to other downstream destinations of the cigarette making machine assembly.

The additive applicator 70 also includes a manifold 444 positioned above an additive material reservoir (not shown). That reservoir is located in the nip zone above pick-up roller 78 and transfer roller 82, and the general size and shape of that reservoir is determined by the configuration of those rollers and control block 1902. As such, a type of puddle of additive material is provided in the nip zone about those rollers. The positioning of the control block 1902 is maintained through the positioning of a reservoir front arm 452 and a reservoir rear arm (not shown). Those reservoir arms are positioned above the pick-up roller 78, and are movable about pivot pin 1907. The control block 1902 can be positioned up or down through the use of an adjustable stop arm 1912. In addition to assisting in providing the boundaries of the reservoir, the control block also provides internal and external porting (not shown) for supply additive material (not shown) from an external source (not shown) and removal of excess additive material for recycling or disposal.

The manifold 444 is attached to a manifold pivot plate (not shown), which is attached to the front roller plate 400. Such attachment leaves the manifold 444 with the capability of moving upward and downward about a manifold pivot pin (not shown). The manifold 444 can be maintained in place during operation of the system through force provided by an air cylinder 1915. Tubing (not shown), such as Tygon-type or polyethylene tubing, or other suitable supply means, is connected to the manifold 444 and originates at a source of additive material (not shown) to provide an input of additive material to the reservoir (not shown). The assembly also includes a collection pot 465 positioned adjacent to and slightly below the pick-up roller 78. The collection pot 465 serves as a temporary collection location for excess additive material removed from the pick-up roller 78. If desired, the reservoir can be equipped with devices for monitoring the amount of additive material that is present within that reservoir, such as are described hereinbefore with reference to FIG. 4. The reservoir of the additive applicator 70 provides a receptacle for the additive material to the point of deposit onto the pick-up roller 78.

Against the front side face of the transfer roller 82 is positioned a scraper 864. A corresponding scraper (not shown) is positioned against the back side face of the transfer roller 82. The scrapers are formed as downwardly extending arms of the control block 1902. As such, excess additive material on the surfaces of the side faces of the transfer roller 82 is scraped from that roller as it passes the scraper. That material then exits at least one outlet port (not shown), which is located within the control block 1902. Typically, two ports, one on each of the front and rear sides of the transfer roller 82, are employed. Then, the excess material is removed through tubes (not shown) to be recycled or discarded. A diaphragm pump (not shown) or other type of suitable means for supply of vacuum can be used to evacuate excess additive material from the system. As such, both side faces of the transfer roller 82 are subjected to surface treatment by two scraper pieces arranged along the side of that roller, so as to remove undesirable excess additive formulation from those surfaces, and hence, maintain those surfaces relatively clean by maintaining those surfaces relatively free of build up of coating formulation. If desired, further surface treatments of either or both of the pick-up roller and transfer roller with air streams, water spray, scrapes or brushes can be employed to assist in maintaining the surfaces of those rollers clean and to assist in reducing the generation of heat caused by friction.

The transfer roller 82 and the pick-up roller 78 are positioned into operative engagement with one another using a roller pressure plate 480. The roller pressure plate 480 is operably connected to an air cylinder 484, or other suitable means for applying force to rollers 78, 82. The air cylinder 484 utilizes compressed air to force the roller pressure plate 480 about a pressure plate pivot shaft 488 into and out of engagement with the transfer roller 82. That plate 480 applies pressure to the collection pot 465 to move that collection pot into engagement with a bearing housing (not shown) on the shaft of pick-up roller 78. Thus, intimate roll contact between the roll faces of transfer roller 82 and pick-up roller 78 can be provided. Movement of the roller pressure plate 480 to engage and disengage the pick-up roller 78 with the transfer roller 82 can programmed, and as such a microprocessor associated with the operation of the cigarette making machine can be used to control movement of that plate 480.

In operation, pick-up roller 78 is rotated counter-clockwise and the transfer roller 82 is rotated clockwise. Hence, additive material introduced into the upper nip region (e.g., reservoir) between the rotating pick-up roller 78 and counter-rotating transfer roller 82 fills a grooved or recessed region (not shown) in the roll face of pick-up roller, and is retained on the roll face of the transfer roller in the region thereof adjacent that grooved or recessed region. As such, there is provided an assembly and method for continuously providing a predetermined supply of additive material to a predetermined region of the roll face of the transfer roller 82.

Additive applicator 70 is an assembly that also includes an application roller 1800 and a transfer pressure roller 725 (or back-up roller) mounted on each side of an application roller 82. Typically, the back-up roller 725 is manufactured from an elastomeric material; and exemplary back-up rollers are those that are used in cigarette making machines that are commercially available. Those rollers are mounted through a front roller plate 400 that is secured to the front exterior region of a cigarette making machine 8. Other back-up roller configurations, such as those types of configurations described previously with reference to FIGS. 5, 6 and 21, also can be employed. The moving paper web 55 is passed between the roll faces of the application roller 1800 and the back-up roller 725.

The manner of arranging and mounting the various rollers can vary. For example, any or all of the rollers can be designed so as to be mounted using a tapered shaft and spindle type of configuration.

The transfer roller 82 is in roll contact with a plurality (e.g., twelve, or other selected number) of protruding applicator dies 1840, 1842, 1844, 1846 of application roller 1800. The application roller dies preferably are of the general dimension of the pattern of additive material that is desired to be applied to the paper web 55. An exemplary application roller 1800 is manufactured from stainless steel, elastomeric material, or a combination of those materials. For example, larger central wheel portion 1920 of the applicator roller can be manufactured from stainless steel, and the protruding dies within the outer roll face 1925 can be shaped manufactured from a relatively soft or flexible elastomeric material. Alternatively, the protruding dies can be manufactured as replaceable inserts manufactured from relatively soft or flexible elastomeric materials. Exemplary elastomeric type materials, are materials such as a polyurethane rubber type material, a natural gum rubber, silicon rubber, and ethylene-propylene diene monomer rubber. Representative protruding dies and associated components fashioned from elastomeric materials can be provided from polyurethane rubber materials of the types available as Cytec Compound #TV-8070 Polyurethane 60-65 Durometer "A", Cytec Compound #TV-8050 Polyurethane 40-45 Durometer "A", and Cytec Compound #TV-8090 Polyurethane 80-85 Durometer "A", from Cytec Inc. Alternatively, the wheel and die component parts of the applicator roller can be manufactured from a hard metal material, such as stainless steel. An exemplary applicator roller has a diameter of about 100 mm to about 200 mm, and typically about 130 mm to about 170 mm; and possesses about four to about sixteen protruding dies each of about 1 mm to about 4 mm in radial height, about 22 mm to about 25 mm in width, and about 5 mm to about 8 mm in circumferential length. Such an applicator roller can be used to apply to one surface of a web of cigarette paper wrapping material spaced bands that are oriented transversely to the longitudinal axis of that paper web. Other sizes and shapes of the dies, other configurations of the dies on the roller, other roller sizes, and the composition of components used to manufacture the roller, can be a matter of design choice. For the embodiment shown, application roller 1800 rotates counter-clockwise.

For a representative embodiment, the pick-up roller 78 and the transfer roller 82 each have diameters of about 103 mm. The transfer roller 82 has a roll face having a width of about 40 mm. The pick-up roller 78 has a roll face having a width of about 68 mm, and a groove having a width of about 22.5 mm is located about equidistant from each side of that roller and circumscribes the entire roll face of that roller. The groove has a depth that can vary, and the depth of a representative groove is about 0.001 inch to about 0.003 inch. The application roller has a width of about 23 mm; and has an inner roller having a diameter of about 130 mm, and an outer face of polyurethane-type rubber material having a radial thickness of about 7 mm, and extending from the outer face are twelve equally spaced dies each having a radial height of about 2.5 mm and a circumferential length of about 6 mm. Such an application roller 1800 can be used to apply to a cigarette paper wrapper an adhesive formulation in the form of spaced bands that are arranged to extend across at least a portion of the width of that wrapper, and that have widths of about 23 mm and lengths of about 6 mm.

For another representative embodiment, the additive applicator 70 can be configured so that it is possible to consistently produce a wrapping material having additive material applied thereto and positioned thereon, such that the wrapping material so produced can be used to manufacture a plurality of cigarette rods, each rod possessing at least two identical bands (e.g., each having a width of about 5 mm to about 7 mm), and the spacing between the bands, measured from the inside adjacent edges of the bands, is no less than 15 mm and no greater than 25 mm.

In a preferred embodiment, each of the transfer roller 82 and the application roller 1800 is driven independently. For example, one servo drive (not shown) can control the rotation of application roller 1800, and a second servo drive (not shown) can control the transfer roller 82. The rotation of the pick-up roller 78 relative to the rotation of the transfer roller 78 can be tightly controlled (e.g., in terms of a timed speed of rotation) in the general manner described previously with reference to FIG. 4. Controlling operation of the various rollers with independent servo systems allows for independent control of speeds of the two supply rollers (e.g., the pick-up and transfer rollers) relative to the application roller, and hence, the ability to tightly control the tolerances associated with application of additive material to the paper web using a multi-roller system. Additionally, it is preferred that rollers that are independently adjustable, in that the degree of touching of the roll faces of the respective rollers during roll contact can be controlled. If desired, each of the application roller 1800, transfer roller 82 and pick-up roller 78 each can be independently operated using three separate servo systems.

In operation, during the process of cigarette manufacture, the pick-up roller 78 is rotated counter-clockwise, and the transfer roller 82 is rotated clock-wise. Those rollers are engaged in contact by pressure supplied by the pressure plate 480. Additive material (not shown) is fed from a source (not shown) to the manifold 444, and from the manifold to the reservoir (not shown). As such additive material is introduced into the upper nip region between the roll faces of the pick-up roller 78 and the transfer roller 82. Due to the continuous groove (not shown) in the roll face of the pick-up roller, additive material has a tendency to fill that groove; and due to the maintained roll contact between the pick-up and transfer rollers, additive material is applied as a continuous stripe on a portion of the roll face of the transfer roller in the region thereof adjacent the groove of the pick-up roller. The application roller 1800, which is in roll contact with the transfer roller, rotates counter-clockwise. Hence, coating formulations, such as mixtures incorporating modified starches and water, can be applied in the desired amount and in the desired manner, on the appropriate region of the roll face of transfer roller, and that formulation then can be efficiently and effectively transferred from the transfer roller to the appropriate regions of the application roller. The continuous paper web 55 passes between the roll faces of the transfer roller 1800 and the back-up roller 725. As a result of the contact experienced by the paper web 55 as it travels between the roll faces of the transfer pressure roller 725 and the applicator roller 1800, additive material transferred to the surfaces of the protruding dies 1840, 1842, 1844, 1846 from the surface of the applicator roller is applied to the paper web 55 in a predetermined pattern. As such, the die faces provide a type of off-set printing of additive material to desired locations on the moving paper web. As a result, the additive material on the surface of the application roller 1800 is transferred to the inside surface of the advancing paper web 55 at locations corresponding to the pattern on the roller face of the application roller. Operation and interaction of the transfer roller 82 and application roller 1800 relative to one another are such that the transfer roller supplies the desired amount of additive material to the die faces of the application roller. Operation and interaction of the die faces of the application roller 1800 and the paper web 55 are such that additive material on successive die faces is applied at predetermined and desired locations of the paper web. That is, the paper web 55 is supplied at a very high rate of speed, and hence, the various rollers also rotate as a correspondingly high rate of speed. The paper web 55 having additive material applied thereto then is advanced to downstream locations of the cigarette making machine, or elsewhere within the apparatus.

Referring to FIG. 13, there is shown a pick-up roller 78 that is representative of the type of pick-up roller described previously with reference to FIG. 13. The pick-up roller 78 possesses a roll face 1950, as well as a circumferentially extending groove 1955 that extends completely around the periphery of the roll face. The width of the groove can vary, and can be designed to provide a desired amount of additive material formulation (not shown). The depth of the groove can also vary, and can be designed to provide a desired amount of additive material formulation (not shown). The groove 1955 most preferably is positioned such that the recess in the roll face of the roller is located between front side roll face surface 1960 and rear side roll face surface 1962. As such, in operation, the roll face (not shown) of the transfer roller (not shown) is in roll contact with side roll face surfaces 1960, 1962 of the pick-up roller 78; and a hollow region (not shown) is formed in the region where those rollers are in roll contact, due to the presence of the groove 1955 in the roll face 1950 of the pick-up roller. Although a preferred embodiment possesses one continuous groove, other groove designs can be employed. For example, a series of continuous grooves, grooves forming the shape of a grid, or other type of pattern, can be employed.

Figure 14:
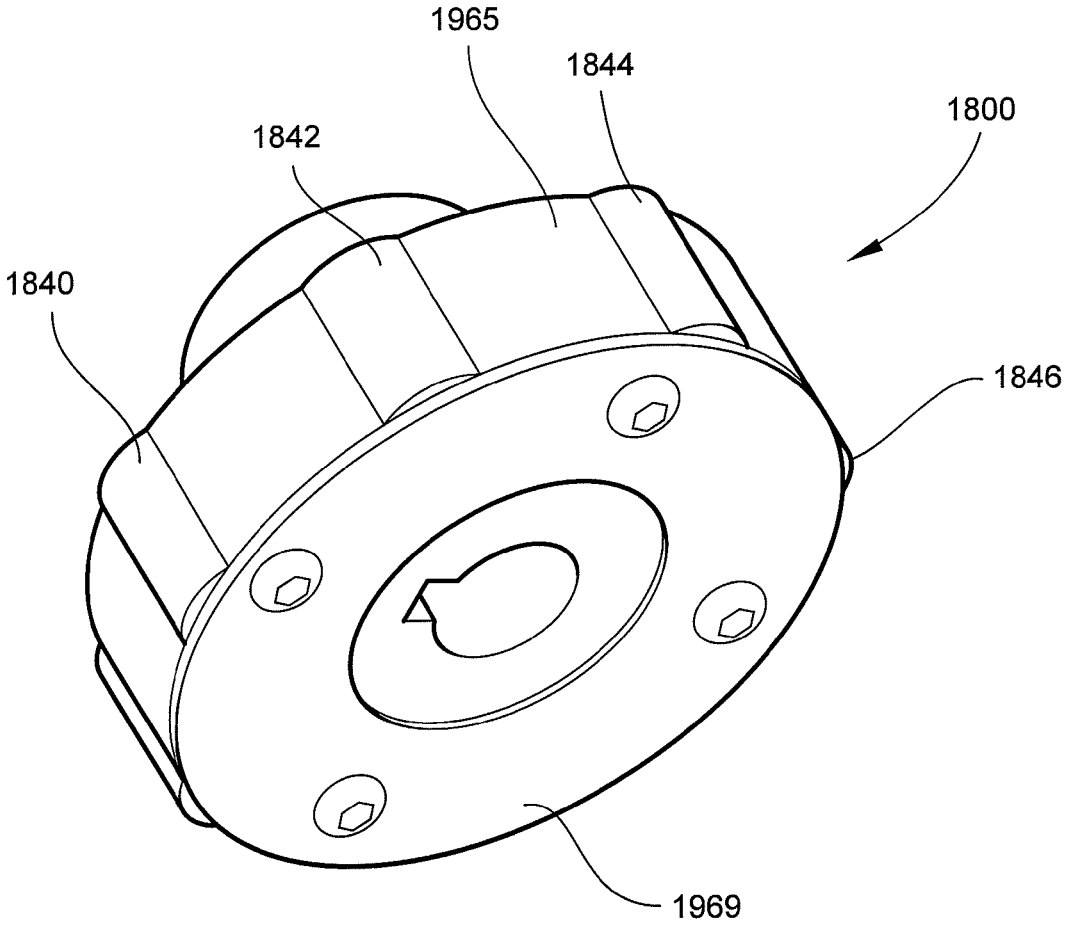

Referring to FIG. 14, there is shown an alternate type of application roller 1800 that is representative of the type of application roller described previously with reference to FIG. 12. Such an application roller can be used as the application roller in the types of applicator systems described previously with reference to FIGS. 21 and 22. The application roller possesses a plurality of spaced dies 1840, 1842, 1844, 1846 positioned at desired locations on the roll face 1965 (e.g., the peripheral surface) of the roller 1800. The dies are provided from cylinders of elastomeric material positioned in semi-circular types of recesses formed in the large central region of the roller. A removable side plate 1969 helps assist in maintaining the dies in place on the roll face of the roller.

Figure 15:
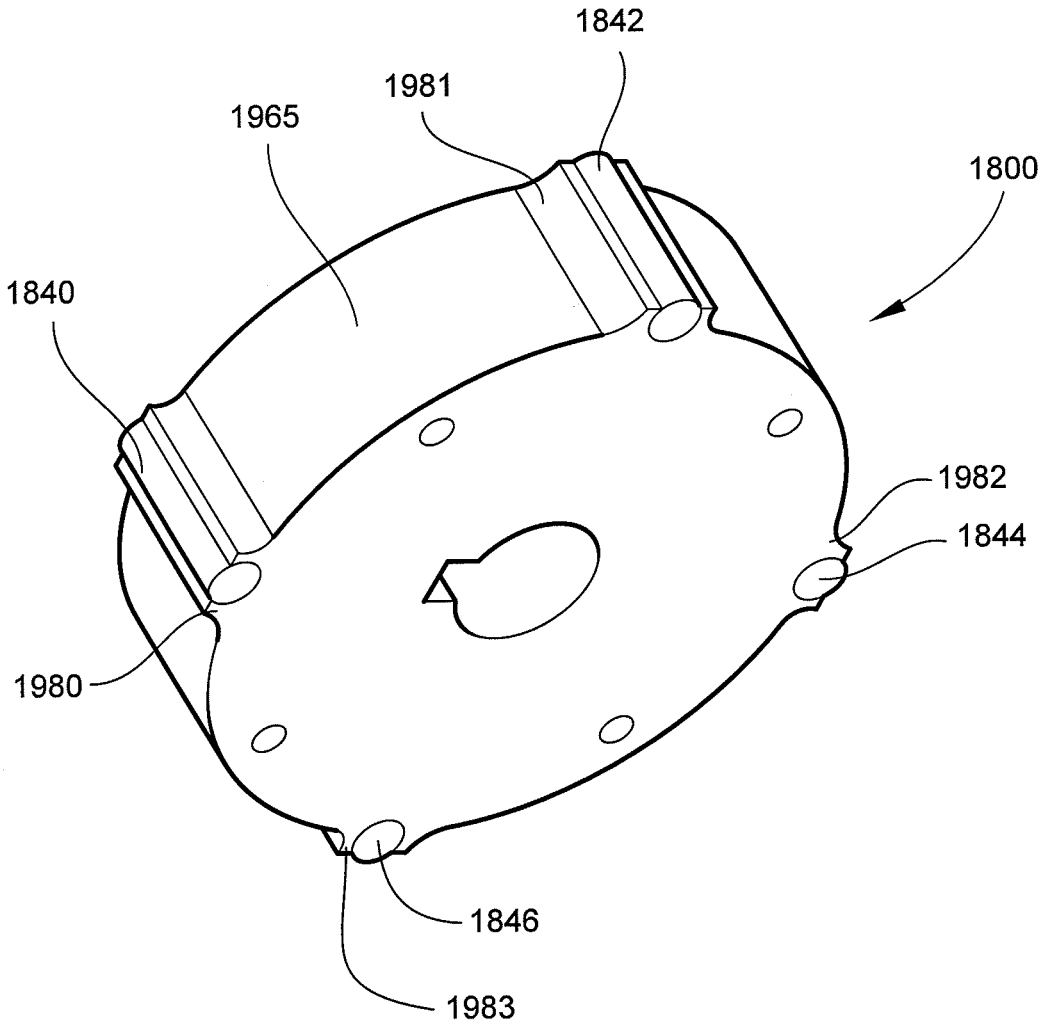

Referring to FIG. 15 there is shown an alternate type of application roller 1800 that is representative of the type of application roller described previously with reference to FIG. 12. Such an application roller can be used as the application roller in the types of applicator systems described previously with reference to FIGS. 21 and 22. The application roller possesses a plurality of spaced dies 1840, 1842, 1844, 1846 positioned at desired locations on the roll face 1965 of the roller 1800. The dies 1840, 1842, 1844, 1846 are provided from cylinders of elastomeric material positioned in outwardly extending insertion regions 1980, 1981, 1982, 1983, respectively, formed in the large central region of the roller. A removable side plate (not shown) helps assist in maintaining the dies in place on the roll face of the roller.

Figure 16:
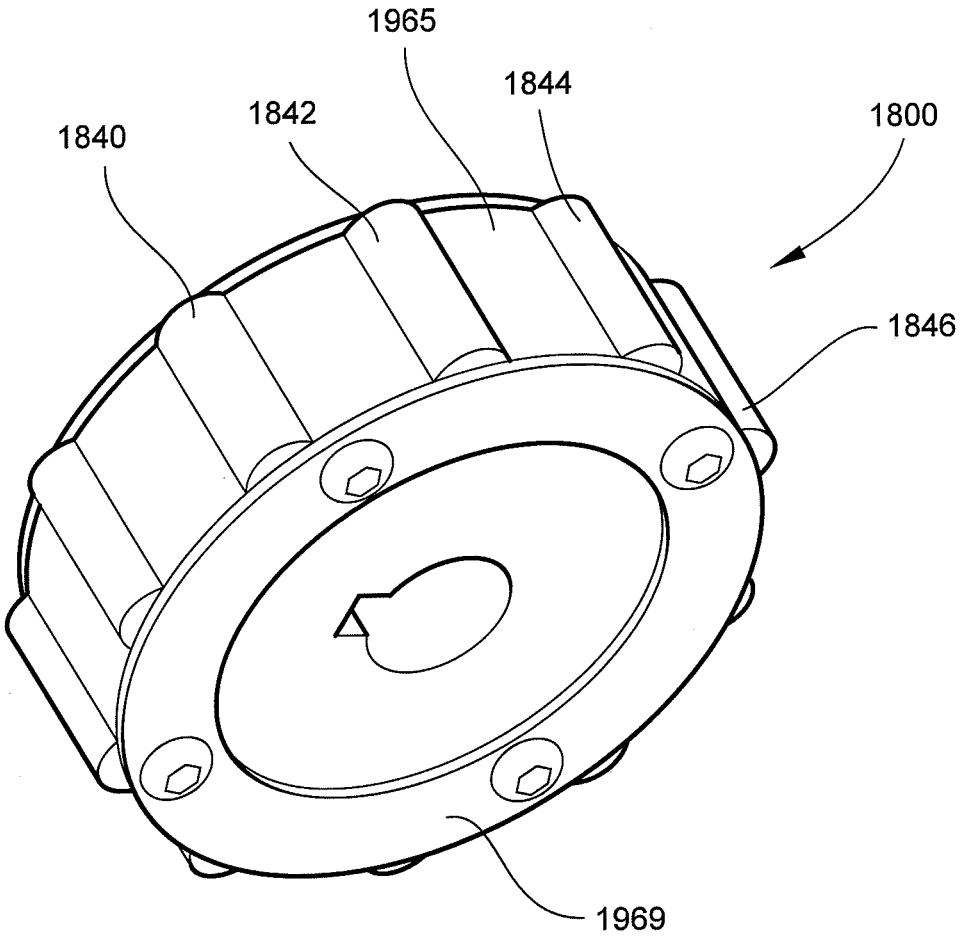

Referring to FIG. 16, there is shown an alternate type of application roller 1800 that is representative of the type of application roller described previously with reference to FIG. 12. Such an application roller can be used as the application roller in the types of applicator systems described previously with reference to FIGS. 10 and 11. The application roller possesses a plurality of spaced dies 1840, 1842, 1844, 1846 positioned at desired locations on the roll face 1965 of the roller 1800. The dies are provided from cylinders of elastomeric material positioned in corresponding semi-circular types of recesses formed in the large central region of the roller. A removable side plate 1969 helps assist in maintaining the dies in place on the roll face of the roller.

Figure 17:
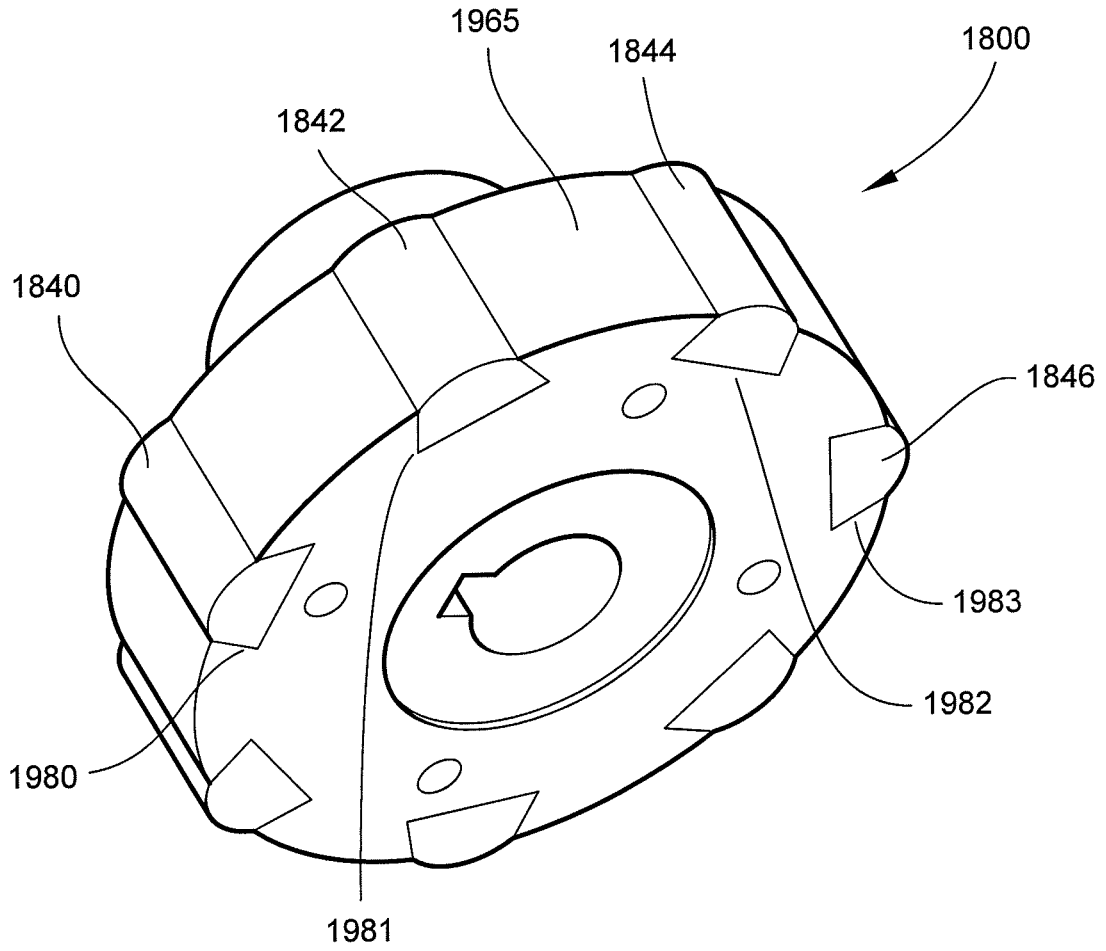

Referring to FIG. 17, there is shown an alternate type of application roller 1800 that is representative of the type of application roller described previously with reference to FIG. 12. Such an application roller can be used as the application roller in the types of applicator systems described previously with reference to FIGS. 21 and 22. The application roller possesses a plurality of spaced dies 1840, 1842, 1844, 1846 positioned at desired locations on the roll face 1965 of the roller 1800. The dies are provided from shaped pieces of elastomeric material positioned in corresponding formed recesses 1980, 1981, 1982, 1983 (e.g., wedge-shaped types of recesses) formed in the large central region of the roller. A removable side plate (not shown) helps assist in maintaining the dies in place on the roll face of the roller.

Figure 18:
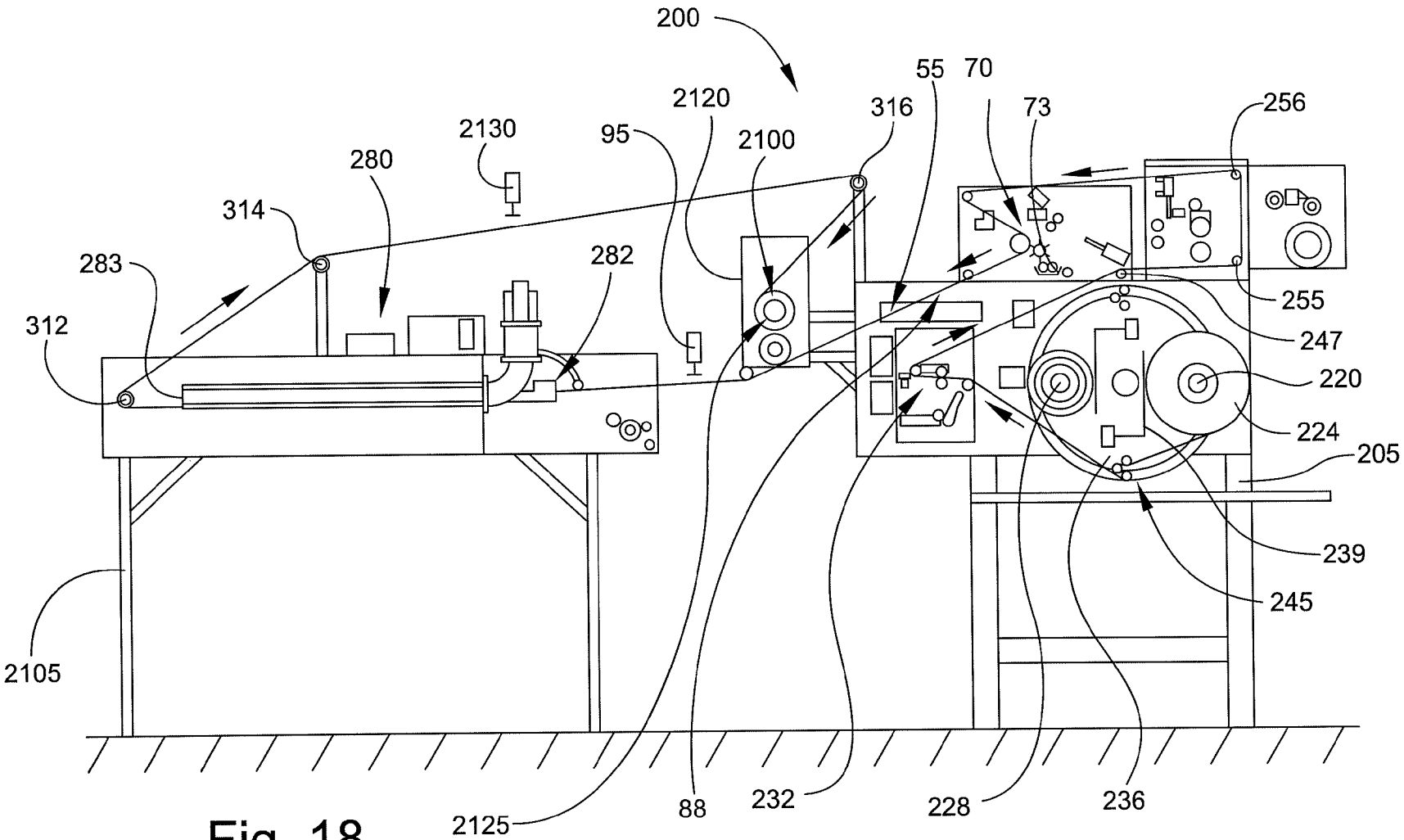
FIG. 18 is a schematic illustration of an apparatus for supplying and rewinding wrapping material, and specifically, a schematic illustration of a source of wrapping material, an additive applicator apparatus, a region for drying material applied to the wrapping material, and a rewind unit for formatting the treated paper onto a bobbin.

Referring to FIG. 18 there is shown a wrapping material supply machine 200. The path of travel of the strip of paper web 55 from the first bobbin 224 us to the second bobbin 2100 is shown by the various arrows. Such a machine 200 possesses an ability to apply, in a continuous fashion, a desired pattern of additive material 73 to a continuous strip of paper web 55 supplied from a first bobbin 224, and to rewind the resulting web so treated to form a second bobbin 2100. Such a machine 200 can be used to apply a coating formulation (e.g., a water-based starch-based formulation) to a continuous paper web 55 in an off-line manner. Then, the second bobbin 2100 can be removed from the machine 200, stored as necessary, and mounted onto a conventional type of automated cigarette making apparatus (not shown) in order to manufacture cigarettes (not shown) using wrapping materials possessing patterned additive material applied thereto. Of particular interest is the ability to employ an essentially unmodified automated cigarette making apparatus to manufacture a continuous cigarette rod having a patterned wrapping material possessing additive material applied thereto.

A suitable wrapping material supply machine 200 can be provided by appropriately modifying a web supply unit available as SE 80 from Hauni-Werke Korber & Co. KG. See, for example, U.S. Pat. No. 5,156,169 to Holmes et al., which is incorporated herein by reference. Other suitable unwind units, such those having the types of components set forth in U.S. Pat. No. 5,966,218 to Bokelman et al., also can be employed. The supply machine 200 includes a frame 205 that supports at least one unwind spindle assembly 220 onto which a first bobbin 224 is mounted. Preferably, the supply machine 200 includes a second unwind spindle assembly 228 for a second bobbin (not shown), and a web splicing mechanism 232. Suitable unwind units, and associated components, are commercially available from sources such as Hauni Maschinenbau AG, Molins, PLC, Goebel Schneid-und Wichelsystme, and Dusenbery Worldwide. The amount of wrapping material contained on the bobbin 224 can vary. Typical bobbins that are mounted on conventional automated cigarette making apparatus often contain a continuous strip of wrapping material that is about 6,500 meters in length.

The paper web 55 is threaded through a tension sensor 236, which, in conjunction with a braking component 239, is in connection with the shaft of the unwind spindle assembly. As such, the combination of the tension sensor 236 and braking component 239 acts to maintain a desired amount of tension on the paper web 55 as it is transferred from the bobbin 224. Braking component systems for unwind units are commercially available, and the design and operation of such types of systems will be readily apparent to those skilled in the art of automated cigarette manufacturing system design and operation.

In operation, a continuous paper web 55 supplied from a bobbin 224 is routed through a path defined by a series of idler rollers, guideposts, and air bars 245, 247, 255, 256. The paper web 55 also is routed through an applicator system 70 that is used to apply a desired pattern of additive material 73 to the paper web 55. A representative additive material 73 is a coating formulation in a liquid, syrup or paste form. Optionally, though not preferred, the paper web can be routed through a heating/cooling control unit (not shown) immediately before the paper web passes through the applicator system 70.

A representative additive applicator 70 comprises components, and can be operated in essentially the same manner as, and can be selected from those types of applicator systems set forth previously. A particularly preferred representative additive applicator 70, and drive system therefor, is described previously with reference to FIG. 12. The additive material 73 most preferably also is applied to predetermined locations on what is considered to be the inside surface 88 of the paper web 55.

After the additive material 73 has been applied to the paper web 55, the web can be exposed to a sensor or detector 95 for an inspection system (not shown). Preferably, the detector 95 is positioned so as to receive information concerning the paper web 55 immediately after additive material 73 has been applied to that paper web. A capacitance type of detector (e.g., that can be used to detect the presence of water of the coating formulation) is preferred; and one representative type of capacitance detector is available as DMT 20 from Lion Precision. Typically, the detector 95 is used in conjunction with the certain inspection systems of the type described previously with reference to FIG. 8. For example, capacitance detector is available as DMT 20 from Lion Precision can be connected to a high speed data acquisition board (e.g., a PXI-1002 unit available from National Instrument); data from the detector is appropriately analyzed using the data acquisition board, and information regarding specifications of the pattern applied to the continuous paper web is generated; an output signal is sent from the data acquisition board to a PLC, informing the operator that the paper web so treated is out of specification; and the operator then can stop the operation of the machine or take steps to rectify the cause of the problem associated with production of wrapping material that is out of specification tolerance. Alternative sensors, detectors and inspection system components and description of inspection system technologies and operation are set forth in U.S. Pat. No. 4,845,374 to White et al.; U.S. Pat. No. 5,966,218 to Bokelman et al.; U.S. Pat. No. 6,020,969 to Struckhoff et al. and U.S. Pat. No. 6,198,537 to Bokelman et al.

Additionally, after the additive material 73 has been applied to the paper web 55 (i.e., downstream from the applicator apparatus 70), the web can be passed through an optional, though highly preferred, heating/cooling control device 280, or other suitable means for controlling heat to which the paper web is subjected. The control device 280 can be supported by a frame 2105, or the frame 205 that supports the unwind unit 245 and applicator apparatus 70 can be adapted to support the control device 280. The control device 280 can be used to alter the heat to which the paper web 55 and additive material is subjected (e.g., by raising or lowering the temperature). For example, the control device can be a heating or drying device adapted to assist in the removal of solvent (e.g., moisture) from the additive material 73 that has been applied to the paper web 55. Alternatively, for example, the heating/cooling control device can be a cooling device adapted to assist in the hardening melted additive material 73 that has been applied to the paper web 55 using a heated additive applicator system 70. Typically, the heating/cooling control device 280 has a tunnel-type configuration through which the paper web 55 is passed (through an inlet end 282 and out an outlet end 283); and during the time that the paper web is present within that tunnel region, the paper web is subjected to heating supplied using infrared convection or radiant heating devices, or cooling supplied using refrigerant-type, solid carbon dioxide-type or liquid nitrogen-type cooling devices.

The size of the optional heating/cooling device 280 can vary. Exemplary heating/cooling devices 280 have lengths of about 2 feet to about 10 feet, with lengths of about 3 feet to about 8 feet being typical, and lengths of about 4 feet to about 7 feet being desirable. The distance that the paper web 55 travels through the heating/cooling device 280 (i.e., the length of travel through that device) can vary. For example, the paper web 55 can be routed back and forth within the heating/cooling device 280 using a suitably adapted roller system configuration (not shown). Representative heating/cooling control devices are described previously with reference to FIG. 2. Radiant-type drying systems (e.g., microwave-type drying systems) are preferred.

The paper web 55 exits the temperature control device 280 and is advanced to a rewind unit 2120. As such, the paper web 55 is wrapped on a core 2125, thereby forming a second bobbin 2100. Optionally, a suitable detector 2130 can be positioned so as to provide for inspection of the paper web 55 after that paper web exits the temperature control device 280. For example, the detector 2130 can be used to detect breaks in the paper web 55, and hence initiate shut down of the operation of the supply machine 200. A representative paper break detector is available as Model No. T18SP6FF50Q from Banner Engineering Inc. The selection and use of other types of detection systems will be readily apparent to those skilled in the art of design and operation of cigarette making machines. Direction of the paper web 55 is provided by suitably aligned series of idler rollers 312, 314, 316 (or guideposts, turning bars, air bars, or other suitable means for directing the paper web throughout the supply machine 200). Suitable pathways for travel of the paper web 55 can be provided by suitably designed tracks or tunnels (not shown). As such, there is provided a way to direct the paper web to the rewind unit 2120, or to an otherwise suitable location. The system also can include components capable of allowing for automatic bobbin changing and splicing functions. It is highly preferred that the wrapping material is wound on the second bobbin 2100 such that when the bobbin is mounted on a conventional type of automated cigarette making machine (not shown), the surface of the wrapping material having additive material applied thereto provides the inner face of the smokable rod so manufactured.

The additive applicator 70 used in conjunction with the supply machine 200 most preferably is driven by a servo drive control system (not shown) or other suitable control means. Suitable servo-based systems and the operation thereof are described in greater detail hereinbefore with reference to FIG. 1. An exemplary servo system for operating the applicator apparatus 70 is available from Bosch Rexroth. The speed of operation of the additive applicator 70 and speed of operation of the supply unit 220 can be controlled relative to one another. Thus, the operation of the applicator apparatus 70 relative to the speed of travel of the continuous paper web 55 can be controlled relative to one another. As such, the positioning of the additive material 73 at desired locations on the paper web 55 can be controlled. In addition, the applicator apparatus 70 can be configured to apply a desired pattern of additive material to the continuous strip of paper web. For example, the applicator apparatus can be configured so that it is possible to consistently produce a wrapping material having additive material applied thereto and positioned thereon, such that the wrapping material so produced can be used to manufacture a plurality of cigarette rods, each rod possessing at least two identical bands (e.g., each having a width of about 5 mm to about 7 mm), and the spacing between the bands, measured from the inside adjacent edges of the bands, is no less than 15 mm and no greater than 25 mm.

The rewind unit 2120 also can utilize the types of components used for constructing the unwind systems of conventional automated cigarette making machines, and that rewind unit can incorporate appropriate electrical motor controls and a servo system. Typically, the rewind spindle is driven by a motor, such as Baldor Industrial Motor, Catalogue No. CDP3330 from Baldor Electric Co. Such a drive, such as a direct current drive, is turned by a reference voltage (e.g., about 0 to about 10 volts); and when the drive is operated, an encoder coupled with the drive is operated. A representative suitable encoder is available as ID No. 295466-12 from Heidenhain. The output of the encoder is fed to a servo drive (e.g., and Indramat Model No. MKD025B-144-GP0-KN from Bosch Rexroth), which in turn drives relevant components (e.g., the application wheel and supply rollers) of the applicator 70. The speed of operation of the rewind unit 2120 can be controlled relative to those speeds of operation of the additive applicator 70 and the supply unit 220. The system also can include components, such as an automatic bobbin changer/splicer and/or an automatic rewind bobbin changer.

When sufficient processed paper web 55 has been wound onto the rewind core 2125, the continuous strip is cut, and the resulting full bobbin 2100 is removed from the supply machine 200. Selection of additive material 73 and effective treatment of the wrapping material 55 after application of that additive material thereto can ensure that the wrapping material wound onto the second bobbin 2100 does not have a propensity stick to itself, and hence, the wrapping material can be readily removed from that bobbin.

Figure 19:
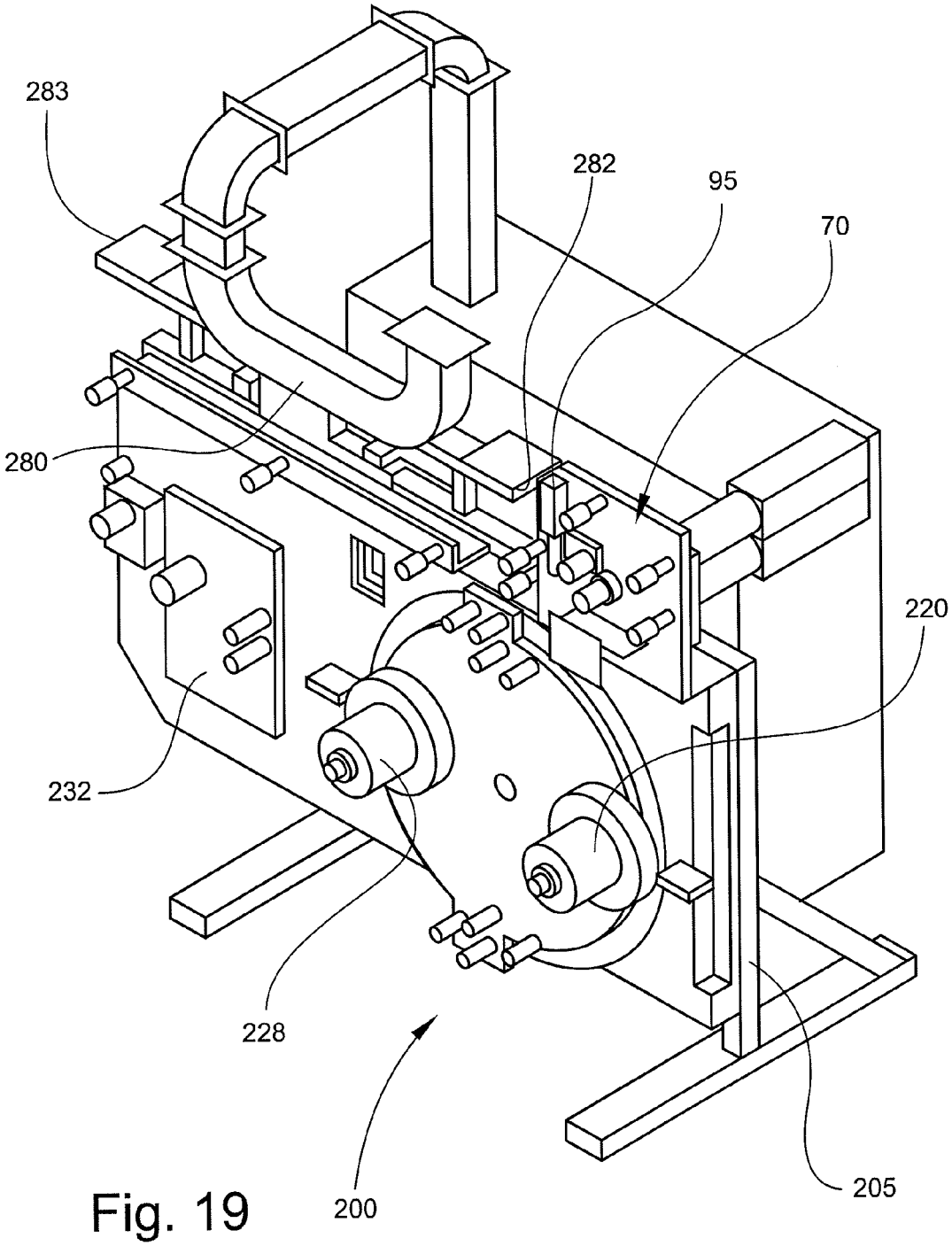
FIG. 19 is a perspective of an additive applicator apparatus of one embodiment of the present invention, that additive applicator apparatus being configured so as to provide wrapping material that can be supplied to a cigarette making machine assembly or wound onto a bobbin.

Referring to FIG. 19, there is shown another representative alternate embodiment of wrapping material supply machine 200. Such a machine 200 possesses spindle assembly units 220, 228, a splicing system 232, an applicator apparatus 70, a detector 95, a heating/cooling control device 280, and a frame 205 that supports the foregoing. The machine 200 possesses an ability to apply a desired pattern of additive material (not shown) to a continuous strip of paper web (not shown) supplied from a bobbin (not shown). Such a machine 200 can be used to apply an additive material in the form of a coating formulation (e.g., a water-based starch-based formulation) to a continuous paper web. Various representative types of applicator systems 70 are set forth previously, and a particularly preferred type of applicator apparatus described hereinbefore with reference to FIG. 12. The continuous paper web having a pattern of additive material applied thereto can be passed through the entrance region 282 of the heating/cooling control device 280, and then exit through the exit region 283 of that control device 280. Then, the wrapping material can be directed to a cigarette making machine (not shown) in situations in which the machine 200 is used in an on-line manner, or the wrapping material can be directed to a rewind unit (not shown) in order to provide a roll of treated wrapping material (e.g., in the form of a bobbin), in situations in which the machine 200 is used in an off-line manner. The frame 205 can be modified to support the rewind unit (not shown), for circumstances in which the supply machine 200 is used in an off-line manner. The applicator apparatus 70 can be configured to apply a desired pattern of additive material to the continuous strip of paper web. For example, the applicator apparatus can be configured so that it is possible to consistently produce a wrapping material having additive material applied thereto and positioned thereon, such that the wrapping material so produced can be used to manufacture a plurality of cigarette rods, each rod possessing at least two identical bands (e.g., each having a width of about 5 mm to about 7 mm), and the spacing between the bands, measured from the inside adjacent edges of the bands, is no less than 15 mm and no greater than 25 mm.

If desired, the off-line type of system can be operated so as to provide one processed bobbin at a time. Alternatively, the off-line type of system can be employed by adapting that system so as to provide a processed master roll, which then can be slit to provide a plurality of bobbins each of the desired width. Alternatively, the off-line system can be suitably adapted to simultaneously produce several processed bobbins at a time. For example, the system can be modified to handle several bobbins by employing a long unwind spindle unit having appropriately positioned spacers, multiple appropriately positioned paper guides, multiple applicator units, multiple microwave wave guides coupled with a large microwave generator, multiple detection units, and a long rewind spindle unit having appropriately positioned spacers. Unwind and rewind equipment can be obtained from commercial sources, and can be suitably modified, if desired. Manners and methods for operating bobbin unwind and rewind units will be readily apparent to those having skill in the art of paper conversion.

The various components, systems and methods can be employed individually, or in various combinations with one another. In one regard, a cigarette making machine assembly can incorporate an on-line additive application system for a paper web, a garniture, a registration system, an inspection system, and heating/cooling control system, each of which are of the type that have been described as various aspects of the present invention. In another regard, for example, the on-line additive application systems can be incorporated into cigarette making machine assemblies without any or all of those other components that have been described as various aspects of the present invention. Alternatively, the components can be applied in a so-called "offline" fashion, using the manners and techniques described in U.S. Patent Publication No. 2003/0131860 to Ashcraft et al.

The various aspects of the present invention, whether employed individually or in some combination, offer several advantages and improvements to conventional systems and methods for cigarette manufacture. The present invention allows a cigarette manufacturer to apply predetermined and discrete amounts of an additive material to a continuous advancing strip of a paper web at desired locations on that paper web, during the manufacture of a continuous cigarette rod using conventional types of cigarette making equipment and methodologies. Of particular interest are bands of additive material that are positioned perpendicularly to the longitudinal axis of the paper web, and those bands can be positioned so as to extend across less than the total width of that paper web. As such, the location of additive material can be controlled so as to not be located in the lap zone of the continuous cigarette rod (e.g., where the side seam adhesive is applied). For the production of certain preferred banded cigarettes, the spaced bands are applied on the wrapping material so that the bands virtually entirely encircle the formed smokable column of each cigarette, while the inner surface of that portion of the wrapping material that provides the overlapping lap zone of the side seam region does not necessarily have additive material applied thereto. Thus, for example, a continuous paper web having a width of about 27 mm and used to provide a cigarette rod having a circumference of about 24.5 mm (i.e., such that the lap zone has a width of about 2.5 mm) can have a band applied to that web such that the band is not located within the lap zone where side seam adhesive is applied; and as such, such a band can have a transversely extending length of about 22 mm to about 24.5 mm, but most preferably about 24.5 mm. The present invention allows a cigarette manufacturer to apply to paper webs additive formulations that have a wide range of chemical and physical properties, and that are provided for application in a wide variety of forms (e.g., a wide range of viscosities). The finger rail modifications, the garniture entrance cone modifications and the heating/cooling control systems of the present invention provide a manufacturer of cigarettes an efficient and effective way to produce cigarettes having additive material applied to the wrapping materials of those cigarette rods in an on-line fashion, during the manufacture of those cigarette rods. That is, the present invention advantageously provides a means for retaining an additive material on a paper web and preventing transfer of the additive material to the surfaces of various components of a cigarette making machine. In addition, the present invention allows a manufacturer of cigarettes to apply additive materials to paper webs without adversely affecting the physical properties and integrity of that paper web to any significant degree. Registration of patterns (e.g., bands) applied to the paper wrapping materials of tobacco rods promotes the ability of cigarette manufacturers to provide consistent quality cigarette rods, and the ability to control the properties of cigarettes through on-line production techniques offers advantages over cigarettes that are manufactured using pre-printed paper wrapping materials. The present invention also provides a manufacturer of cigarettes with the ability to ensure the production of high quality cigarettes with applied patterns registered in the desired locations of those cigarettes.

Certain preferred paper wrapping materials used in carrying out the present invention are useful for the manufacture of cigarettes designed to exhibit reduced ignition propensity. That is, cigarettes incorporating certain wrapping materials, when placed on a flammable substrate, tend to self extinguish before burning that substrate. Of particular interest are those cigarettes possessing tobacco rods manufactured using appropriate wrapping materials possessing bands composed of appropriate amounts of appropriate components so as to have the ability to meet certain cigarette extinction criteria. Also, of particular interest are those cigarettes possessing tobacco rods manufactured using appropriate wrapping materials designed to possess appropriate numbers of bands having appropriate features and positioned at appropriate locations, so as to have the ability to meet certain cigarette extinction design criteria.

The paper wrapping material that is further processed to provide the patterned wrapping material can have a wide range of compositions and properties. The selection of a particular wrapping material will be readily apparent to those skilled in the art of cigarette design and manufacture. Typical paper wrapping materials are manufactured from fibrous materials, and optional filler materials, to form so-called "base sheets." Wrapping materials of the present invention can be manufactured without significant modifications to the production techniques or processing equipment used to manufacture those wrapping materials.

Typical wrapping material base sheets suitable for use as the circumscribing wrappers of tobacco rods for cigarettes have basis weights that can vary. Typical dry basis weights of base sheets are at least about 15 $g/m^2$, and frequently are at least about 20 $g/m^2$; while typical dry basis weights do not exceed about 80 $g/m^2$, and frequently do not exceed about 60 $g/m^2$. Many preferred wrapping material base sheets have basis weights of less than 50 $g/m^2$, and even less than 40 $g/m^2$. Certain preferred paper wrapping material base sheets have basis weights between about 20 $g/m^2$ and about 30 $g/m^2$.

Typical wrapping material base sheets suitable for use as the circumscribing wrappers of tobacco rods for cigarettes have inherent porosities that can vary. Typical base sheets have inherent porosities that are at least about 5 CORESTA units, usually are at least about 10 CORESTA units, often are at least about 15 CORESTA units, and frequently are at least about 20 CORESTA units. Typical base sheets have inherent porosities that are less than about 200 CORESTA units, usually are less than about 150 CORESTA units, often are less than about 85 CORESTA units, and frequently are less than about 70 CORESTA units. A CORESTA unit is a measure of the linear air velocity that passes through a 1 $cm^2$ area of wrapping material at a constant pressure of 1 centibar. See, CORESTA Publication ISO/TC0126/SC I N159E (1986). The term "inherent porosity" refers to the porosity of that wrapping material itself to the flow of air. A particularly preferred paper wrapping material base sheet is composed of wood pulp and calcium carbonate, and exhibits an inherent porosity of about 20 to about 50 CORESTA units.

Typical paper wrapping material base sheets suitable for use as the circumscribing wrappers of tobacco rods for cigarettes incorporate at least one type of fibrous material, and can incorporate at least one filler material, in amounts that can vary. Typical base sheets include about 55 to about 100, often about 65 to about 95, and frequently about 70 to about 90 percent fibrous material (which most preferably is a cellulosic material); and about 0 to about 45, often about 5 to about 35, and frequently about 10 to about 30 percent filler material (which most preferably is an inorganic material); based on the dry weight of that base sheet.

The wrapping material incorporates a fibrous material. The fibrous material can vary. Most preferably, the fibrous material is a cellulosic material, and the cellulosic material can be a lignocellulosic material. Exemplary cellulosic materials include flax fibers, hardwood pulp, softwood pulp, hemp fibers, esparto fibers, kenaf fibers, jute fibers and sisal fibers. Mixtures of two or more types of cellulosic materials can be employed. For example, wrapping materials can incorporate mixtures of flax fibers and wood pulp. The fibers can be bleached or unbleached. Other fibrous materials that can be incorporated within wrapping materials include microfibers materials and fibrous synthetic cellulosic materials. See, for example, U.S. Pat. No. 4,779,631 to Durocher and U.S. Pat. No. 5,849,153 to Ishino. Representative fibrous materials, and methods for making wrapping materials therefrom, are set forth in U.S. Pat. No. 2,754,207 to Schur et al; and U.S. Pat. No. 5,474,095 to Allen et al.; and PCT WO 01/48318.

The wrapping material normally incorporates a filler material. Certain types of filler materials are set forth in PCT WO 03/043450. Preferably, the filler material has the form of essentially water insoluble particles. Additionally, the filler material normally incorporates inorganic components. Filler materials incorporating calcium salts are particularly preferred. One exemplary filler material has the form of calcium carbonate, and the calcium carbonate most preferably is used in particulate form. See, for example, U.S. Pat. No. 4,805,644 to Hampl; U.S. Pat. No. 5,161,551 to Sanders; and U.S. Pat. No. 5,263,500 to Baldwin et al.; and PCT WO 01/48,316. Other filler materials include agglomerated calcium carbonate particles, calcium tartrate particles, magnesium oxide particles, magnesium hydroxide gels; magnesium carbonate-type materials, clays, diatomaceous earth materials, titanium dioxide particles, gamma alumina materials and calcium sulfate particles. See, for example, U.S. Pat. No. 3,049,449 to Allegrini; U.S. Pat. No. 4,108,151 to Martin; U.S. Pat. No. 4,231,377 to Cline; U.S. Pat. No. 4,450,847 to Owens; U.S. Pat. No. 4,779,631 to Durocher; U.S. Pat. No. 4,915,118 to Kaufman; U.S. Pat. No. 5,092,306 to Bokelman; U.S. Pat. No. 5,109,876 to Hayden; U.S. Pat. No. 5,699,811 to Paine; U.S. Pat. No. 5,927,288 to Bensalem; U.S. Pat. No. 5,979,461 to Bensalem; and U.S. Pat. No. 6,138,684 to Yamazaki; and European Patent Application 357359. Certain filler-type materials that can be incorporated into the wrapping materials can have fibrous forms. For example, components of the filler material can include materials such as glass fibers, ceramic fibers, carbon fibers and calcium sulfate fibers. See, for example, U.S. Pat. No. 2,998,012 to Lamm; U.S. Pat. No. 4,433,679 to Cline; and U.S. Pat. No. 5,103,844 to Hayden et al.; PCT WO 01/41590; and European Patent Application 1,084,629. Mixtures of filler materials can be used. For example, filler material compositions can incorporate mixtures of calcium carbonate particles and precipitated magnesium hydroxide gel, mixtures of calcium carbonate particles and calcium sulfate fibers, or mixtures of calcium carbonate particles and magnesium carbonate particles.

There are various ways by which the various additive components can be added to, or otherwise incorporated into, the base sheet. Certain additives can be incorporated into the wrapping material as part of the paper manufacturing process associated with the production of that wrapping material. Alternatively, additives can be incorporated into the wrapping material using size press techniques, spraying techniques, printing techniques, or the like. Such techniques, known as "off-line" techniques, are used to apply additives to wrapping materials after those wrapping materials have been manufactured. Various additives can be added to, or otherwise incorporated into, the wrapping material simultaneously or at different stages during or after the paper manufacturing process.

The base sheets can be treated further, and those base sheets can be treated so as to impart a change to the overall physical characteristics thereof and/or so as to introduce a change in the overall chemical compositions thereof. For example, the base sheet can be electrostatically perforated. See, for example, U.S. Pat. No. 4,924,888 to Perfetti et al. The base sheet also can be embossed, for example, in order to provide texture to major surface thereof. Additives can be incorporated into the wrapping material for a variety of reasons. Representative additives, and methods for incorporating those additives to wrapping materials, are set forth in U.S. Pat. No. 5,220,930 to Gentry, which is incorporated herein by reference. See, also, U.S. Pat. No. 5,168,884 to Baldwin et al. Certain components, such as alkali metal salts, can act a burn control additives. Representative salts include alkali metal succinates, citrates, acetates, malates, carbonates, chlorides, tartrates, propionates, nitrates and glycolates; including sodium succinate, potassium succinate, sodium citrate, potassium citrate, sodium acetate, potassium acetate, sodium malate, potassium malate, sodium carbonate, potassium carbonate, sodium chloride, potassium chloride, sodium tartrate, potassium tartrate, sodium propionate, potassium propionate, sodium nitrate, potassium nitrate, sodium glycolate and potassium glycolate; and other salts such as monoammonium phosphate. Certain alkali earth metal salts also can be used. See, for example, U.S. Pat. No. 2,580,568 to Matthews; U.S. Pat. No. 4,461,311 to Matthews; U.S. Pat. No. 4,622,983 to Matthews; U.S. Pat. No. 4,941,485 to Perfetti et al.; U.S. Pat. No. 4,998,541 to Perfetti et al.; and PCT WO 01/08514; which are incorporated herein by reference. Certain components, such as metal citrates, can act as ash conditioners or ash sealers. See, for example, European Patent Application 1,084,630. Other representative components include organic and inorganic acids, such as malic, levulinic, boric and lactic acids. See, for example, U.S. Pat. No. 4,230,131 to Simon. Other representative components include catalytic materials. See, for example, U.S. Pat. No. 2,755,207 to Frankenburg. Typically, the amount of chemical additive does not exceed about 3 percent, often does not exceed about 2 percent, and usually does not exceed about 1 percent, based on the dry weight of the wrapping material to which the chemical additive is applied. For certain wrapping materials, the amount of certain additive salts, such as burn chemicals such as potassium citrate and monoammonium phosphate, preferably are in the range of about 0.5 to about 0.8 percent, based on the dry weight of the wrapping material to which those additive salts are applied. Relatively high levels of additive salts can be used on certain types of wrapping materials printed with printed regions that are very effective at causing extinction of cigarettes manufactured from those wrapping materials. Exemplary flax-containing cigarette paper wrapping materials having relatively high levels of chemical additives have been available as Grade Names 512, 525, 527, 540, 605 and 664 from Schweitzer-Mauduit International. Exemplary wood pulp-containing cigarette paper wrapping materials having relatively high levels of chemical additives have been available as Grade Names 406 and 419 from Schweitzer-Mauduit International.

Flavoring agents and/or flavor and aroma precursors (e.g., vanillin glucoside and/or ethyl vanillin glucoside) also can be incorporated into the paper wrapping material. See, for example, U.S. Pat. No. 4,804,002 to Herron; and U.S. Pat. No. 4,941,486 to Dube et al. Flavoring agents also can be printed onto cigarette papers. See, for example, the types of flavoring agents used in cigarette manufacture that are set forth in Gutcho, *Tobacco Flavoring Substances and Methods*, Noyes Data Corp. (1972) and Leffingwell et al., *Tobacco Flavoring for Smoking Products* (1972).

Films can be applied to the paper. See, for example, U.S. Pat. No. 4,889,145 to Adams; U.S. Pat. No. 5,060,675 to Milford et al., and PCT WO 02/43513 and PCT WO 02/055294. Catalytic materials can be incorporated into the paper. See, for example, PCT WO 02/435134 and U.S. Patent Application Publication No. 2004/0134631 to Crooks et al.

Typical paper wrapping materials that can be used in carrying out the present invention are manufactured under specifications directed toward the production of a wrapping material having an overall generally consistent composition and physical parameters. For those types of wrapping materials, the composition and parameters thereof preferably are consistent when considered over regions of each of the major surfaces of those materials. However, typical wrapping materials tend to have a "two-sided" nature, and thus, there can be changes in the composition and certain physical parameters of those materials from one major surface to the other.

Though less preferred, the wrapping material can be manufactured using a paper making process adapted to provide a base web comprising multiple layers of cellulosic material. See, U.S. Pat. No. 5,143,098 to Rogers et al.

Much less preferred paper wrapping materials can have compositions and/or properties that differ over different regions of each of their major surfaces. The wrapping material can have regions of increased or decreased porosity provided by control of the composition of that material, such as by controlling the amount or type of the filler. The wrapping material can have regions of increased or decreased air permeability provided by embossing or perforating that material. See, for example, U.S. Pat. No. 4,945,932 to Mentzel et al. The wrapping material can have regions (e.g., predetermined regions, such as bands) treated with additives, such as certain of the aforementioned salts. However, wrapping materials having a patterned nature are not necessary when various aspects of the present invention are used to apply patterns to those wrapping materials using on-line pattern application techniques.

Paper wrapping materials suitable for use in carrying out the present invention are commercially available. Representative cigarette paper wrapping materials have been available as Ref. Nos. 419, 454, 456, 460 and 473 Ecusta Corp.; Ref. Nos. Velin 413, Velin 430, VE 825 C20, VE 825 C30, VE 825 C45, VE 826 C24, VE 826 C30 and 856 DL from Miguel; Tercig LK18, Tercig LK24, Tercig LK38, Tercig LK46 and Tercig LK60 from Tervakoski; and Velin Beige 34, Velin Beige 46, Velin Beige 60, and Ref Nos. 454 DL, 454 LV, 553 and 556 from Wattens. Other representative cigarette paper wrapping materials are available as 38 CORESTA unit Printed Diagonal Lines, 46 CORESTA unit Printed Diagonal Lines, 60 CORESTA unit Printed Diagonal Lines, 38 CORESTA unit Longitudinal Verge Lines, 46 CORESTA unit Longitudinal Verge Lines, 60 CORESTA unit Longitudinal Verge Lines, 46 CORESTA unit Beige Velin and 60 CORESTA unit Beige Velin from Trierenberg Holding in Austria. Exemplary flax-containing cigarette paper wrapping materials have been available as Grade Names 105, 114, 116, 119, 170, 178, 514, 523, 536, 520, 550, 557, 584, 595, 603, 609, 615 and 668 from Schweitzer-Mauduit International. Exemplary wood pulp-containing cigarette paper wrapping materials have been available as Grade Names 404, 416, 422, 453, 454, 456, 465, 466 and 468 from Schweitzer-Mauduit International.

Coating formulations or additive materials typically are applied to wrapping materials that are supplied from rolls, and most preferably, from bobbins. The amount of wrapping material on a bobbin can vary, but the length of continuous strip of wrapping material on a bobbin typically is more than about 6,000 meters; and generally, the length of continuous strip of wrapping material on a bobbin typically is less than about 7,000 meters. The width of the wrapping material can vary, depending upon factors such as the circumference of the smokable rod that is manufactured and the width of the overlap region zone that provides for the sideseam. Typically, the width of a representative continuous strip of wrapping material is about 24 mm to about 30 mm.

The composition of the additive material or coating formulation can vary. Generally, the composition of the coating is determined by the ingredients of the coating formulation. Preferably, the coating formulation has an overall composition, and is applied in a manner and in an amount, such that the physical integrity of the wrapping material is not adversely affected when the coating formulation is applied to selected regions of the wrapping material. It also is desirable that components of the coating formulation not introduce undesirable sensory characteristics to the smoke generated by a smoke article incorporating a wrapping material treated with that coating formulation. Thus, suitable combinations of various components can act to reduce the effect of coatings on sensory characteristics of smoke generated by the smoking article during use. Preferred coatings provide desirable physical characteristics to cigarettes manufactured from wrapping materials incorporating those coatings. Preferred coatings also can be considered to be adhesives, as it is desirable for those coatings to remain in intimate contact with (e.g., to adhere to or otherwise remain secured to) desired locations on the wrapping material.

Examples of certain types of coating formulations and representative types of components thereof are set forth in U.S. Pat. No. 4,889,145 to Adams; U.S. Pat. No. 5,060,675 to Milford et al.; U.S. Pat. No. 6,929,013 to Ashcraft et al.; U.S. Pat. No. 6,848,449 to Kitao et al.; U.S. Pat. No. 6,904,917 to Kitao et al.; U.S. Pat. No. 6,854,469 to Hancock et al.; U.S. Pat. No. 7,073,514 to Barnes et al.; U.S. Pat. No. 7,276,120 to Holmes; U.S. Pat. No. 7,275,548 to Hancock et al.; PCT Publication No. WO 02/043513; PCT Publication No. WO 02/055294; and European Patent Application No. 1,234,514. Other examples of certain types of coating formulations and representative types of components thereof (for example, starch-containing formulations) are set forth in U.S. Pat. No. 7,234,471 to Fitzgerald et al., which is incorporated by reference herein in its entirety. Other coating formulations are described herein.

The coating formulation preferably comprises a film-forming agent, or material. The film-forming agent can be a polymeric material or resin. Exemplary film-forming materials include alginates (e.g., sodium alginate or ammonium alginate, including those alginates available as Kelcosol from Kelco), pectins (e.g., including those available as TIC Pretested HM from TIC Gums), derivatives of cellulose (e.g., carboxymethylcellulose including the Aqualon sodium carboxymethylcellulose CMC from Hercules Incorporated, and other polymeric materials such as hydroxypropylcellulose and hydroxyethylcellulose), ethylene vinyl acetate copolymers, guar gum (e.g., including Type M, Type MM, Type MM high viscosity from Frutarom; and Ticagel from TIC Gums), xanthan gum (e.g., including Keltrol from Kelco), starch (e.g., corn starch and rice starch), modified starch (e.g., dextrin, oxidized tapioca starch and oxidized corn starch), polyvinyl acetate, and polyvinyl alcohol. Suitable combinations of various film-forming materials also can be employed. Exemplary blends include water-based blends of ethylene vinyl acetate copolymer emulsion and polyvinyl alcohol. Other exemplary blends are water-based blends provided by mixing starches or modified starches with emulsion polymers or copolymers.

In embodiments in which the coating formulation is applied with a solvent or liquid carrier, that solvent or liquid carrier can vary. The solvent can be a liquid having an aqueous character, and can include relatively pure water. An aqueous liquid is a suitable solvent or carrier for film-forming materials such as water-based emulsions, starch-based materials, sodium carboxymethylcellulose, ammonium alginate, guar gum, xanthan gum, pectins, polyvinyl alcohol, and hydroxyethylcellulose. Starch-based materials that are film-forming agents can comprise starch or components derived from starch. In some embodiments, it is preferred that the solvent not be a non-aqueous solvent, such as ethanol, n-propyl alcohol, iso-propyl alcohol, ethyl acetate, n-propyl acetate, iso-propyl acetate, toluene, and the like. Formulations that incorporate solvents in amounts and forms such that those solvents do not adversely affect the quality of the wrapping paper (e.g., by causing swelling of the fibers of the wrapping paper, by causing puckering of the wrapping paper, or by causing wrinkling of the wrapping paper) are particularly preferred.

Generally, the selection of solvent depends upon the nature of the film-forming polymeric material, and that the particular polymeric material selected readily dissolves (i.e., is soluble) or is highly dispersible in a highly preferred solvent. Although not all components of the coating formulation are necessarily soluble in the liquid carrier, it is most preferable that the film-forming polymeric material be soluble (or at least highly dispersible) in that liquid. In referring to the components of the coating formulation with respect to the liquid solvent, "soluble" means that the components for a thermodynamically stable mixture when combined with the solvent have a significant ability to dissolve in that solvent, and do not form precipitates to any significant degree when present in that solvent. Suitable polymeric materials, such as starch-based materials, can be processed within aqueous liquids to produce formulations that can be considered to be "pastes."

The coating formulation and/or the film-forming material can also include a filler material. Exemplary filler materials can be the essentially water-insoluble types of filler materials previously described. Preferred filler materials have a finely divided (e.g., particulate) form. Typical fillers are those that have particle sizes that are less than about 3 microns in diameter. Typical particle sizes of suitable fillers range from about 0.3 micron to about 2 microns in diameter. The filler materials can have a variety of shapes. Exemplary filler materials are those that are composed of inorganic materials including metal particles and filings, calcium carbonate (e.g., precipitated-type fillers, including those having a prismatic form), calcium phosphate, clays (e.g., attapulgite clay), talc, aluminum oxide, mica, magnesium oxide, calcium sulfate, magnesium carbonate, magnesium hydroxide, aluminum oxide, and titanium dioxide. See, for example, the types of filler materials set forth in U.S. Pat. No. 5,878,753 to Peterson et al. Representative calcium carbonate fillers are those available as Albacar PCC, Albafil PCC, Albaglos PCC, Opacarb PCC, Jetcoat PCC, and Calopake F PCC from Specialty Minerals, Inc. Prismatic forms of calcium carbonate are especially preferred. Exemplary filler materials can also comprise organic materials including starches, modified starches and flours (e.g., rice flour), particles of polyvinyl alcohol, particles of tobacco (e.g., tobacco dust), extracts of tobacco (e.g., spray dried tobacco extracts), and other like materials. The filler material can also be fibrous cellulosic materials. See, for example, U.S. Pat. No. 5,417,228 to Baldwin et al. Although less preferred, alternate fillers can include carbon-based materials (e.g., graphite-type materials, carbon fiber materials, and ceramics), metallic materials (e.g., particles of iron), and the like. The filler material also can be a water soluble salt (e.g., potassium chloride, sodium chloride, potassium citrate, sodium citrate, calcium chloride, or magnesium chloride). Other exemplary water soluble salts are those various types of salts that are set forth herein as appropriate components of wrapping paper materials for smokable rods. Filler materials can be used to provide desirable properties to the coating formulation when applied to the wrapping paper, enhance wet coating hold-out, reduce the amount of water present in the formulation, increase the weight and solids content of the formulation, decrease drying requirements, facilitate drying process steps that involve the use of microwave dryers, and decrease the tendency of the wrapping paper to tear during and/or after the coating formulation is applied.

The coating formulations can incorporate other ingredients in addition to the aforementioned coating materials. Those ingredients can be dispersed or suspended within the coating formulation. Those other ingredients can be employed in order to provide specific properties or characteristics to the wrapping paper. Those ingredients can be preservatives (e.g., potassium sorbate), humectants (e.g., ethylene glycol, propylene glycol, and derivatives thereof), pigments, dyes, colorants, burn promoters and enhancers, burn retardants and inhibitors, plasticers (e.g., dibutyl phthalate, polyethylene glycol, polypropylene glycol, and triacetin), sizing agents, syrups (e.g., high fructose corn syrup), flavoring agents (e.g, ethyl vanillin and caryophyllene oxide), sugars (e.g., rhamnose), flavor precursors, components that provide a desirable aroma or odor, deodorants, optical brighteners and other agents that can be used to assist in inspecting the applied pattern, hydrating materials, such as metal hydrates (e.g., borax, magnesium sulfate decahydrate, sodium silicate pentahydrate, and sodium sulfate decahydrate), oils, surfactants, defoaming agents, viscosity reducing agents (e.g., urea), acidic materials (e.g., inorganic acids, such as boric acid, and organic acids, such as citric acid), basic materials (e.g., alkali metal hydroxides), and the like. Certain of those ingredients are soluble in the solvent of the coating formulation (e.g., certain salts, acids, and bases are soluble in solvents such as water). Certain of those ingredients are insoluble in the solvent of the coating formulation (e.g., particles of metallic materials are insoluble in most of the solvents used for coating formulations). See, for example, those types of components set forth in U.S. Pat. No. 6,929,013 to Ashcraft et al. Various types of suitable salts, including suitable water soluble salts, are set forth in U.S. Pat. No. 2,580,568 to Matthews; U.S. Pat. No. 4,461,311 to Matthews; U.S. Pat. No. 4,622,983 to Matthews; U.S. Pat. No. 4,941,485 to Perfetti et al.; U.S. Pat. No. 4,998,541 to Perfetti et al.; and PCT Publication No. WO 01/08514.

In alternative embodiments in which the coating formulation is applied with a solvent, the coating formulation typically has a liquid, syrup, or paste form, and is applied as such. Depending upon the actual ingredients that are combined with the solvent, the coating formulation has the form of a solution, an emulsion (e.g., a water-based emulsion), or a liquid having solid materials dispersed therein. The film-forming material can be dissolved or dispersed in a suitable solvent to form the coating formulation. Certain other optional ingredients can also be dissolved, dispersed, or suspended in that formulation. Additionally, optional filler material can also be dispersed within that formulation. Preferably, the filler material is essentially insoluble and essentially chemically non-reactive with the solvent, at least at those conditions at which the formulation is employed. Coating formulations having the form of what can be considered to be pastes may be particularly useful. Typically, a paste (a) is formed by heating a mixture of water and a starch-based material sufficiently to hydrolyze the starch-based material, (b) has a flowable, plastic-type fluid form, (c) exhibits adhesive properties, and hence exhibits a tendency to maintain its position when applied to a substrate, and (d) forms a desirable film upon drying.

The relative amounts of the various components in a solvent-carried coating formulation can vary. Typically, the coating formulation includes at least about 30 percent solvent, usually at least about 40 percent solvent, and often at least about 50 percent solvent, based on the total weight of that formulation. Typically, the amount of solvent within the coating formulation does not exceed about 95 percent, usually does not exceed about 90 percent, and often does not exceed about 85 percent, based on the total weight of that formulation. In some embodiments, the coating formulation includes at least about 0.5 percent film-forming material, usually at least about 1 percent film-forming material, and often at least about 2 percent film-forming material, based on the total weight of that formulation. In certain embodiments, the amount of film-forming material within the coating formulation does not exceed about 60 percent, usually does not exceed about 50 percent, and often does not exceed about 40 percent, based on the total weight of that formulation. In particular embodiments, the coating formulation can typically include at least about 3 percent of the optional filler material, usually at least about 5 percent filler material, and often at least about 10 percent filler material, based on the total weight of that formulation. Typically, the amount of optional filler material within the coating formulation does not exceed about 35 percent, usually does not exceed about 30 percent, and often does not exceed about 25 percent, based on the total weight of that formulation.

The amounts of other optional components of the coating formulation can vary. The amount of plasticizer often ranges from about 0.5 percent to about 5 percent, and preferably ranges from about 2 to about 3 percent, based on the total weight of the formulation. The amount of humectant often ranges from about 1 percent to about 5 percent, and preferably ranges from about 2 to about 3 percent, based on the total weight of the formulation. The amount of wetting agent often ranges from about 0.5 percent to about 2 percent, and preferably ranges from about 0.8 to about 1 percent, based on the total weight of the formulation. The amount of preservative often ranges from about 0.01 percent to about 0.3 percent, and preferably ranges from about 0.5 percent, based on the total weight of the formulation. The amount of burn chemical often ranges from about 1 percent to about 15 percent, and preferably ranges from about 5 to about 10 percent, based on the total weight of the formulation. The amount of viscosity reducing agent often ranges from about 1 percent to about 10 percent, and preferably ranges from about 2 percent to about 6 percent, based on the total weight of the formulation. The amount of burn chemical often ranges from about 1 percent to about 15 percent, and preferably ranges from about 5 to about 10 percent, based on the total weight of the formulation. The amount of metal hydrate often ranges from about 3 percent, usually at least about 5 percent, and often at least about 10 percent, based on the total weight of that formulation; but the amount of metal hydrate usually does not exceed about 35 percent, often does not exceed about 30 percent, and frequently does not exceed about 25 percent, based on the total weight of that formulation.

Flavoring agents can be incorporated into the coating formulations. Preferably, the flavoring agents exhibit sensory characteristics that can be described as having notes that are sweet, woody, fruity, or some combination thereof. The flavoring agents preferably are employed in amounts that depend upon their individual detection thresholds. Typically, the flavoring agents are employed in sufficient amounts so as to mask or ameliorate the off-tastes and malodors associated with burning paper. Combinations of flavoring agents (e.g., a flavor package) can be employed in order to provide desired overall sensory characteristics to smoke generated from the smoking articles incorporating those flavoring agents. Most preferably, those flavoring agents are employed in amounts and manners so that the sensory characteristics of those flavoring agents are hardly detectable; and those flavoring agents do not adversely affect the overall sensory characteristics of smoking article into which they are incorporated. Preferred flavoring agents can be incorporated into coating formulations, have low vapor pressures, do not have a tendency to migrate or evaporate under normal ambient conditions, and are stable under the processing conditions experienced by wrapping paper materials of the present invention. Exemplary flavoring agents that provide sweet notes include ethyl vanillin, vanillin, heliotropin, and methylcyclopentenolone; and those flavoring agents typically are employed in amounts of 0.001 to about 0.01 percent, based on the total weight of the coating formulation into which they are incorporated. An exemplary flavoring agent that provides woody notes includes caryophyllene oxide; and that flavoring agent typically is employed in amounts of 0.2 to about 0.6 percent, based on the total weight of the coating formulation into which it is incorporated. Exemplary flavoring agents that provide fruity notes include ketones such as 4-hydroxphenyl-2-butanone and lactones such as gamma-dodecalactone; and those flavoring agents typically are employed in amounts of 0.001 to about 0.1 percent, based on the total weight of the coating formulation into which they are incorporated.

In some embodiments, certain additive materials can be applied to the wrapping paper in the form of a coating formulation that is in a so-called "solid polymer" form. That is, film-forming materials, such as ethylene vinyl acetate copolymers and certain starches, can be mixed with other components of the coating formation, and applied to the wrapping paper without the necessity of dissolving those film-forming materials in a solvent. Typically, solid polymer coating formulations are applied at elevated temperatures relative to ambient temperature; and the viscosities of the film-forming materials of those heated coating formulations typically have an extremely wide range of viscosities.

Certain highly preferred coating formulations of the present invention incorporate at least one type of starch-based material. Typical formulations incorporate about 25 to about 65, and generally about 35 to about 55, weight percent water; about 30 to about 55, and generally about 35 to about 50, weight percent starch-based material; and about 0 to about 35 weight percent other components (e.g., such as the types of additive components described herein). For example, filler materials can make up about 5 to about 30 weight percent of such a formulation; preservatives can make up less than about 1 weight percent of such a formulation; and colorants can make up a very small amount of the formulation. Typically, the solvent (e.g., water) content of a suitable coating formulation can be at least about 35 and up to about 50 weight percent of the formulation, and the starch-based material and other non-solvent components of the formulation can make up at least about 50 and up to about 65 weight percent of the formulation. For certain formulations, water comprises less than about 50 percent of the formulation. In certain embodiments, mixtures of starch-based materials and emulsion polymers, or mixtures of starch-based materials and emulsion copolymers, can be employed. In an exemplary embodiment, the coating formulation can be provided by mixing a starch-based material in water with a polyvinylalcohol-stabilized emulsion polymer or copolymer (e.g., ethylene vinyl acetate); or by mixing a starch-based material in water with a surfactant-stabilized emulsion polymer or copolymer. For example, surfactant-stabilized ethylene vinyl acetate copolymer emulsions, such as those having solids contents of about 70 to about 75 percent by weight, can be incorporated within starch-based paste formulations in amounts of about 5 to about 25 percent, based on the total weight of the formulation. As another example, dry addition of low molecular weight polyvinylalcohol into either a surfactant-stabilized vinyl acetate ethylene emulsion or a polyvinylalcohol-stabilized emulsion to produce an emulsion having a solids content of about 50 to about 75 percent by weight, can be incorporated with starch-based paste formulations in amounts of about 5 to about 25 percent, based on the total weight of the formulation.

The type of starch-based material can vary. Exemplary starches include tapioca, waxy maize, corn, potato, wheat, rice, and sago starches. Modified starches also can be employed. Starch can be treated with acid to provide a thin boiling starch, treated with sodium hypochlorite to provide an oxidized starch, treated with acid and roasted to provide a dextrin, polymerized to provide a crosslinked specialty starch, or chemically substituted. Combinations of starches and modified starches can be employed; and as such, some embodiments of coating formulations can incorporate at least two starch-based materials. Exemplary starch-based materials include materials characterized as being derived from tapioca starch, as being derived from waxy maize starch, and as being dextrins. See, for example, the trade booklet Corn Starch, Corn Industries Research Foundation, Inc. (1955).

In certain embodiments, a starch-based material can be prepared by dispersing a starch and/or a modified starch in water, and heating sufficiently to cause the starch-based material to undergo hydration. A variety of methods can be used to heat aqueous dispersions incorporating starch-based materials. Suitable starch-based formulations can be manufactured using a "batch" type of process, although jet cooking, and other types of continuous cooking, can also be employed. Preferred methods for providing starch-based paste types of materials of desirable stability and smoothness involve control of temperature, heating time, agitation, degree of cooling, and cooling time. Processing a mixture of aqueous liquid and starch-based material provides a formulation that possesses the starch-based component in a form that is capable of forming a type of film on the wrapping paper to which the formulation is applied. In addition, the gelling properties of starch-based pastes help cause those formulations to form desirable films on the surface regions of wrapping paper materials to which the formulation is applied. Starch-based pastes can be shear sensitive, and hence are suitable for application to a wrapping paper material using the types of equipment described herein.

A preferred method for cooking a starch-based formulation having the form of a paste includes measuring the required amount of water (e.g., water at ambient temperature or warm water at about 100° F.) into a water-jacketed cooking apparatus. With mild agitation, desired components (e.g., colorant, sodium chloride, and potassium sorbate) can be added to the water, followed by the desired amount of starch-based material. The starch-based material can be sifted prior to use in order to avoid lump formation; and any powdered starch-based material can be scraped from the inner sidewalls of the cooker back into the liquid mixture. Then, the jacketed tank hot water circulation system is set at a desired temperature (e.g., about 150° F.). When the slurry reaches a predetermined temperature (e.g., about 130° F.), a recirculating pump can be used to recirculate the aqueous slurry of starch-based material. A propeller type of mixer (e.g., operated at about 100 rpm to about 300 rpm, often about 200 rpm to about 250 rpm) can be used to provide a shearing type of mixing to that slurry. The jacketed tank hot water circulation system then is set at a desired temperature (e.g., about 190° F. to about 200° F.), and the slurry is cooked further. Cooking is continued at least until the slurry reaches a temperature at which the starch-based material undergoes hydration, and hence commences to behave as a gel. Such a cooking time can vary; however, the heating rate is often such that the slurry reaches a temperature sufficient for the starch-based material to commence forming a gel within about 30 to about 90 minutes. As a result, the slurry commences to exhibit the behavior of a paste. The temperature at which the starch-based material undergoes hydration can vary depending upon factors such as the selection of the particular starch-based material. Typically the slurry is heated to a temperature of at least about 150° F., and frequently the slurry is not heated to a temperature of above about 200° F. For example, for one type of starch-based material, the slurry is heated and maintained at about 170° F. to about 180° F.; and for another type of starch-based material, the slurry is heated and maintained at about 190° F. to about 195° F. The manner by which the slurry is maintained at the elevated temperature can vary (e.g., the jacketed tank hot water flow can be cycled on and off in order to maintain the starch-based slurry, which has the form of a paste, within a desired temperature range for a desired period of time). Slurries of larger volume are often maintained at elevated temperature for longer periods of time than are slurries of smaller batch size. The time period over which the slurry is maintained at the elevated temperature typically is that period over which the starch-based material undergoes a desired degree of hydration. For slurries having volumes of less than about 20 liters, that period typically does not exceed about 30 minutes, and often that period does not exceed about 20 minutes. Then, the resulting paste is cooled. For example, ambient temperature water can be circulated through the jacketed tank to cool the starch-based paste below a desired temperature (e.g., to about 140° F., or less). Coating formulations can have viscosities that increase with decreasing temperature (e.g., viscosities of about 60,000 centipoise to about 150,000 centipoise at 25° C.), making it desirable for the starch-based paste to be handled in a more liquid form while at an elevated temperature. The resulting starch-based paste can then be used virtually immediately to apply a pattern to a wrapping paper; or the paste so manufactured can be held and transferred (e.g., pumped) into a suitable container for storage, shipping, and later use.

Another method for cooking a starch-based paste formulation can include the use of an inline steam injection cooker. A suitable aqueous starch-based formulation can be heated and mixed using such a cooker. Control of the heating and cooling rates of the formulation can be achieved through appropriate means (e.g., through use of an inline heat exchange system).

Mixtures of starch-based materials can be used to achieve coating formulations having relatively high solids contents and relatively low solvent contents. Raw or uncooked starch-based materials can be incorporated into those formulations. Thin boiling starch-based materials can be incorporated into those formulations. Mixtures of starch-based materials, and certain additive materials, such as oils and surfactants (e.g., coconut oil or potassium sterarate), can be incorporated into the formulation in relatively small amounts; and as such, formulations can exhibit reduced propensities to retrograde.

The amount of coating formulation that is applied to the paper wrapping material can vary. Generally, the amount of coating formulation that is applied to the paper wrapping material is not dependent upon whether the coating formulation is applied using a solvent or without a solvent. Typically, coating of the wrapping paper material provides a coated paper having an overall dry basis weight (i.e., the basis weight of the whole wrapping paper material, including coated and uncoated regions) of at least about 1.05 times, often at least about 1.1 times, and frequently at least about 1.2 times, that of the dry basis weight of that wrapping paper material prior to the application of coating thereto. Generally, coating of the wrapping paper material provides a coated paper having an overall dry basis weight of not more than about 1.5 times, typically about 1.4 times, and often not more than about 1.3 times, that of the dry basis weight of the wrapping paper material that has the coating applied thereto. Typical overall dry basis weights of those wrapping paper materials are about 20 g/m$^2$ to about 40 g/m$^2$, and preferably about 25 g/m$^2$ to about 35 g/m$^2$. For example, a wrapping paper material having a dry basis weight of about 25 g/m$^2$ can be coated in accordance with the present invention to have a resulting overall dry basis weight of 26 g/m$^2$ to about 38 g/m$^2$, frequently about 26.5 g/m$^2$ to about 35 g/m$^2$, and often about 28 g/m$^2$ to about 32 g/m$^2$.

The dry weights of the coated regions of wrapping paper material of the present invention can vary. Generally, the dry weights of the coated regions of wrapping paper material are not dependent upon whether the coating formulation is applied using a solvent or without a solvent. For wrapping paper materials that are used for the manufacture of cigarettes designed to meet certain cigarette extinction test criteria, it is desirable that the wrapping paper materials have sufficient coating formulation applied thereto to in the form of appropriately shaped and spaced bands in order that the dry weight of additive material applied to those wrapping materials totals at least about 1 pound/ream, often at least about 2 pounds/ream, and frequently at least about 3 pounds/ream, while the total dry weight of that applied additive material normally does not exceed about 10 pounds/ream.

Typical coated regions of paper wrapping materials of the present invention that are suitable for use as the circumscribing wrappers of tobacco rods for cigarettes have inherent porosities that can vary. Typically, the inherent porosities of the coated regions of the wrapping materials are less than about 8.5 CORESTA units, usually are less than about 8 CORESTA units, often are less than about 7 CORESTA units, and frequently are less than about 6 CORESTA units. Typically, the inherent porosities of the coated regions of the wrapping materials are at least about 0.1 CORESTA unit, usually are at least about 0.5 CORESTA unit, often are at least about 1 CORESTA unit. Preferably, the inherent porosities of the coated regions of the wrapping materials, particularly those wrapping materials that are used for the manufacture of cigarettes designed to meet certain cigarette extinction test criteria, are between about 0.1 CORESTA unit and about 4 CORESTA units.

Applying a coating formulation to a tobacco paper, for example, to reduce porosity, can include the application of pressure and/or heat to the additive material, for example, additive materials comprising film-forming materials. Such application of pressure and/or heat to the additive material can also apply pressure and/or heat to the paper, for example, as in embossing or calendaring a paper. In such processes, the additive material may be deformed, or diffused, into bands in desirable positions and dimensions on the paper. For example, an additive material, such as a film-forming material, comprising a polymer can be diffused with pressure and/or heat into a band or pattern on a paper.

The rate at which the additive material is deformed into a band can be quantified as a measure of diffusivity. Diffusivity relates to mass flux, or the movement of objects from one point to another in a given time. Diffusivity describes how fast or slow an object diffuses. For purposes herein, diffusivity can be defined as the rate at which a mass of solute transfers per unit area ($cm^2$) per unit time (second) under unit concentration gradient. In general, the diffusivity of a solute decreases with its molecular weight, and decreases with the molecular weight of the fluid through which it is diffusing, increases with temperature, and decreases with pressure.

When an additive material, for example, a film-forming material, is applied as a band (such as bands 1505, 1506, 1507, 1508 shown in FIG. 8) on a paper suitable for making a smokable product, the paper can also undergo a certain amount of deformation. The amount of diffusivity of the paper is in a relatively inverse relationship to the amount of pressure applied to the paper. That is, as the amount of pressure on the paper increases, the amount of diffusivity of the paper decreases. For example, in one embodiment of plain tobacco paper, as pressure (created by an ultrasonic force) on the paper increases from 0 to about 300 Newtons, paper diffusivity decreases from about 1.8 cm/second to about 1.3 cm/second in a relatively linear fashion. In these ranges of pressure and diffusivity, the paper maintains an acceptable level of opacity. An acceptable level of opacity indicates that the integrity of the paper can be maintained to an acceptable degree for commercial production of smokable products.

However, the paper comprises cellulose, which can be characterized by a relatively low degree of deformability. As a result, an increase in the amount of pressure to deform the material into a desirable band on the paper can have a propensity to damage the paper in the process. For example, as the pressure, or ultrasonic force, on a plain tobacco paper increases to a range of about 400 to about 600 Newtons, the diffusivity of the plain paper can decrease to a range of about 1.2 cm/second to about 0.8 cm/second. Thus, the effect of increased pressure can cause a decrease in diffusivity of the paper (and the additive material), which is undesirable for deforming the additive material into a band on the cellulose-containing paper. At the same time, at such increased pressure levels, opacity of the paper, and thus the paper's integrity, can become unacceptable for producing high quality wrapped smoking articles.

Thus, another aspect of the present invention relates to a wrapping paper for a smokable rod having decreased paper diffusivity as a result of the application of additive materials so as to preserve the opacity of the paper at desired levels. In some embodiments, the wrapping paper for a smokable rod can comprise a pattern of intermittent bands applied to a wire side surface of the wrapping paper. The bands comprise a water-insoluble material comprising a starch-based material. The starch component can be in an amount such that the material is sufficiently deformable so as to (a) reduce an amount of pressure to apply the bands, (b) decrease paper diffusivity, and (c) maintain paper opacity at a level acceptable for commercial production of the smokable rods. The pattern of bands can be adapted to reduce the porosity of the paper so as to decrease the supply of oxygen to smokable material inside the rod and thereby reduce ignition propensity of the smokable rod. Alternatively, the additive material can include one or more of other materials capable of deforming, including, for example, hydrocarbon polymers such as waxes, polyolefins, thermoplastic starches, and aliphatic polyesters and their mixtures. Such materials can be in the form of a hot melt material, or can be applied as a filler coating. In addition, other materials contemplated by the present invention include, for example, flavoring agents and/or odor-masking agents. Such flavoring agents and/or odor-masking agents can be encapsulated, heat stable, and can release flavors or odor-masking compounds at elevated temperatures, for example, at about 400 degrees C. Such components may provide an ability to alter the nature or character of smoke.

In some embodiments, the starch in the material can comprise a starch ester. In a preferred embodiment, the starch comprises a starch particle size of about 200 to about 1000 nm. The starch ester can be derived in various manners. In one preferred manner, the starch ester is formed from a starch reacted with an organic carboxylic acid anhydride. One example of such a starch ester is a starch acetate. In a particular embodiment, the material comprises a filler comprising a starch having a size of about 200 to about 400 nm and a calcium carbonate filler, the starch comprising a filler loading of about 20% and the calcium carbonate comprising a filler loading of about 6%. In a wrapping paper having bands of such a material, the bands can have an amount and density sufficient to maintain opacity in the paper.

In some embodiments, the starch in the material can comprise a starch-coated inorganic filler. In a preferred embodiment, the starch-coated inorganic filler comprises calcium carbonate. In a highly preferred embodiment, the ratio of starch to calcium carbonate is about 1:1 to about 1:3. These ratios can refer to the ratio of the thickness of the starch to the thickness of the calcium carbonate in the filler. The total thickness of a band, for example, a starch and calcium carbonate band, can be seen as the thickness of bands 1505, 1506, 1507, 1508 on the paper web 55 in FIG. 8. Preferably, the calcium carbonate filler has a size in the range of about 0.5 to about 2.4 microns. In some embodiments, the calcium carbonate comprises a scalenohedron-shaped or a rhombic-shaped precipitated calcium carbonate. In such an embodiment, an area of the wrapping paper having the band applied preferably comprises a decreased diffusivity. Optimization of starch content in a wrapping paper can result in a decrease in paper diffusivity, thereby protecting the integrity of the wrapping paper during application of such additive materials, for example, a film-forming material. In this way, opacity of the paper can be maintained at a level acceptable for commercial production of the smokable rods.

In some embodiments, the material can include a hot melt formulation comprising a thermoplastic polymer, in combination with a starch ester and/or a starch-coated inorganic filler, such as calcium carbonate. Preferably, the hot melt formulation comprises a melting temperature in a range of about 60 degrees C. to about 130 degrees C. A hot melt formulation can be applied to the wrapping paper in various ways. For example, the hot melt material can be applied to the paper without a solvent, and can be cured at ambient temperature. In a preferred embodiment, the hot melt formulation comprises an electrostatic powder that can be applied to the paper utilizing ultrasonic waves. A starch useful in combination with a thermoplastic polymer can be derived in various manners. In one preferred manner, the starch comprises a starch derivative grafted with an aliphatic polyester formed from copolymerization of the starch with a cyclic ester.

In a preferred embodiment, the thermoplastic polymer comprises a polycaprolactone. For a paper having an additive material in which the polymer comprises a polycaprolactone, heating the material and paper at an elevated temperature, for example, above 220 degrees C., and for a sufficient period of time, for example, 15 minutes, decreases the paper diffusivity to desirable levels. Thus, an increase in heat on a wrapping paper during application of additive materials can result in a decrease in paper diffusivity.

In some embodiments, the additive material can include a starch ester, a starch-coated inorganic filler, or both. An additive material having a starch ester, a starch-coated inorganic filler, or both can further include a thermoplastic polymer. In preferred embodiments, the starch ester and/or starch-coated filler comprise a total loading weight in a range greater than 20 percent, preferably in a range of about 20 percent to about 30 percent, of the total weight of the paper and starch ester and/or filler. Such a filler loading in a wrapping paper can result in a decrease in paper diffusivity so as to reduce the amount of pressure needed to apply the bands. In this way, the integrity of the wrapping paper can be protected during application of additive materials, thereby maintaining an acceptable level of paper opacity suitable for commercial production of the smokable rods. Such wrapping paper can comprise a fire standard compliant paper having a self-extinction rate of at least 75% in a standard (ASTM) test of ignition strength. Such additive materials according to the present invention are particularly useful in preparing fire standard compliant paper from paper having a low dry basis weight without the additive material, for example, in the range of about 20 $g/m^2$ to about 30 $g/m^2$.

In another aspect, the present invention relates to a cigarette comprising a column of smokable material, and a wrapping paper having a wire side surface and a felt side surface circumscribing the smokable material such that the felt side surface of the paper faces the smokable material, in which a pattern of intermittent bands is applied to the wire side surface of the paper. The bands comprise a water-insoluble material comprising a starch ester and/or a starch-coated inorganic filler. The starch component can be in an amount such that the material is sufficiently deformable so as to (a) reduce an amount of pressure to apply the bands, (b) decrease paper diffusivity, and (c) maintain paper opacity at a level acceptable for commercial production of the cigarette. The pattern of bands can be adapted to reduce the porosity of the paper so as to decrease the supply of oxygen to the smokable material inside the cigarette and thereby reduce ignition propensity of the cigarette. In preferred embodiments, the starch ester and/or starch-coated filler in the cigarette paper comprise a total loading weight in a range of about 20 percent to about 30 percent of the total weight of the paper and starch ester and/or filler. In some embodiments, the material can further include a hot melt formulation comprising a thermoplastic polymer having a melting temperature in a range of about 60 degrees C. to about 130 degrees C. As further described herein, paper diffusivity in a cigarette wrapping paper can be decreased by each of an additive material comprising a water insoluble, starch component, a relatively high filler loading from the material in the paper, and utilizing heat to apply the material to the paper. A lowered paper diffusivity allows a reduced amount of pressure to apply the bands, thereby preserving paper opacity suitable for commercial production of the cigarettes.

In another aspect, the present invention relates to a method of making a wrapping paper for a smoking article. The method can include the steps of: providing a wrapping paper substrate for a smoking article wound on a first roll; unwinding the substrate from the first roll; and applying on the substrate a pattern of intermittent bands comprising a water-insoluble material comprising a starch ester and/or a starch-coated inorganic filler. The starch component can be in an amount such that the material is sufficiently deformable so as to (a) reduce an amount of pressure to apply the bands, (b) decrease paper diffusivity, and (c) maintain paper opacity at a level acceptable for commercial production of the smoking article. Such a wrapping paper can be utilized to make a smoking article having reduced ignition propensity.

In some embodiments of such a method, the starch can comprise a particle size of about 200 nm to about 1000 nm. In a preferred embodiment, the additive material comprises a filler comprising a starch having a size of about 200 nm to about 400 nm and a calcium carbonate filler, the starch comprising a filler loading of about 20% and the calcium carbonate comprising a filler loading of about 6%. In another preferred embodiment, the starch-coated inorganic filler further comprises calcium carbonate, and the material further comprises a ratio of starch to calcium carbonate in the range of about 1:1 to about 1:3. In some embodiments of such a method, the material can further include a hot melt formulation comprising a thermoplastic polymer. Preferably, the hot melt formulation comprises a melting temperature in a range of about 60 degrees C. to about 130 degrees C. For a paper having an additive material in which the polymer comprises a polycaprolactone, heating the material and paper at an elevated temperature, for example, above 220 degrees C., and for a sufficient period of time, for example, 15 minutes, decreases the paper diffusivity to desirable levels. In preferred embodiments, the starch ester and/or starch-coated filler in the cigarette paper comprise a total loading weight in a range of about 20 percent to about 30 percent of the total weight of the paper and starch ester and/or filler.

The bands of material, for example, a film-forming material, can be applied to the wrapping paper in various ways and utilizing various apparatus. Some embodiments of such a method can further include applying the material onto the substrate without a solvent. In a preferred embodiment, the bands can be applied to the paper utilizing a hot embossing technique. In a highly preferred embodiment, the bands can be applied to the paper by heating the material with ultrasonic waves. In preferred embodiments, the bands can be cured sufficiently at ambient temperature to solidify the bands on the substrate.

The pattern of bands can be applied to the paper by other means, including, for example, by spraying or by inkjet coating. In some embodiments, the pattern of bands can be applied to the substrate on-line on a cigarette making apparatus during making of the smoking article. Preferably, in such an on-line manner, the bands can be applied without changing the speed of the paper of about 600 meters per minute or greater during manufacture of the smoking articles. In other embodiments, the method can further include winding the substrate onto a second roll such that the pattern of bands is applied to the substrate offline prior to making of the smoking article. In particular embodiments, each of the bands comprises a first coating layer effective in reducing an inherent porosity of the substrate, and a second coating layer different from the first coating layer and overlying the first coating layer. For a substrate wound onto a second roll, the second coating layer can be effective in preventing blocking, that is to allow the substrate to cleanly release, when the wrapping paper is unwound from the second roll.

Figure 20:
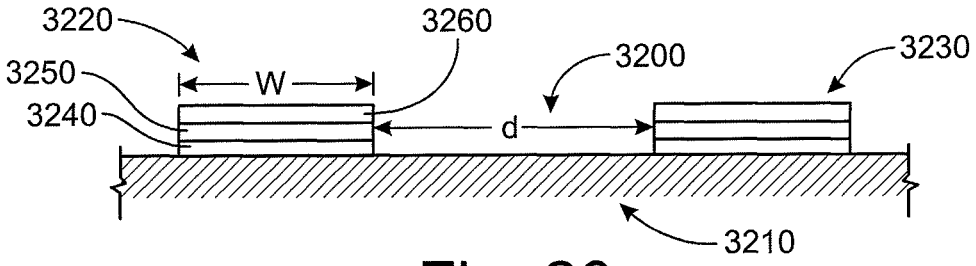
FIG. 20 is a diagrammatic view of a plurality of bands applied onto a paper web.

As shown in FIG. 20, one embodiment of a printed paper wrapping material 3200 has a paper base sheet 3210 that includes a printed pattern having the form of a series of recurring bands, two of which are shown as bands 3220, 3230. The paper wrapping material can have a dry basis weight of about 25 g/m2. The bands 3220, 3230 both have maximum widths of, for example, about 4 mm. The width of each band is illustrated as width "w." In other embodiments, each band can have a maximum width of about 6 mm, or other width, suitable for altering performance characteristics of a smokable article, such as a cigarette. The bands are positioned at predetermined intervals, such that the spacing between each of the respective bands, as measured as the space separating each band, is about 20 mm. That spacing is illustrated as distance "d." The bands are printed onto the base sheet as a plurality of continuous layers, and for the embodiment shown, there are three layers, 3240, 3250 and 3260. The application pattern of each layer can be virtually the same, and the layers can be registered so that each successive layer directly and completely overlies the layer directly below. The coating formulation used to apply to each layer may or may not be the same. The layers can be applied by spraying or by ink jet coating.

The first or bottom layer 3240 of printing formulation can be applied, such as by spraying or ink jet printing onto the base web 3210. The same coating formulation can be printed as the second layer 3250 onto the first layer 3240. The second layer 3250 can be printed in virtually the same manner as the first layer 3240. Printed onto the second layer 3250 is a third layer 3260, which can comprise the same coating formulation as the first and second layers 3240, 3250, respectively. The third layer 3260 can be applied in virtually the same manner as the first and second layers 3240, 3250, respectively.

When the printed wrapping material 3200 is slit into a web of 27 mm width, that web possesses a plurality of spaced-apart bands, each band being about 4 mm in width and about 27 mm across. The dry weight of each band can be, for example, about 1.5 mg (i.e., the weight provided to the base sheet in the each region having the layers of coating formulation can be about 1.5 mg). The amount of dry weight provided by each layer of each band can be, for example, about 0.5 mg. The wrapping material 3200 so provided represents a base sheet having a series of essentially equally spaced, multi-layered bands of essentially equal width and dimension. Each band can be continuous in nature, and each layer of each band can be continuous.

In some embodiments, one or more of the coating layers of a band of coating formulation can comprise a different coating formulation than other coating layers. For example, in certain embodiments, each of the plurality of bands of coating formulation can include the first coating layer 3240 effective in reducing an inherent porosity of the substrate, and the second coating layer 3250 that is different from the first coating layer 3240 and overlying the first coating layer 3240. In such embodiments, at least one of the coating layers 3240, 3250 in each band can be applied by spraying or by ink jet coating.

Another representative formulation for an additive material for a web of wrapping paper is a non-aqueous starch-based formulation. The starch-based formulation can be a film-forming material for application to a tobacco paper to reduce porosity. In one aspect of the present invention, the starch filler formulation comprises a starch ester. The starch ester formulation can provide bands on the paper that cause the paper to exhibit low ignition propensity suitable for FSC paper. Starch esters are more water-insoluble than plain starches, and are unexpectedly effective as a porosity-reducing filler in tobacco paper. Small holes in paper, for example, those less than one micron in size, have allowed some residual permeability in conventional tobacco papers treated with materials to reduce porosity. However, some embodiments of starch esters according to the present invention have particle sizes sufficiently small to optimize packing of such smaller holes in tobacco paper. For example, starch ester particles in the range of less than 400 nm, such as between 200-400 nm, may be sufficiently small to effectively enter paper pores. Alternatively, starch ester particles larger than 600 nm, preferably in the range of 600-1000 nm, may be of sufficient size to effectively enter paper pores. Such optimized packing of small paper holes by the starch ester closes those small holes and thus decreases paper porosity and oxygenation potential. As a result, paper having bands of such a starch ester applied exhibit a reduced ignition capability so as to provide FSC-rated paper.

It was discovered that in paper having such an optimized level of filler loading and starch content, paper porosity, or permeability, can be controlled a function of temperature. This helps reduce the amount of pressure needed to deform and apply a starch filler formulation onto the paper, which in turn helps preserve the integrity of the paper. Such an approach is particularly useful in low weight papers that are more susceptible to damage by excessive pressure, for example wrapping papers having a dry basis weight in the range of about 20 g/m$^2$ to about 30 g/m$^2$. In this manner, a low ignition propensity FSC paper can be provided that exhibits a similar strength to the paper prior to treatment. Paper strength is important to allow processing the paper at speeds of about 600 meters per minute typical in the manufacture of smokable articles utilizing such paper. Starch esters can be compounded with other filler materials, such as polymers, so that the starch ester can be applied to the paper without a solvent. Accordingly, the filler can be cured under ambient conditions. As a result, any drying step can be eliminated, which can serve to further protect the paper.

A wrapping paper having a starch-based formulation can be utilized to manufacture smoking articles, such as cigarettes, such that the paper is effective in reducing ignition propensity, or proclivity, while minimizing the chance of discernible changes in smoke delivery and taste to a smoker.

A starch ester useful in making materials that can be applied as bands, or as fillers, on a paper wrapper according to the present invention can be prepared in various ways. One preferred starch ester preparation process is disclosed in U.S. Pat. No. 6,605,715 to Lammers et al., which is incorporated by reference herein in its entirety. In such a process, a starch-based feedstock is reacted with an organic carboxylic acid anhydride in the presence of a catalyst at an excess pressure in an essentially anhydrous medium. The excess pressure of the reaction can be generally in the range from 0.01 to 100 bar, and preferably in the range from about 0.5 bar to about 5 bar. Pressures of 5 to 100 bar can be achieved by using a gas atmosphere for raising the pressure. "Essentially anhydrous medium" means that the medium during the reaction contains no more than about 10% by weight of water. The catalyst can comprise sodium acetate, sodium hydroxide, or sulphuric acid. Acetic acid or excess acetanhydride can be used as the reaction medium, or solvent. This process is particularly well suited for the preparation of starch acetates, for example, when an acetic acid anhydride is used as the carboxylic acid anhydride, and acetic acid is used as the carboxylic acid.

The process can be carried out in a temperature range of about 115 degrees C. to about 180 degrees C. A small rise in temperature, for example, about 5 to about 10 degrees C., significantly accelerates the reaction and reduces the reaction time by over 50%. In one example, the reaction mixture can be heated in a closed reaction vessel to a temperature of about 70 degrees to about 100 degrees C., the starch-based feedstock is allowed to react with the carboxylic acid anhydride, and the reaction mixture is cooled in order to maintain its temperature at 129-180 degrees C., after which the reaction mixture can be recovered and the starch ester precipitated from the reaction mixture.

Preferably, no significant degradation of the starch occurs despite the increase in temperature. Thus, the duration of the esterification reaction can be significantly shortened, and the separation of the product can be facilitated. Even higher reaction temperatures may be used, whereby the reaction can, if desired, be carried out without a catalyst.

In such a process, the reaction temperature and viscosity can be controlled to a greater degree than in a conventional unpressurized process. Due to the elevated pressure, the reaction time can be shortened because the reaction rate is dependent on the temperature. In addition, the desired degree of substitution of the final product can be controlled by varying the amount of carboxylic acid anhydride present, thereby optimizing the consumption of the anhydride reagent.

After the reaction components are reacted as described, and the starch ester, for example, a starch acetate, is precipitated from the reaction mixture, the starch slurry can be filtered, washed, and dried. The finished starch ester powder can then be ground, if desired, depending on the coarseness resulting from the manner of precipitation and degree of substitution.

Such a process can be utilized with any native starch having an amylose content of 0% to 100% and an amylopectin content of 100% to 0%. Thus, the starch may be derived from barley, potato, wheat, oats, peas, maize, tapioca, sago, rice, or a similar tuber-bearing or grain plant. The starch ester preparation process can also be utilized with derivatives of such native starches having some free hydroxyl groups by oxidizing, hydrolyzing, cross-linking, cationizing, grafting, or etherifying.

A starch ester useful in making additive materials can be prepared utilizing other processes in addition to, or alternative to, the processes described.

It was discovered that by adding a filler comprising starch to an additive material, the amount of deformability, or diffusivity, of an unheated paper can be enhanced, or controlled. In samples of tobacco paper having a starch-containing additive, as pressure on the paper (created by an ultrasonic force) increases from 0 to, for example, 2300 Newtons, paper diffusivity can decrease to about 0.1 cm/second to about 0.2 cm/second. In these ranges of pressure and diffusivity, the paper maintains an level of opacity acceptable for commercial production of smokable products.

Thus, by adding a starch-containing filler, the paper can be more diffusible with the same amount of pressure. Therefore, the amount of pressure necessary to deform the additive material into a band having desirable dimensions and positions on the paper can be reduced, thereby preserving the integrity of the paper.

Various embodiments of papers suitable for smokable articles were prepared and tested for the effects of embossing on paper diffusivity and porosity, or air permeability.

In one exemplary embodiment, starch pigment filler was prepared by means of a two-stage process according to U.S. Patent Application No. 2007/0101904 of Peltonen et al., which is incorporated by reference herein in its entirety. Such a process includes first preparing a solution comprising a starch derivative (such as a starch ester) by dissolving the starch derivative into a suitable solvent, for example, an organic solvent or, alternatively, in a homogeneous mixture of an organic solvent and non-solvent such as water. The solution is then brought into contact with a non-solvent in which the starch ester does not dissolve in order to precipitate the starch ester from the solvent. As a result, a dispersion is generated that comprises a precipitate comprising starch ester derivative and a liquid phase formed of the solvent and the non-solvent. The solvent is removed from the liquid phase, comprising both solvent and non-solvent, and the precipitate is separated from the non-solvent and recovered. In this manner, optimally shaped particles were be prepared from starch ester and having optical properties better than those of commonly used fillers, for example, precipitated calcium carbonate (PCC).

Paper samples were prepared using 70% hardwood (birch) pulp and 30% softwood (pine) pulp, and a filler comprising either (1) a precipitated calcium carbonate (PCC) having a scalenohedran shape, a size of 1.3 microns, and a 26% filler loading; (2) a starch filler prepared as described and having a 200-400 nm particle size and a 26% filler loading; (3) a starch filler having a 200-400 nm particle size in combination with the PCC and a combined filler loading of 26% (individual samples including 5% starch/21% PCC; 10% starch/16% PCC; 15% starch/11% PCC; and 20% starch/6% PCC); and (4) a starch filler having a particle size larger than 600 nm and a 26% filler loading. Target parameters for the paper samples included a paper basis weight of about 30 g/m$^2$, a filler content (loading) of about 26%, and a Bendtsen air permeability of about 645 ml/min. The paper samples were embossed using a temperature of about 152 degrees C. to about 157 degrees C. and a pressure of 6 bars for 20 seconds. The papers having the different fillers were measured for diffusivities at embossing pressures of 0, 300, 700, 1500, and 2300 Newtons. The highest pressures possible for achieving acceptable paper quality were chosen.

As the applied force on the starch-containing portions of the paper increases, the starch particles undergo a series of changes in proximity, shape, and/or form. An initial increase in applied force causes the starch particles to undergo compaction, or move closer together. A further increase in pressure causes the starch particles to plastically deform, that is, to change from a more spherical shape to a more oval shape, or from an original shape to a flatter shape, such that the particles elongate and become even more tightly packed together. Finally, a further increase in pressure causes the starch particles to be joined to each other into a still smaller space so as to form a film. Thus, as an applied force increases on the starch-containing portions of the paper, the diffusivity of the starch particles and paper decreases. In such a manner, starch fillers can provide low paper diffusivities upon applying pressure, for example, by ultrasonics.

The paper having a larger than 600 nm starch filler has an initially lower diffusivity (in the absence of pressure at 0 Newtons) compared to paper having a 200-400 nm particle size starch filler or paper having only PCC. This is due to the larger starch particles already being maximally packed (ie, tightly compacted) for their size and thus more stable, as compared to smaller starch particles which have the potential to move around and compact further. In one embodiment, for example, paper having a larger than 600 nm starch filler had about a 30% to about a 35% lower diffusivity in the absence of pressure than paper having only scalenohedran-shaped PCC. Accordingly, a larger than 600 nm starch filler is preferred for providing a lower paper diffusivity.

In one embodiment, a paper having 20% filler loading of a 200-400 nm starch filler and 6% filler loading of PCC has about a 10% to about a 30% decrease in diffusivity when undergoing increasing embossing pressures between 0 and 2300 Newtons. This is a greater decrease in diffusivity from increasing pressure than papers having a smaller ratio of starch to PCC (that is, filler loadings of 5% starch/21% PCC; 10% starch/16% PCC; and 15% starch/11% PCC). Further, this decrease in diffusivity is greater than that in a paper having 26% filler loading of a 200-400 nm starch filler without PCC. Accordingly, a paper having a larger ratio of small particle (200-400 nm) starch to PCC (preferably, 20% filler loading of starch and 6% filler loading of PCC) is characterized by a greater decrease in diffusivity from increasing pressure than papers having a smaller ratio of starch to PCC or papers having starch with no PCC. Such a decrease in paper diffusivity is due to movement and compaction of the smaller starch particles in the paper, which is more pronounced in papers having a larger amount of starch.

Another starch-based formulation of the present invention can be applied to a tobacco paper as a coating on a calcium carbonate filler. Applying a starch-coated filler can provide a paper having low ignition propensity and substantially the same strength as an untreated paper, but with a lower weight than conventional papers having only a calcium carbonate filler.

It was discovered that the thickness of the starch-based coating on the paper can affect the ability of the starch and filler to deform to desired dimensions and/or position(s) on the paper. In some embodiments, the ratio of the thickness of the starch to the thickness of the filler, such as precipitated calcium carbonate (PCC), can be in a range from about 1:9 to about 1:1 (equal thicknesses of starch and filler). That is, the thickness of the starch can be in a range from about 10% to about 50%, and the thickness of the filler can be in a range from about 90% to about 50%, of the combined thickness of starch and filler.

A wrapping paper having a starch-coated calcium carbonate filler can be utilized to manufacture smoking articles, such as cigarettes, such that the paper is effective in reducing ignition propensity, or proclivity, while minimizing the chance of discernible changes in smoke delivery and taste to a smoker.

In another exemplary embodiment, paper samples were prepared using 50% hardwood (eucalyptus) and 50% softwood (pine), and a filler comprising either (1) PCC alone having a rhombic shape and a size of 1.4 micron, 1.9 micron, or 2.4 micron; (2) PCC having each of these sizes and coated with one part starch to 9 parts PCC (1:9 ratio); (3) PCC having each of these sizes and coated with one part starch to 3 parts PCC (1:3 ratio); and (4) PCC having each of these sizes and coated with one part starch to one parts PCC (1:1 ratio). Target parameters for the paper samples included a paper basis weight of about 30 g/m$^2$ and a filler content loading of about 29%. The sample papers having each of the described preparations were embossed, and diffusivities were measured for papers having the different fillers at a pressure of 0, 300, 700, 1500, and 2300 Newtons. The highest pressures possible for achieving acceptable paper quality were chosen.

Paper having the 2.4 micron rhombic-shaped PCC exhibited a slightly larger decrease in diffusivity than paper having the 1.9 micron rhombic-shaped PCC, and a significantly larger decrease in diffusivity than paper having the 1.4 micron rhombic-shaped PCC. This is due to the larger rhombic-shaped starch particles undergoing greater compaction than smaller rhombic-shaped starch particles.

In the embodiments of paper having the 2.4 micron rhombic-shaped PCC, a thicker starch coating around the PCC exhibited lower diffusivities in the absence of embossing pressure than paper having less starch coating, or no starch coating, around the PCC. In particular, paper having a 1:1 and a 1:3 starch to PCC ratio had diffusivities in the absence of pressure on average about 15% to about 25% lower than paper having a 1:9 starch to PCC ratio or PCC and no starch coating.

For example, in one embodiment, paper having a 1:1 ratio of starch to PCC exhibited about twice the percentage decrease in diffusivity as paper having no starch coating around the PCC when undergoing increasing embossing pressures between 0 and 2300 Newtons. In each of papers having starch to PCC in a ratio of 1:1, 1:3, or 1:9, the amount of decrease in diffusivity was greater at a lower range of embossing pressure, for example, between 0 and 300 Newtons, than at higher embossing pressures. Each of these decreases in paper diffusivity are due to movement and compaction of starch particles in the papers, which is more pronounced in papers having a larger amount of starch. As the starch particles reach a maximum degree of compaction, the rate of decrease in diffusivity levels off after an initial larger rate of decrease.

Thus, embodiments of papers in accordance with the present invention papers having either a starch filler or a starch-coated PCC experience sufficient movement and compaction of the starch particles so as to provide some decrease in paper diffusivity with increasing embossing pressures from 0 to 2300 Newtons.

The embodiments of papers having a scalenohedran-shaped PCC filler were compared to those having a rhombic-shaped PCC filler. Diffusivity of paper having either scalenohedran-shaped or rhombic-shaped PCC decreases during embossing, which is likely due to compaction of the starch particles into closer proximity with each other. The scalenohedran-shaped PCC unexpectedly exhibits a lower diffusivity at all pressures compared to the rhombic-shaped PCC. For example, in some embodiments, the paper having scalenohedran-shaped PCC has about a 5% to about a 25% less diffusivity than the paper having a 2.4 micron rhombic-shaped PCC. However, this difference in diffusivity decreases as the compressive embossing pressure increases above 300 Newtons. In papers having both PCC and starch, for a PCC filler having either a scalenohedran shape or a rhombic shape, paper diffusivity decreases when the filler includes a larger amount of starch particles.

Each of the paper samples was tested prior to embossing for porosity, or air permeability. A Borgwalt air permeability test was performed on the paper samples, measuring air flow through the paper in cm/minute. A paper having a 200-400 nm starch filler and 20% filler loading of starch and 6% filler loading of PCC had a preferably consistent decrease in air permeability when undergoing increasing embossing pressures from 0 to 2300 Newtons.

Other inorganic fillers, or a combination of such fillers, can be utilized to formulate the additive material comprising a starch-coated filler. For example, other mineral fillers suitable for this purpose include the various phases of calcium carbonate or magnesium carbonate, or the like, along with hydroxides of magnesium or the like.

An additive material, or solution, useful for reducing permeability and controlling the burn characteristics of a smoking article can include a filler material disbursed or suspended in the material. The filler material can be, for example, a particulate, inorganic, non-reactive filler. Adding such a filler to a material applied to the wrapping paper of a smoking article can enhance the reduction in permeability in treated areas of the paper. Inorganic filler particles can be less affected by the heat of the burning smoking article, which can help the applied band remain intact so as to be effective in restricting oxygen to a burning coal. Accordingly, such a filler can improve the ability of treated areas to self-extinguish a burning coal in the smoking article. Various inorganic fillers that can be homogenously disbursed in the band that do not adversely affect the texture or appearance of the wrapping paper may be suitable for this purpose. For example, some representative fillers include chalk, clay, and titanium oxide.

In one aspect of the present invention, the level of filler loading and starch content is optimized so that paper porosity, or permeability, can be controlled as a function of temperature. This helps reduce the amount of pressure needed to deform and apply a starch-containing filler formulation onto the paper. As used herein, "filler loading" means the amount of the total weight of a paper and filler comprised by the filler, which can be expressed as the percent of filler by weight of the total weight of the paper and filler.

While some conventional additive materials, such as film-forming materials, include particulate, inorganic fillers, those filler particles do not tend to enter into the pores of the wrapping paper, and the filler forms a layer on the surface of the paper. However, in some embodiments of the present invention, the filler particles can be sufficiently small to enter the pores of the paper. Alternatively, or in addition, heating the additive material can cause the filler particles to deform sufficiently to enter the pores of the paper. When filler loading is optimized with packing of filler particles in the paper pores, a stronger paper can be created, thereby helping to preserve the integrity of the paper during the use of force to apply the additive additive. An additive material having filler particles integrated into a wrapping paper in such a manner can further enhance the reduction in permeability in treated areas of the paper.

In embodiments of the present invention having optimized loading of starch-containing fillers, the filler loading can be in the range of about 20 percent to about 40 percent.

In another aspect of the present invention, a starch can be applied to a tobacco paper as a "hot melt" formulation. A hot melt formulation can comprise a polymer containing starch, a starch ester, and/or a starch-coated inorganic filler, such as calcium carbonate. Hot melt starch-based materials can be applied to a paper directly, deformed to desired dimensions and positions on the paper, and then cooled. Application of such hot melt starch materials to a paper can be carried out in various ways. For example, the hot melt starch material can be applied as bands to a paper by gravure printing, inkjet printing, spraying, by utilizing a hot embossing process or ultrasonic embossing, as described below, and/or by other methods.

A hot melt formulation comprising a polymer according to the present invention can have melt temperatures as high as 130 degrees Celsius (C). In preferred embodiments, thermoplastic starch materials can have a "low melt" temperature, for example, in the range of about 60 degrees C. to about 70 degrees C. Such materials in these temperature ranges can be extruded for application to a paper web. Cooling, or curing, of the hot melt starch application applied to the paper can be accomplished under ambient conditions. That is, no additional equipment or process is required in order to cool the hot melt application to a desired temperature for further processing of the paper.

One advantage of such a technique for applying a starch-containing band onto the paper is that application of the hot melt formulation can be achieved without a solvent, that is, without any wet chemicals. This allows the application process to proceed without need of a drying step. Avoidance of a drying step can help preserve the integrity of the paper. In addition, in the absence of any solvent, the hot melt formulation can dry, or cure, almost instantly, which provides the ability to apply very thin bands.

A starch useful in making a hot-melt adhesive formulation that can be applied as bands on a paper wrapper according to the present invention can be prepared in various ways. One preferred starch preparation process is disclosed in U.S. Pat. No. 5,780,568 to Vuorenpaa et al., which is incorporated by reference herein in its entirety. In such a process, a starch or starch derivative can be graft-copolymerized with a cyclic ester to produce a starch derivative grafted with an aliphatic polyester. The product obtained by such a process comprises a starch derivative grafted with a polyester and having an aliphatic polyester content of at least 26%, up to 80%, but preferably about 67%. Such starch derivatives grafted with an aliphatic polyester resist deterioration as starch content increases, and are water insoluble, hydrophobic, and impermeable. Products made by such a process are useful for coating of paper to increase the water resistance and reduce water transmission of the paper.

The starch or starch derivative can be graft co-polymerized without a catalyst or with the aid of a suitable ring-opening catalyst with a cyclic ester, which as a result of polymerization, forms aliphatic polyester grafts in the starch or starch derivative. Cyclic esters useful in such a process include, for example, butyrolactone, valerolactone, and caprolactone. The ring-opening catalyst may be any catalyst used in ring-opening polymerization of a cyclic ester, such as an organometallic compound of aluminum, stannum, or zinc.

The process can be implemented as mass polymerization without the use of a solvent or other medium. Oxygen inhibiting the polymerization of aliphatic polyesters is eliminated by performing the polymerization in a nitrogen atmosphere. In such a process, the reaction temperature may be in the range of about 100 degrees C. to about 200 degrees C., preferably in the range of about 150 degrees C. to about 180 degrees C. The reaction time may be between about 3 and about 12 hours, preferably between about 6 and about 12 hours.

The starch may be any native starch, such as barley, potato, wheat, oat, corn, tapioca, sago, rice, or other tuber or grain based starch with an amylase content of 0% to 100% and an amylopectin content of 100% to 0%. The starch derivative may be an alkoxylated starch, for example, hydroxyethyl or hydroxypropyl starch; an esterified starch, for example, starch acetate; a chemically or enzymatically hydrolyzed starch; an oxygenated starch; or a carboxymethylated starch.

Starch derivatives grafted with an aliphatic polyester are particularly useful as a thermoplastic polymer component in a hot-melt adhesive. Hot-melt adhesives comprising such a starch derivative optimally have a melting point that does not exceed the process temperature, preferably below 150 degrees C. Thus, hot-melt adhesives comprising a grafted starch derivative can have a low melting point. Such a grafted starch derivative is characterized by sufficiently stable melt viscosity values, which ensures that the properties of the adhesive being manufactured will not change during manufacture and storage. In addition, hot-melt adhesives comprising a grafted starch derivative can have tensile strength values comparable to other "standard" thermoplastic polymers, such as ethylene vinyl acetate (EVA).

A starch useful in making a hot-melt adhesive that can be applied as bands on a paper wrapper can be prepared utilizing other processes in addition to, or alternative to, the processes described. Some embodiments of a hot melt starch-based formulation can comprise various types of polymers.

One such low-melt base polymer useful in combination with a starch for applying in bands onto paper is polycaprolactone. Polycaprolactone has a low melting point of about 60 degrees C., and is available commercially as CAPA® from Perstorp Polyols, Inc., 600 Matzinger Road, Toledo, Ohio.

Each of a starch ester formulation, a starch-coated calcium carbonate filler, and a starch-containing hot melt formulation can be plastically deformed to form bands on the wrapping paper. Accordingly, the supply of oxygen to smokable material inside a smokable article made from the paper—and ignition propensity in the smokable article—can be controlled. Applying such starch-containing burn control additives to the paper utilizing lower diffusion forces and/or without a drying step, can protect the integrity of the paper. Use of such starch-containing additives and/or paper-protecting application processes allow the wrapping paper to move on a commercial cigarette maker at a rate of about 600 meters per minute in order to meet expected production capabilities. In addition, such additives and application processes permit production of FSC paper having burn-control bands on-line, that is, while on the cigarette maker, and without changing the speed of the paper, or with only minimal change in the speed of the paper. Bands having the materials and applied by the processes of the present invention are detectable on the cigarette maker at this processing speed.

In some embodiments, the bands of starch ester and/or starch-coated calcium carbonate can be applied to the paper utilizing a "hot embossing" technique. "Hot embossing" is defined as essentially the compression of a polymer softened by raising the temperature of the polymer just above its glass transition temperature to form a shape or pattern. A thermoplastic polymer film can be shaped, or thermoformed, in a hot embossing process when the heated polymer is in a molten, liquid phase or in a strongly softened, but still solid phase. Such shaping can be accomplished using various apparatus, such as rollers, stamps, plates, molds, or other pressing devices to provide pressure to the polymer film.

The polymer film can be compressed at various degrees of embossing force, depending on influencing variables including, for example, the polymer material being shaped, the desired end configuration of the polymer film, and the temperature and pressure environment at which the force is applied, among others. For example, a thermoplastic polymer film can be compressed in a low pressure, or evacuated, chamber, which can permit use of lower compressive forces. Likewise, a higher heating temperature may permit use of lower compressive forces to achieve the desired degree of polymer shaping. A hot embossing system can have various advantages, including, for example, the ability to take advantage of the wide range of properties of polymers, utilization of diverse thermoplastic films (including biocompatible substrates), the ability to reliably replicate a hot embossed product, and efficient and economic mass production.

In particular embodiments, the bands can be embossed onto the paper by internal activation, or heating, of the bands using ultrasonic waves, as described below. Such an application process can have the advantage of being a dry process, involving no wet chemicals and no additional chemicals, for example, a solvent. This allows the application process to proceed without need of a drying step, thereby helping to preserve the integrity of the paper. Since the absence of any solvent permits the hot melt formulation to "dry" almost instantly, very thin bands can be applied. When utilizing such a hot embossing process, the bands of starch ester and/or starch-coated calcium carbonate can be laminated as a film. In this manner, a plurality of layers of the bands can be applied on top of other bands, as desired. Another advantage of applying a band of material to a paper in this manner is that hot embossing can provide bands that are not visibly detectable by a consumer. In addition, such a hot embossing process can provide the ability to control product quality by process control mechanisms.

In some embodiments, the bands of starch ester and/or starch-coated inorganic filler can be applied to the paper in a hot embossing process that utilizes ultrasonic waves to activate, or heat, the bands. In such a process of ultrasonic embossing, or bonding, the starch ester and/or starch-coated inorganic filler, such as calcium carbonate, can be formulated into an electrostatic powder suitable for thermoplastically applying in bands on the paper. By heating the electrostatic powder, the amount of pressure applied to the powder and the paper to deform the filler into a band on the paper can be reduced. Thus, in one aspect of the present invention, reducing the amount of pressure to deform a polymer onto a paper helps preserve the integrity of the paper. An ultrasound device, or generator, can be utilized to generate heat only within the polymer, thereby facilitating a reduction in the amount of heat applied directly to the paper and further helping to preserve the integrity of the paper (from heat degradation).

As a form of hot embossing, ultrasonic embossing application of starch-based materials onto tobacco paper has the advantage of being a dry process in which no wet chemicals, such as a solvent, are involved. Accordingly, ultrasonic embossing allows the application of starch-based materials to proceed without need of a drying step, thereby helping to preserve the integrity of the paper. Since the absence of any solvent permits the hot melt formulation to "dry" almost instantly, very thin bands can be applied.

Such a hot embossing, or ultrasonic bonding, process can provide the ability to control product quality by process control mechanisms. As bands of starch ester and/or starch-coated calcium carbonate are applied onto the paper by ultrasonic means, the application apparatus, such as a roller or anvil drum over which the paper web travels, can expand due to the heat generated by multiple applications in rapid succession. In addition, the paper can have inconsistencies that may be otherwise acceptable in commercial production of tobacco paper and smokable articles using such paper. Thermal expansion of the apparatus and inconsistencies in the paper, as well as other processing variables, can create variations in the thickness of the bands on the final paper product. To compensate for such variables, the system for ultrasonic application of starch-containing bands onto the paper can include a means for maintaining a constant gap between the portion of the ultrasonic generating device adjacent the paper (for example, a sound probe) and the structure on which the paper moves, for example, an anvil drum (not shown). A closed-loop feedback control of the gap between these surfaces as the paper moves past can provide real-time control of the thickness of the bands in response to such factors.

In some embodiments of an ultrasonic embossing process, the bands of starch ester and/or starch-coated calcium carbonate can be laminated onto the paper as a film. In this manner, a plurality of layers of the bands can be applied on top of other bands, as desired.

The paper wrapping material of the present invention can have can be coated in patterns having predetermined shapes. The coating can have the form of bands, cross directional lines or bands (including those that are perpendicular or at angles to the longitudinal axis of the wrapping material), stripes, grids, longitudinally extending lines, circles, hollow circles, dots, ovals, checks, spirals, swirls, helical bands, diagonally crossing lines or bands, triangles, hexagonals, honeycombs, ladder-type shapes, zig zag shaped stripes or bands, sinusoidal shaped stripes or bands, square wave shaped stripes or bands, patterns composed of coated regions that are generally "C" or "U" shaped, patterns composed of coated regions that are generally "E" shaped, patterns composed of coated regions that are generally "S" shaped, patterns composed of coated regions that are generally "T" shaped, patterns composed of coated regions that are generally "V" shaped, patterns composed of coated regions that are generally "W" shaped, patterns composed of coated regions that are generally "X" shaped, patterns composed of coated regions that are generally "Z" shaped, or other desired shapes. Combinations of the foregoing shapes also can used to provide the desired pattern. Preferred patterns are cross directional lines or bands that are essentially perpendicular to the longitudinal axis of the wrapping material.

The relative sizes or dimensions of the various shapes and designs can be selected as desired. For example, shapes of coated regions, compositions of the coating formulations, or amounts or concentrations of coating materials, can change over the length of the wrapping material. The relative positioning of the printed regions can be selected as desired. For example, wrapping materials that are used for the production of cigarettes designed to meet certain cigarette extinction test criteria, the pattern most preferably has the form of spaced continuous bands that are aligned transversely or cross directionally to the longitudinal axis of the wrapping material. However, cigarettes can be manufactured from wrapping materials possessing discontinuous bands positioned in a spaced apart relationship. For wrapping materials of those cigarettes, it is most preferred that discontinuous bands (e.g., bands that are composed of a pattern, such as a series of dots, grids or stripes) cover at least about 70 percent of the surface of the band area or region of the wrapping material.

Preferred wrapping materials possess coatings in the form of bands that extend across the wrapping material, generally perpendicular to the longitudinal axis of the wrapping material. The widths of the individual bands can vary, as well as the spacings between those bands. Typically, those bands have widths of at least about 0.5 mm, usually at least about 1 mm, frequently at least about 2 mm, and most preferably at least about 3 mm. Typically, those bands have widths of up to about 8 mm, usually up to about 7 mm. Preferred bands have widths of about 4 mm to about 7 mm, and often have widths of about 6 mm to about 7 mm. Such bands can be spaced apart such that the spacing between the bands is at least about 10 mm; often at least about 15 mm, frequently at least about 20 mm, often at least about 25 mm, in certain instances at least about 30 mm, and on occasion at least about 35 mm; but such spacing usually does not exceed about 50 mm. For certain preferred wrapping materials, the bands are spaced apart such that the spacing between the bands is about 15 mm to about 25 mm.

There are several factors that determine a specific coating pattern for a wrapping material of the present invention. It is desirable that the components of the coating formulations applied to wrapping materials not adversely affect to any significant degree (i) the appearance of cigarettes manufactured from those wrapping materials, (ii) the nature or quality of the smoke generated by those cigarettes, (iii) the desirable burn characteristics of those cigarettes, or (iv) the desirable performance characteristics of those cigarettes. It also is desirable that wrapping materials having coating formulations applied thereto not introduce undesirable off-taste, or otherwise adversely affect the sensory characteristics of the smoke generated by cigarettes manufactured using those wrapping materials. In addition, preferred cigarettes of the present invention do not have a tendency to undergo premature extinction, such as when lit cigarettes are held in the smoker's hand or when placed in an ashtray for a brief period of time.

Cigarettes designed to meet certain cigarette extinction test criteria can be produced from wrapping materials of the present invention. Banded regions on a wrapping material are produced using additive materials that are effective in reducing the inherent porosity of the wrapping material in those regions. Additive materials and fillers applied to the wrapping material in those banded regions are effective in increasing the weight of the wrapping material in those regions. Filler materials that are applied to the wrapping material in those banded regions are effective in decreasing the burn rate of the wrapping materials in those regions. Typically, when wrapping materials of relatively high inherent porosity are used to manufacture cigarettes, those wrapping materials possess relatively high weight bands that introduce a relatively low inherent porosity to the banded regions. Additive materials, such as film-forming materials, have a tendency to reduce the porosity of the wrapping material, whether or not those materials are used in conjunction with fillers. However, coatings that combine porosity reduction with added coating weight to wrapping materials also are effective in facilitating extinction of cigarettes manufactured from those wrapping materials. Low porosity in selected regions of a wrapping material tends to cause a lit cigarette to extinguish due to the decrease in access to oxygen for combustion for the smokable material within that wrapping material. Increased weight of the wrapping material also tends to cause lit cigarette incorporating that wrapping material to extinguish. As the inherent porosity of the wrapping material increases, it also is desirable to (a) select an additive material so as to cause a decrease the inherent porosity of the coated region of the wrapping material and/or (b) provide a coating that provides a relatively large amount of added weight to the coated region of the wrapping material.

Cigarettes of the present invention possessing tobacco rods manufactured using certain appropriately treated wrapping materials of the present invention, when tested using the methodology set forth in the Cigarette Extinction Test Method by the National Institute of Standards and Technology (NIST), Publication 851 (1993) using 10 layers of Whatman No. 2 filter paper, meet criteria requiring extinction of greater than about 50 percent, preferably greater than about 75 percent, and most preferably about 100 percent, of cigarettes tested. Certain cigarettes of the present invention possessing tobacco rods manufactured using certain appropriately treated wrapping materials of the present invention, when tested using the methodology set forth in the methodology set forth in ASTM Designation: E 2187-02b using 10 layers of Whatman No. 2 filter paper, meet criteria requiring extinction of greater than about 50 percent, preferably greater than about 75 percent, and most preferably about 100 percent, of cigarettes tested. Preferably, each cigarette possesses at least one band located in a region of its tobacco rod such that the band is capable of providing that cigarette with the ability to meet those cigarette extinction criteria. For a tobacco rod of a particular length incorporating a wrapping material possessing bands that are aligned transversely to the longitudinal axis of the wrapping material in a spaced apart relationship, the ratio of the length of the tobacco rod to the sum of the width of a band and the distance between the bands is 1 to 2, preferably about 1.1 to about 1.4, and most preferably about 1.2.

Paper wrapping materials of the present invention are useful as components of smoking articles such as cigarettes. Preferably, one layer of the wrapping material of the present invention is used as the wrapping material circumscribing the smokable material, and thereby forming the tobacco rod of a cigarette. In one regard, it is preferable that the wrapping material possesses the coated regions located on the "wire" side thereof, and the "wire" side of that wrapping material forms the inner surface of the circumscribing wrapping material of the tobacco rod. That is, when the wrapping material is used to manufacture a smokable rod, the "wire side" major surface of the wrapping material that circumscribes the smokable material faces that smokable material. Typically, the "felt" side of the wrapping material is used as the visible outer surface of the tobacco rod. The terms "wire side" and "felt side" in referring to the major surfaces of paper sheet are readily understood as terms of art to those skilled in the art of paper and cigarette manufacture.

Cigarettes of the present invention can possess certain appropriately treated wrapping materials of the present invention. The wrapping material can possess patterns of predetermined shapes and sizes positioned at predetermined locations, and hence, cigarettes appropriately manufactured from that wrapping material can possess patterns of predetermined shapes and sizes positioned at predetermined locations on their smokable rods. The wrapping material can possess patterns of predetermined composition positioned at predetermined locations, and hence, cigarettes appropriately manufactured from that wrapping material can possess patterns of predetermined composition positioned at predetermined locations on their smokable rods. The foregoing types of patterns can introduce certain properties or behaviors to specific regions of those smokable rods (e.g., the patterns can provide specific regions of increased weight, decreased permeability and/or increased burn retardant composition to wrapping material). For example, a wrapping material that possesses bands that surround the column of smokable material of the smokable rod and that decrease the permeability of the wrapping material (e.g., the wrapping material can have bands applied thereto and the bands can be positioned thereon) can be such that each acceptable smokable rod manufactured from that wrapping material can possess at least two identical bands on the wrapping material surrounding the tobacco column, and the spacing between the bands, measured from the inside adjacent edges of the bands, is no less than 15 mm and no greater than 25 mm.

Certain preferred cigarettes incorporate banded wrapping materials for the column of smokable material. The wrapping material of each preferred smokable rod can possess at least one band. Alternatively, the wrapping material of each preferred smokable rod can possess at least two bands, and those bands can be virtually identical. The band spacing on the wrapping material can vary. Typically, bands are spaced about 15 mm to about 60 mm apart, often about 15 mm to about 45 mm apart, and frequently about 15 mm to about 30 mm apart. For certain preferred wrapping materials, smokable rods and cigarettes, the band spacing, measured from the inside adjacent edges of the bands, is no less than 15 mm and no greater than 25 mm, and in certain preferred embodiments is about 18 mm to about 20 mm. Certain cigarettes can possess bands that are spaced on the wrapping materials of those cigarettes such that each cigarette possesses a band or bands of the desired configuration and composition in essentially identical locations on each tobacco rod of each cigarette. See also U.S. Pat. No. 7,234,471 to Fitzgerald et al. for further description of compositions of bands and methods, techniques, and parameters for applying those bands onto cigarette paper.

Cigarettes of the present invention can be manufactured from a variety of components, and can have a wide range of formats and configurations. Typical cigarettes of the present invention having cross directional bands applied to the wrapping materials of the tobacco rods of those cigarettes (e.g., virtually perpendicular to the longitudinal axes of those cigarettes) have static burn rates (i.e., burn rates of those cigarettes under non-puffing conditions) of about 50 to about 60 mg tobacco rod weight per minute, in the non-banded regions of those cigarettes. Typical cigarettes of the present invention having cross directional bands applied to the wrapping materials of the tobacco rods of those cigarettes have static burn rates (i.e., burn rates of those cigarettes under non-puffing conditions) of less than about 50 mg tobacco rod weight per minute, preferably about 40 to about 45 mg tobacco rod weight per minute, in the banded regions of those cigarettes.

The tobacco materials used for the manufacture of cigarettes of the present invention can vary. Descriptions of various types of tobaccos, growing practices, harvesting practices and curing practices are set for in *Tobacco Production, Chemistry and Technology*, Davis et al. (Eds.) (1999). The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within a cigarette ranges from about 0.6 g to about 1 g. The tobacco filler normally is employed so as to filler the tobacco rod at a packing density of about 100 mg/cm$^3$ to about 300 mg/cm$^3$, and often about 150 mg/cm$^3$ to about 275 mg/cm$^3$. Tobaccos can have a processed form, such as processed tobacco stems (e.g., cut-rolled or cut-puffed stems), volume expanded tobacco (e.g., puffed tobacco, such as propane expanded tobacco and dry ice expanded tobacco (DIET)), or reconstituted tobacco (e.g., reconstituted tobaccos manufactured using paper-making type or cast sheet type processes).

Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes,* 3$^{rd}$ Ed., p. 43 (1990) and *Tobacco Production, Chemistry and Technology*, Davis et al. (Eds.) p. 346 (1999). Other representative tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; and U.S. Pat. No. 5,714,844 to Young et al.; US Patent Applications 2002/0000235; 2003/0075193; and 2003/0131859; PCT WO 02/37990; U.S. patent application Ser. No. 10/285,395, filed Oct. 31, 2002 and Ser. No. 10/463,211, filed Jun. 17, 2003; and Bombick et al., *Fund Appl. Toxicol.,* 39, p. 11-17 (1997); which are incorporated herein by reference.

If desired, in addition to the aforementioned tobacco materials, the tobacco blend of the present invention can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco*

*Flavoring Substances and Methods*, Noyes Data Corp. (1972) and Leffingwell et al., *Tobacco Flavoring for Smoking Products* (1972).

Smoking articles also can incorporate at least one flavor component within the side seam adhesive applied to the wrapping material during the manufacture of the tobacco rods. That is, for example, various flavoring agents can be incorporated in a side seam adhesive CS-2201A available from R. J. Reynolds Tobacco Company, and applied to the seam line of the wrapping material. Those flavoring agents are employed in order to mask or ameliorate any off-taste or malodor provided to the smoke generated by smoking articles as a result of the use of the wrapping materials of the present invention, such as those wrapping materials having coating formulations incorporating certain cellulosic-based or starch-based components applied thereto. Exemplary flavors include methyl cyclopentenolone, vanillin, ethyl vanillin, 4-parahydroxyphenyl-2-butanone, gamma-undecalactone, 2-methoxy-4-vinylphenol, 2-methoxy-4-methylphenol, 5-ethyl-3-hydroxy-4-methyl-2(5H)-furanone, methyl salicylate, clary sage oil and sandalwood oil. Typically, such types of flavor components are employed in amounts of about 0.2 percent to about 6.0 percent, based on the total weight of the adhesive and flavor components.

Cigarettes preferably have a rod shaped structure and a longitudinal axis. Such cigarettes each have a column of smokable material circumscribed by wrapping material of the present invention. Preferably, the wrapping material encircles the outer longitudinally extending surface of the column of smokable material, and each end of the cigarette is open to expose the smokable material. Exemplary cigarettes, and exemplary components, parameters and specifications thereof, are described in U.S. Pat. No. 5,220,930 to Gentry; PCT WO 02/37990 and U.S. Patent Application 2002/0166563; which are incorporated herein by reference. Representative filter element components and designs are described in Browne, *The Design of Cigarettes,* 3rd Ed. (1990); *Tobacco Production, Chemistry and Technology*, Davis et al. (Eds.) 1999; U.S. Pat. No. 4,508,525 to Berger; U.S. Pat. No. 4,807,809 to Pryor et al.; U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones, Jr. et al.; U.S. Pat. No. 5,101,839 to Jakob et al.; U.S. Pat. No. 5,105,834 to Saintsing et al.; U.S. Pat. No. 5,105,838 to White et al.; U.S. Pat. No. 5,271,419 to Arzonico et al.; U.S. Pat. No. 5,360,023 to Blakley et al; U.S. Pat. No. 5,595,218 to Koller et al.; U.S. Pat. No. 5,718,250 to Banerjee et al.; and U.S. Pat. No. 6,537,186 to Veluz; US Patent Applications 2002/0014453; 2002/0020420; and 2003/0168070; U.S. patent application Ser. No. 10/600,712, filed Jun. 23, 2003, to Dube et al.; PCT WO 03/059096 to Paine et al.; and European Patent No. 920816. Representative filter materials can be manufactured from tow materials (e.g., cellulose acetate or polypropylene tow) or gathered web materials (e.g., gathered webs of paper, cellulose acetate, polypropylene or polyester). Certain filter elements can have relatively high removal efficiencies for selected gas phase components of mainstream smoke.

Although the present invention has been described with reference to particular embodiments, it should be recognized that these embodiments are merely illustrative of the principles of the present invention. Those of ordinary skill in the art of smoking article design and manufacture will appreciate that the various systems, equipment and methods may be constructed and implemented in other ways and embodiments. Accordingly, the description herein should not be read as limiting the present invention, as other embodiments also fall within the scope of the present invention.

What is claimed is:

1. A wrapping paper for a smokable rod comprising:

a pattern of intermittent bands applied to a wire side surface of the wrapping paper, the bands comprising a water-insoluble material comprising a starch in an amount such that the material is sufficiently deformable so as to (a) reduce an amount of pressure to apply the bands, (b) decrease paper diffusivity, and (c) maintain paper opacity at a level acceptable for commercial production of the smokable rods wherein the starch in the water-soluble material comprises a starch-coated inorganic filler, and the starch-coated inorganic filler comprises calcium carbonate, and wherein the ratio of the thickness of the starch to the thickness of the calcium carbonate in the starch-coated inorganic filler is about 1:1 to about 1:3.

2. The wrapping paper of claim 1, wherein the pattern of bands is adapted to reduce a porosity of the paper so as to decrease a supply of oxygen to a smokable material inside the rod and thereby reduce ignition propensity of the smokable rod.

3. The wrapping paper of claim 1, wherein the starch comprises a starch ester.

4. The wrapping paper of claim 1, wherein the starch comprises a particle size of about 200 nm to about 1000 nm.

5. The wrapping paper of claim 1, wherein the starch has a size of about 200 nm to about 400 nm and the starch comprises a filler loading of about 20% based on the total weight of the filler and the calcium carbonate comprises a filler loading of about 6% based on the total weight of the filler.

6. The wrapping paper of claim 1, wherein the calcium carbonate filler comprises a size in the range of about 0.5 microns to about 2.4 microns.

7. The wrapping paper of claim 1, wherein the calcium carbonate comprises a scalenohedron-shaped or a rhombic-shaped precipitated calcium carbonate.

8. The wrapping paper of claim 1, wherein the material further comprises a hot melt formulation comprising a thermoplastic polymer.

9. The wrapping paper of claim 8, wherein the hot melt formulation comprises a melting temperature in a range of about 60 degrees C. to about 130 degrees C.

10. The wrapping paper of claim 8, wherein the thermoplastic polymer comprises a polycaprolactone.

11. The wrapping paper of claim 10, wherein heating the paper above 220 degrees C. decreases the paper diffusivity.

12. The wrapping paper of claim 8, wherein the hot melt material is applied to the paper without a solvent and is curable at ambient temperature.

13. The wrapping paper of claim 8, wherein the hot melt formulation comprises an electrostatic powder adapted for application to the paper utilizing ultrasonic waves.

14. The wrapping paper of claim 8, wherein the starch comprises a starch derivative grafted with an aliphatic polyester formed from copolymerization of the starch with a cyclic ester.

15. The wrapping paper of claim 1, wherein the paper without the material comprises a dry basis weight in the range of about 20 $g/m^2$ to about 30 $g/m^2$.

16. The wrapping paper of claim 1, wherein the bands are adapted to be applied to the paper on-line on a cigarette making apparatus without changing a speed of the paper.

17. The wrapping paper of claim 1, wherein commercial production of the smokable rods comprises a paper speed of about 600 meters per minute.

18. The wrapping paper of claim 3, wherein the starch ester comprises a starch acetate.

19. A wrapping paper for a smokable rod comprising:

a pattern of intermittent bands applied to a wire side surface of the wrapping paper, the bands comprising a water-insoluble material comprising a filler, and the filler comprises at least one of a starch and a starch-coated inorganic filler in an amount such that the material is sufficiently deformable so as to (a) reduce an amount of pressure to apply the bands, (b) decrease paper diffusivity, and (c) maintain paper opacity at a level acceptable for commercial production of the smokable rods wherein the starch comprises a starch ester and has a size of about 200 nm to about 400 nm, wherein the filler further comprises a calcium carbonate filler, and wherein the starch comprises a filler loading of about 20% based on the total weight of the filler and the calcium carbonate comprises a filler loading of about 6% based on the total weight of the filler.

20. The wrapping paper of claim 19, wherein the pattern of bands is adapted to reduce a porosity of the paper so as to decrease a supply of oxygen to a smokable material inside the rod and thereby reduce ignition propensity of the smokable rod.

21. The wrapping paper of claim 19, wherein the starch ester and/or a starch-coated filler comprise a total loading weight in a range of about 25 percent to about 30 percent of the total weight of the paper and starch ester and/or filler.

22. The wrapping paper of claim 19, wherein the calcium carbonate is starch-coated, and wherein the ratio of the thickness of the starch to the thickness of the calcium carbonate in the starch-coated calcium carbonate is in the range of about 1:1 to about 1:3.

23. The wrapping paper of claim 19, wherein the material is applied to the paper without a solvent and is curable at ambient temperature.

24. The wrapping paper of claim 19, wherein the material further comprises a hot melt formulation comprising a thermoplastic polymer having a melting temperature in a range of about 60 degrees to about 130 degrees C.

25. The wrapping paper of claim 19, wherein the paper further comprises a fire standard compliant paper having a self-extinction rate of at least 75% in a standard (ASTM) test of ignition strength.

26. The wrapping paper of claim 19, wherein the bands are adapted to be applied to the paper on-line on a cigarette making apparatus without changing a speed of the paper.

27. A cigarette, comprising:

a column of smokable material;

a wrapping paper having a wire side surface and a felt side surface circumscribing the smokable material such that the felt side surface of the paper faces the smokable material; and a pattern of intermittent bands applied to the wire side surface of the paper, the bands comprising a water-insoluble material comprising at least one of a starch ester and a starch-coated inorganic filler in an amount such that the material is sufficiently deformable so as to (a) reduce an amount of pressure to apply the bands, (b) decrease paper diffusivity, and (c) maintain paper opacity at a level acceptable for commercial production of the cigarette, wherein the pattern of bands is adapted to reduce a porosity of the paper so as to decrease a supply of oxygen to the smokable material inside the paper and thereby reduce ignition propensity of the cigarette wherein the starch-coated inorganic filler comprises calcium carbonate and wherein the ratio of the thickness of the starch ester to the thickness of the calcium carbonate in the starch-coated inorganic filler is about 1:1 to about 1:3.

28. The cigarette of claim 27, wherein the starch ester and/or starch-coated filler comprise a total loading weight in a range of about 25 percent to about 30 percent of the total weight of the paper and starch ester and/or filler.

29. The wrapping paper of claim 27, wherein the material further comprises a hot melt formulation comprising a thermoplastic polymer having a melting temperature in a range of about 60 degrees C. to about 130 degrees C.

30. A cigarette, comprising:

a column of smokable material;

a wrapping paper having a wire side surface and a felt side surface circumscribing the smokable material such that the felt side surface of the paper faces the smokable material; and a pattern of intermittent bands applied to the wire side surface of the paper, the bands comprising a water-insoluble material comprising at least one of a starch ester having a size of about 200 nm to about 400 nm and a starch-coated inorganic filler comprising calcium carbonate in an amount such that the material is sufficiently deformable so as to (a) reduce an amount of pressure to apply the bands, (b) decrease paper diffusivity, and (c) maintain paper opacity at a level acceptable for commercial production of the cigarette, wherein the pattern of bands is adapted to reduce a porosity of the paper so as to decrease a supply of oxygen to the smokable material inside the paper and thereby reduce ignition propensity of the cigarette wherein the material comprises a filler comprising the starch ester and the calcium carbonate, and wherein the starch ester comprises a filler loading of about 20% percent based on the total weight of the filler and the calcium carbonate comprises a filler loading of about 6% based on the total weight of the filler.

31. The cigarette of claim 30, wherein the ratio of the thickness of the starch ester to the thickness of the calcium carbonate in the starch-coated inorganic filler is about 1:1 to about 1:3.

32. The cigarette of claim 30, wherein the starch ester and/or starch-coated filler comprise a total loading weight in a range of about 25 percent to about 30 percent of the total weight of the paper and starch ester and/or filler.

33. The wrapping paper of claim 30, wherein the material further comprises a hot melt formulation comprising a thermoplastic polymer having a melting temperature in a range of about 60 degrees C. to about 130 degrees C.

* * * * *